US009455058B2

(12) United States Patent
Oishi

(10) Patent No.: US 9,455,058 B2
(45) Date of Patent: Sep. 27, 2016

(54) HIGH-STRENGTH AND HIGH-ELECTRICAL CONDUCTIVITY COPPER ALLOY ROLLED SHEET AND METHOD OF MANUFACTURING THE SAME

(75) Inventor: Keiichiro Oishi, Tokyo (JP)

(73) Assignee: MITSUBISHI SHINDOH CO., LTD., Tokyo (JP)

( * ) Notice: Subject to any disclaimer, the term of this patent is extended or adjusted under 35 U.S.C. 154(b) by 997 days.

(21) Appl. No.: 13/144,057

(22) PCT Filed: Dec. 25, 2009

(86) PCT No.: PCT/JP2009/071599

§ 371 (c)(1),
(2), (4) Date: Jul. 11, 2011

(87) PCT Pub. No.: WO2010/079707

PCT Pub. Date: Jul. 15, 2010

(65) Prior Publication Data

US 2011/0265917 A1 Nov. 3, 2011

(30) Foreign Application Priority Data

Jan. 9, 2009 (JP) ..... 2009-003666

(51) Int. Cl.

| | |
|---|---|
| ***C22C 9/02*** | (2006.01) |
| ***C22F 1/08*** | (2006.01) |
| ***H01B 1/02*** | (2006.01) |
| ***C22C 9/06*** | (2006.01) |

(52) U.S. Cl.

CPC ..... *H01B 1/026* (2013.01); *C22C 9/02* (2013.01); *C22C 9/06* (2013.01); *C22F 1/08* (2013.01)

(58) Field of Classification Search

USPC ..... 148/411, 432, 433, 501

See application file for complete search history.

(56) References Cited

U.S. PATENT DOCUMENTS

| | | | |
|---|---|---|---|
| 2,074,713 | A | 3/1937 | Tross |
| 4,073,667 | A | 2/1978 | Caron et al. |

(Continued)

FOREIGN PATENT DOCUMENTS

| | | | |
|---|---|---|---|
| CN | 1546701 | A | 11/2004 |
| CN | 1693502 | A | 11/2005 |

(Continued)

OTHER PUBLICATIONS

Taiwanese office action issued in related matter 099100411 on Oct. 22, 2013.

(Continued)

*Primary Examiner* — Devang R Patel

(74) *Attorney, Agent, or Firm* — Griffin and Szipl PC

(57) ABSTRACT

In a high-strength and high-electrical conductivity copper alloy rolled sheet, 0.14 to 0.34 mass % of Co, 0.046 to 0.098 mass % of P, 0.005 to 1.4 mass % of Sn are contained, [Co] mass % representing a Co content and [P] mass % representing a P content satisfy the relationship of $3.0 \leq ([Co]-0.007)/([P]-0.009) \leq 5.9$, a total cold rolling ratio is equal to or greater than 70%, a recrystallization ratio is equal to or less than 45% a an average grain size of recrystallized grains is in the range of 0.7 to 7 μm, an average grain diameter of precipitates is in the range of 2.0 to 11 nm, and an average grain size of fine crystals is in the range of 0.3 to 4 μm. By the precipitates of Co and P, the solid solution of Sn, and fine crystals, the strength, conductivity and ductility of the copper alloy rolled sheet are improved.

13 Claims, 3 Drawing Sheets

(56) References Cited

U.S. PATENT DOCUMENTS

| | | | | |
|---|---|---|---|---|
| 4,260,432 | A | 4/1981 | Plewes | |
| 4,388,270 | A | 6/1983 | Stavish et al. | |
| 4,427,627 | A | 1/1984 | Guerlet et al. | |
| 4,666,667 | A | 5/1987 | Kamio et al. | |
| 5,004,498 | A | 4/1991 | Shimamura et al. | |
| 5,322,575 | A | 6/1994 | Endo et al. | |
| 5,814,168 | A | 9/1998 | Hatakeyama et al. | |
| 6,132,529 | A | 10/2000 | Hatakeyama et al. | |
| 7,608,157 | B2 | 10/2009 | Oishi | |
| 7,928,541 | B2 | 4/2011 | Miwa et al. | |
| 2006/0016528 | A1 | 1/2006 | Hatakeyama | |
| 2006/0260721 | A1 | 11/2006 | Oichi | |
| 2007/0051442 | A1 | 3/2007 | Yamamoto et al. | |
| 2009/0014102 | A1 | 1/2009 | Hatakeyama | |
| 2009/0084473 | A1* | 4/2009 | Aruga et al. | 148/554 |
| 2010/0008817 | A1 | 1/2010 | Ando | |
| 2010/0047112 | A1 | 2/2010 | Fugono et al. | |
| 2010/0206513 | A1 | 8/2010 | Hattori et al. | |
| 2010/0297464 | A1 | 11/2010 | Oishi | |
| 2011/0056596 | A1* | 3/2011 | Oishi | 148/680 |
| 2011/0100676 | A1 | 5/2011 | Oishi | |
| 2011/0200479 | A1* | 8/2011 | Mihara et al. | 420/470 |

FOREIGN PATENT DOCUMENTS

| | | | |
|---|---|---|---|
| EP | 1630240 | A1 | 3/2006 |
| JP | 60-245753 | A | 12/1985 |
| JP | 60-245754 | A | 12/1985 |
| JP | 63-65039 | A | 3/1988 |
| JP | 01-108322 | A | 4/1989 |
| JP | 04-272148 | A | 9/1992 |
| JP | 06-094390 | A | 4/1994 |
| JP | 10-130754 | A | 5/1998 |
| JP | 10-168532 | | 6/1998 |
| JP | 11-97609 | A | 4/1999 |
| JP | 11-256255 | | 9/1999 |
| JP | 2001-214226 | A | 8/2001 |
| JP | 2001-316742 | | 11/2001 |
| JP | 2003-268467 | | 9/2003 |
| JP | 2004-137551 | | 5/2004 |
| JP | 2004-292917 | A | 10/2004 |
| TW | 200417616 | | 9/2004 |
| TW | 200706660 | | 2/2007 |
| WO | 2004/079026 | A1 | 9/2004 |
| WO | 2007-139213 | A1 | 12/2007 |
| WO | 2008/099892 | A1 | 8/2008 |
| WO | 2009/107586 | A1 | 9/2009 |

OTHER PUBLICATIONS

Office Action issued in co-pending related U.S. Appl. No. 13/144,034 on Apr. 26, 2013.
Office Action issued in co-pending U.S. Appl. No. 12/808,564 on Jun. 5, 2014.
Fundamentals of Rockwell Hardness Testing, www.wilsoninstrumenets.com, 2004, pp. 1-15.
Office Action issued in co-pending related U.S. Appl. No. 12/555,990 on Mar. 27, 2014.
Office Action issued in co-pending related U.S. Appl. No. 12/919,206 on Mar. 12, 2014.
E. Paul Degarmo et al., Materials and Processes in Manufacturing 383-384 (9th ed. 2003), filed in a related application as Exhibit A1.
Copper Parts Data Book, pp. 88 and 94 (1997).
Copper and Copper Alloys, ASM Specialty Handbook, pp. 3-4, and 454 (2001).
1994 Annual Book of ASTM Standards, vol. 02.01, 480-486 and 514-521 (1994), filed in a related application Exhibit A1.
International Search Report issued in corresponding application PCT/JP2009/071599, completed Mar. 19, 2010 and mailed Apr. 6, 2010.
Office Action issued in related Taiwanese application 097143579 on Oct. 24, 2012.
ASM Specialty Handbook, Copper and Copper Alloys, 2001, p. 521, filed in related U.S. Appl. No. 12/808,564 as Exhibit C.
Metals Handbook, Tenth Edition, vol. 2 Properties and Selection: Nonferrous Alloys and Special-Purpose Materials, "Wrought Copper and Copper Alloy Products," 1990, pp. 241-243.
International Search Report issued in related application PCT/JP2009/071606, completed Mar. 19, 2010 and mailed Apr. 6, 2010.
Table 1, compositions and elemental relationships of sample alloy Nos. 5-11, and Table 2, experimental results of alloy Nos. 55-61, submitted in related U.S. Appl. No. 12/555,990 as Exhibit A.
International Search Report issued in related application PCT/JP2008/070410, completed Jan. 23, 2009 and mailed Feb. 10, 2009.
Restriction Election issued in co-pending related U.S. Appl. No. 13/144,034 on Apr. 18, 2012.
Office Action issued in related Canadian application 2,706,199 on Dec. 2, 2011.
Espacenet English Abstract of JP 10-130754 (filed as Exhibit A1 in related U.S. Appl. No. 12/555,990), modified 2011.
Definition of Tensile Strength, at http://metals.about.com/library/bldef-Tensile-Strength.htm (2002), (filed as Exhibit A2 in related U.S. Appl. No. 12/555,990).
"Definition of Hardness," at http://metals.about.com/library/bldef-Hardness.htm (2002), (filed as Exhibit A3 in related U.S. Appl. No. 12/555,990).
"Definition of Proof Stress," at http://metals.about.com/library/bldef-Proof-Stress.htm (2002), (filed as Exhibit A4 in related U.S. Appl. No. 12/555,990).
Pierre Leroux, Breakthrough Indentation Yield Strength Testing (Nanovea 2011), (filed as Exhibit A5 in related U.S. Appl. No. 12/555,990).
Copper and Copper Alloys of the ASM Specialty Handbook®, p. 454 (filed as Exhibit A6 in related U.S. Appl. No. 12/555,990), 2001.
Copper and Copper Alloys of the ASM Specialty Handbook®, pp. 3 and 4 (filed as Exhibit A7 in related U.S. Appl. No. 12/555,990), 2001.
Standards Handbook: Part 2—Alloy Data, Wrought Copper and Copper Alloy Mill Products 34 and 38 (Copper Development Association, Inc. 1985), (filed as Exhibit A8 in related U.S. Appl. No. 12/555,990).
Yield Strength—Strength(Mechanics) of Materials, at http://www.engineersedge.com/material_science/yield_strength.htm (downloaded Apr. 18, 2012), two pages.
J.R. Davies (ed.), ASM Specialty Handbook Copper and Copper Alloys 8-9 (ASM International), filed as Exhibit A in related U.S. Appl. No. 13/514,680, 2001.
E. Paul Degarmo et al., Materials and Processes in Manufacturing 402-404, 432-434, 989-998 (John Wiley & Sons, Inc. 2003).
Data Sheet No. A 6 Cu-DHP, Consel International Pour Le Developpement Du Cuivre, pp. 1, 2 and 4 (1968) submitted in a related application as Exhibit B.
Copper Parts Data Book, pp. 88 and 94 (1997), submitted in a related application as Exhibit C.
Office Action issued in co-pending related U.S. Appl. No. 12/555,990 on Apr. 14, 2011.
International Search Report issued in corresponding application No. PCT/JP2009/053216, completed May 19, 2009 and mailed May 26, 2009.
J.R. Davies (ed.), ASM Specialty Handbook Copper and Copper Alloys 8-9 (ASM International), filed as Exhibit A in related application, 2001.
J.R. Davies (ed.), ASM Specialty Handbook Copper and Copper Alloys 243-247 (ASM International 2001), filed as Exhibit D in related application.

* cited by examiner

FIG. 2

(a)

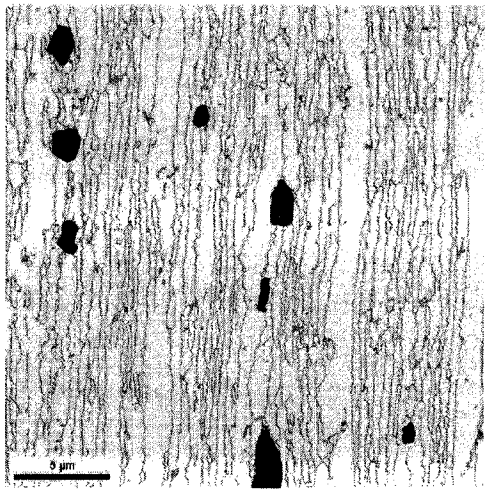

5μm RECRYSTALLIZATION

RECRYSTALLIZATION RATIO : 3%

AVERAGE GRAIN SIZE OF RECRYSTALLIZATION PORTION : 1.5μm

・TEST NO. 2 OF TABLE 20

・ALLOY NO. 21

・METAL STRUCTURE AFTER FINAL PRECIPITATION HEAT TREATMENT IN PROCESS C6

(b)

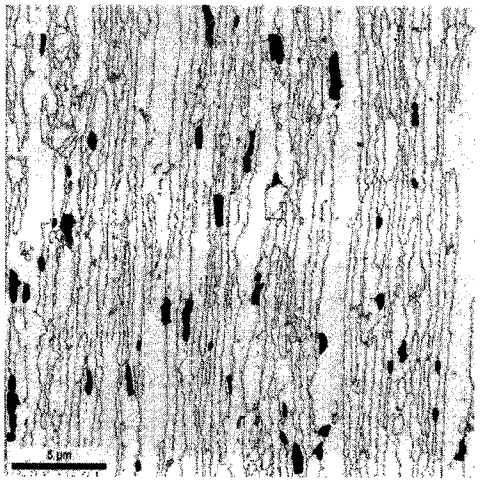

5μm FINE CRYSTAL

FINE CRYSTAL RATIO : 3%

AVERAGE GRAIN SIZE OF FINE CRYSTAL PORTION : 0.7μm

・TEST NO. 2 OF TABLE 20

・ALLOY NO. 21

・METAL STRUCTURE AFTER FINAL PRECIPITATION HEAT TREATMENT IN PROCESS C6

AVERAGE GRAIN DIAMETER : 3.7nm

- TEST NO. 2 OF TABLE 20
- ALLOY NO. 21
- TEM PHOTOGRAPH OF METAL STRUCTURE AFTER FINAL PRECIPITATION HEAT TREATMENT IN PROCESS C6 (750,000-fold)

HIGH-STRENGTH AND HIGH-ELECTRICAL CONDUCTIVITY COPPER ALLOY ROLLED SHEET AND METHOD OF MANUFACTURING THE SAME

This is a National Phase Application in the United States of International Patent Application No. PCT/JP2009/071599, filed Dec. 25, 2009, which claims priority on Japanese Patent Application No. 2009-003666, filed Jan. 9, 2009. The entire disclosures of the above patent applications are hereby incorporated by reference.

TECHNICAL FIELD

The present invention relates to a high-strength and high-electrical conductivity copper alloy rolled sheet which is produced by a process including a precipitation heat treatment process and a method of manufacturing the high-strength and high-electrical conductivity copper alloy rolled sheet.

BACKGROUND ART

In the past, copper sheets have been used in various industrial fields as a material for connectors, electrodes, connecting terminals, terminals, relays, heat sinks and bus bars by utilizing the excellent electrical and heat conductivity thereof. However, since pure copper including C1100 and C1020 has low strength, the use per unit area is increased to ensure the strength and thus cost increases occur and weight increases also occur.

Cr—Zr copper (1% Cr-0.1% Zr—Cu), which is a solution heat-treating-aging.precipitation type alloy, is known as a high-strength and high-electrical conductivity copper alloy. However, in general, a rolled sheet using this alloy is manufactured through a heat treatment process in which a hot-rolled material is subjected to a solution heat treatment including re-heating at 950° C. (930° C. to 990° C.) and subsequent immediate quenching and is subjected to aging. Alternatively, a rolled sheet is manufactured through a heat treatment process in which after hot rolling, a hot-rolled material is subjected to plastic forming by hot or cold forging, heated at 950° C., rapidly quenched, and then subjected to aging. The high-temperature process of 950° C. not only requires significant energy, but oxidation loss occurs when the heating operation is performed in the air. In addition, because of the high temperature, diffusion easily occurs and the materials stick to each other, so an acid cleaning process is required.

For this reason, the heat treatment is performed at 950° C. in an inert gas or in vacuum, so the cost is increased and extra energy is also required. Further, although the oxidation loss is prevented by the heat treatment in an inert gas or the like, the sticking problem is not solved. Further, regarding the characteristics, crystal grains become coarse and problems occur in fatigue strength since the heating operation is performed at high temperatures. Meanwhile, in a hot rolling process in which the solution heat treatment is not performed, even when an ingot is heated to its solution heat temperature, the temperature of the material decreases during the hot rolling and along time is required to perform the hot rolling, so only very poor strength can be obtained. In addition, Cr—Zr copper requires special temperature management since a temperature condition range of the solution heat-treating is narrow, and if a cooling rate is also not increased, the Cr—Zr copper is not solution heat-treated. Meanwhile, when using Cr—Zr copper in a thin sheet, there is a method of performing the solution heat treatment by using a continuous annealing line in a stage of the thin sheet or a method of performing the solution heat treatment in a stage of the final punched product. However, when the solution heat treatment is performed by using a continuous annealing line, it is difficult to make a quenching state, and when the material is exposed to the high temperature such as 900° C. or 950° C., crystal grains become coarse and the properties become worse. When the solution heat treatment is performed on a final punched product, a productivity problem is caused and extra energy is also required. Moreover, since a large amount of active Zr and Cr is included, restrictions are imposed on the melting and casting conditions. As a result, excellent characteristics are obtained, but the cost is increased.

In the vehicle field using the copper sheets, while a decrease in the vehicle body weight is required to improve fuel efficiency, the number of components such as a connecting terminal, connector, relay and bus bar is increased due to the high-level informatization and the acquisition of electronic properties and hybrid properties (an increase in the number of electrical components) in a vehicle, and the number of heat sinks and the like for cooling the mounted electronic components is also increased. Accordingly, a copper sheet to be used is required to have a smaller thickness and higher strength. Naturally, in comparison to the case of home electric appliances and the like, regarding the vehicle usage environment, the temperature of the vehicle interior, as well as the engine room, increases in summer and enters harsh conditions. Further, since the usage environment is a high-current usage environment, it is particularly necessary to lower stress relaxation properties when a copper sheet is used in a connecting terminal, a connector and the like. The low stress relaxation properties mean that a contact pressure or spring properties of a connector and the like are not lowered in a usage environment of, for example, 100° C. In this specification, in a stress relaxation test to be described later, a low stress relaxation rate indicates "low" or "good" stress relaxation properties and a large stress relaxation rate indicates "high" or "bad" stress relaxation properties. It is preferable that a copper alloy rolled sheet has a low stress relaxation rate. As in vehicles, in the case of fittings such as a relay, terminal and connector, which are used in solar energy generation, wind power generation and the like, a high current flows therein, and thus high electrical conductivity is required and the usage environment thereof reaches 100° C. in some cases.

In addition, in many cases, due to the demands for high reliability, important electrical components are connected to each other by brazing, not soldering. Examples of a brazing filler material include Bag-7 (56Ag-22Cu-17Zn-5Sn alloy brazing filler material), described in JIS Z 3261, and a recommended brazing temperature thereof is in the high temperature range of 650° C. to 750° C. Accordingly, a copper sheet for use in connecting terminals and the like is required to have heat resistance of, for example, about 700° C.

In addition, for power modules and the like, a copper sheet for use in a heat sink or a heat spreader is joined to a ceramic or the like which is a base sheet. Soldering is employed for the above joining, but progress has been made regarding Pb-free solder and thus high-melting point solder such as Sn—Cu—Ag is used. In mounting a heat sink, a heat spreader and the like, it is required that not only does softening not occur but also that deformation and warpage do not occur and a small thickness is demanded in view of weight reduction and economy. Accordingly, a copper sheet is required to be not easily deformed even when exposed to high temperatures. That is, for example, a copper sheet is required to keep high strength even at about 350° C., which is higher than the melting point of the Pb-free solder by about 100° C., and to have resistance to deformation.

The invention is used in connectors, electrodes, connecting terminals, terminals, relays, heat sinks, bus bars, power modules, light-emitting diodes, lighting equipment components, members for a solar cell and the like, has excellent electrical and heat conductivity and realizes a small thickness, that is, high strength. In addition, when the invention is applied to connectors and the like, it is necessary to have good bendability and ductility such as bendability should be provided. Moreover, it is also necessary to have good stress relaxation properties. When simply increasing strength only, it is desirable that cold rolling is performed to cause work hardening. However, when a total cold rolling ratio becomes equal to or greater than 40%, and particularly equal to or greater than 50%, ductility including bendability becomes worse. Further, when a rolling ratio is increased, stress relaxation properties also become worse. Meanwhile, thin sheets are employed for the above-described using in connectors and the like, and in general, the thickness is 4 mm or equal to or smaller than 3 mm, or further equal to or smaller than 1 mm. In addition, since the thickness of a hot rolled material is in the range of 10 to 20 mm, a total cold rolling equal to or greater than 60%, and generally equal to or greater than 70% is required. In that case, an annealing process is generally added in the course of cold rolling. However, when causing the recrystallization by increasing the temperature in the annealing process, ductility is recovered, but strength becomes lower. In addition, when partially causing the recrystallization, although also depending on the relationship with the ratio of the subsequent cold rolling, ductility becomes poorer or strength becomes lower. In the invention of the present application, when a precipitation heat treatment is performed after cold rolling, precipitates of Co, P and the like to be described later are precipitated to strengthen the material, and at the same time, fine recrystallized grains or crystals (hereinafter, these crystal grains are referred to as fine crystals in this specification, and the fine crystals will be described later in detail) having a low dislocation density and a shape slightly different from that of recrystallized grains are formed partially around the original crystal grain boundaries to minimize a decrease in strength of the matrix and considerably improve ductility. In addition, by a series of processes, including causing work hardening by cold rolling with a rolling ratio not damaging ductility and stress relaxation properties and a final recovery heat treatment, high strength, high electrical and heat conductivity and excellent ductility are obtained.

A copper alloy is known which includes 0.01 to 1.0 mass % of Co, 0.005 to 0.5 mass % of P and the balance including Cu and inevitable impurities (for example, see JP-A-10-168532). However, such a copper alloy is also insufficient in both strength and electrical conductivity.

DISCLOSURE OF THE INVENTION

The invention solves the above-described problems, and an object of the invention is to provide a high-strength and high-electrical conductivity copper alloy rolled sheet, which has high strength, high electrical and heat conductivity and excellent ductility, and a method of manufacturing the high-strength and high-electrical conductivity copper alloy rolled sheet.

In order to achieve the object, the invention provides a high-strength and high-electrical conductivity copper alloy rolled sheet which has an alloy composition containing 0.14 to 0.34 mass % of Co, 0.046 to 0.098 mass % of P, 0.005 to 1.4 mass % of Sn and the balance including Cu and inevitable impurities and is manufactured by a manufacturing process including a hot rolling process, a cold rolling process and a precipitation heat treatment process, in which [Co] mass % representing a Co content and [P] mass % representing a P content satisfy the relationship of $3.0 \leq ([Co]-0.007)/([P]-0.009) \leq 5.9$, a total cold rolling ratio is equal to or greater than 70%, after a final precipitation heat treatment process, a recrystallization ratio is equal to or less than 45%, an average grain size of recrystallized grains in a recrystallization portion is in the range of 0.7 to 7 μm and substantially circular or substantially elliptical precipitates are present in the metal structure, the precipitates are fine precipitates which have an average grain diameter of 2.0 to 11 nm, or alternatively, 90% or greater of which is equal to or less than 25 nm in diameter, and the precipitates are uniformly dispersed, in a fibrous metal structure extending in a rolling direction in the metal structure after the final precipitation heat treatment or final cold rolling, fine crystals are present which have no annealing twin crystals and in which an average long/short ratio, which is observed from an inverse pole figure (IPF) map and a grain boundary map in an EBSP analysis result, is equal to or greater than 2 and equal to or less than 15, and an average grain size of the fine crystals is in the range of 0.3 to 4 μm and a proportion of the area of the fine crystals to the whole metal structure in an observation plane is in the range of 0.1% to 25%, or alternatively, an average grain size of both of the fine crystals and recrystallized grains is in the range of 0.5 to 6 μm and a proportion of the area of both of the fine crystals and recrystallized grains to the whole metal structure in the observation plane is in the range of 0.5% to 45%.

According to the invention, due to fine precipitates of Co and P, solid-solution of Sn and fine crystals, the strength, conductivity and ductility of a high-strength and high-electrical conductivity copper alloy rolled sheet are improved.

It is preferable that 0.16 to 0.33 mass % of Co, 0.051 to 0.096 mass % of P and 0.005 to 0.045 mass % of Sn are contained and [Co] mass % representing a Co content and [P] mass % representing a P content satisfy the relationship of $3.2 \leq ([Co]-0.007)/([P]-0.009) \leq 4.9$. In this manner, the amount of Sn approaches its lower limit in the composition range and thus the conductivity of a high-strength and high-electrical conductivity copper alloy rolled sheet is improved.

In addition, it is preferable that 0.16 to 0.33 mass % of Co, 0.051 to 0.096 mass % of P and 0.32 to 0.8 mass % of Sn are contained and [Co] mass % representing a Co content and [P] mass % representing a P content satisfy the relationship of $3.2([Co]-0.007)/([P]-0.009) \leq 4.9$. In this manner, the amount of Sn approaches its upper limit in the composition range and thus the strength of a high-strength and high-electrical conductivity copper alloy rolled sheet is improved.

In addition, it is preferable to provide a high-strength and high-electrical conductivity copper alloy rolled sheet which has an alloy composition containing 0.14 to 0.34 mass % of Co, 0.046 to 0.098 mass % of P, 0.005 to 1.4 mass % of Sn, at least one of 0.01 to 0.24 mass % of Ni and 0.005 to 0.12 mass % of Fe and the balance including Cu and inevitable impurities and is manufactured by a manufacturing process including a hot rolling process, a cold rolling process and a precipitation heat treatment process, in which [Co] mass % representing a Co content, [Ni] mass % representing a Ni content, [Fe] mass % representing a Fe content and [P] mass % representing a P content satisfy the relationships of $3.0 \leq ([Co]+0.85\times[Ni]+0.75\times[Fe]-0.007)/([P]-0.0090) \leq 5.9$ and $0.012 \leq 1.2\times[Ni]+2\times[Fe] \leq [Co]$, a total cold rolling ratio is equal to or greater than 70%, after a final precipitation heat treatment process, a recrystallization ratio is equal to or less than 45%, an average grain size of recrystallized grains in a recrystallization portion is in the range of 0.7 to 7 μm and substantially circular or substantially elliptical precipitates are present in the metal structure, the precipitates are fine precipitates which have an average grain diameter of 2.0 to 11 nm, or alternatively, 90% or greater of which is equal to or less than 25 nm in diameter, and the precipitates are uniformly dispersed, in a fibrous metal structure extending in a rolling direction in the metal structure after the final precipitation heat treatment or final cold rolling, fine crystals are present which have no annealing twin crystals and in which an average long/short ratio, which is observed from an inverse pole figure (IPF) map and a grain boundary map in an EBSP analysis result, is equal to or greater than 2 and equal to or less than 15, and an average grain size of the fine crystals is in the range of 0.3 to 4 μm and a proportion of the area of the fine crystals to the whole metal structure in an observation plane is in the range of 0.1% to 25%, or alternatively, an average grain size of both of the fine crystals and recrystallized grains is in the range of 0.5 to 6 μm and a proportion of the area of both of the fine crystals and recrystallized grains to the whole metal structure in the observation plane is in the range of 0.5% to 45%. In this manner, as a result of making the precipitates of Co, P and the like fine by Ni and Fe, solid-solutioning of Sn and fine crystals, the strength and conductivity of a high-strength and high-electrical conductivity copper alloy rolled sheet are improved.

It is preferable that at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr is further contained. In this manner, Al, Zn, Ag, Mg or Zr detoxifies S incorporated during a recycle process of the copper material and prevents intermediate temperature embrittlement. In addition, since these elements further strengthen the alloy, the ductility and strength of a high-strength and high-electrical conductivity copper alloy rolled sheet are improved.

It is preferable that conductivity is equal to or greater than 45 (% IACS), and a value of $(R^{1/2}\times S\times(100+L)/100)$ is equal to or greater than 4300 when conductivity is denoted by R(% IACS), tensile strength is denoted by S(N/mm$^2$) and elongation is denoted by L (%). In this manner, strength and electrical conductivity are improved and the balance between strength and electrical conductivity becomes excellent and thus a thin rolled sheet can be produced at a low cost.

It is preferable that the high-strength and high-electrical conductivity copper alloy rolled sheet is manufactured by a manufacturing process including hot rolling, that a rolled material subjected to the hot rolling has an average grain size equal to or greater than 6 μm and equal to or less than 50 μm, or satisfies the relationship of $5.5\times(100/RE0) \leq D \leq 70\times(60/RE0)$ where a rolling ratio of the hot rolling is denoted by RE0(%) and a grain size after the hot rolling is denoted by D μm, and that when a cross-section of the crystal grain taken along a rolling direction is observed, when a length in the rolling direction of the crystal grain is denoted by L1 and a length in a direction perpendicular to the rolling direction of the crystal grain is denoted by L2, an average value of L1/L2 is equal to or greater than 1.02 and equal to or less than 4.5. In this manner, ductility, strength and conductivity are improved and the balance between strength, ductility and electrical conductivity becomes excellent and thus a thin rolled sheet can be produced at a low cost.

It is preferable that the tensile strength at 350° C. is equal to or greater than 300(N/mm$^2$). In this manner, high-temperature strength is increased and thus a rolled sheet according to the invention is not easily deformed at high temperatures and can be used in a high-temperature state.

It is preferable that Vickers hardness (HV) after heating at 700° C. for 30 seconds is equal to or greater than 100, or 80% or greater of a value of Vickers hardness before the heating, or, a recrystallization ratio in the metal structure after heating is equal to or less than 45%. In this manner, excellent heat resistance is obtained and thus a rolled sheet according to the invention can be used in circumstances exposed to a high-temperature state in addition to in a process when a product is manufactured from the material.

It is preferable to provide a method of manufacturing the high-strength and high-electrical conductivity copper alloy rolled sheet, the method including: a hot rolling process; a cold rolling process; a precipitation heat treatment process; and a recovery heat treatment process, in which a hot rolling start temperature is in the range of 830° C. to 960° C., an average cooling rate until the temperature of the rolled material subjected to the final pass of the hot rolling or the temperature of the rolled material goes down from 650° C. to 350° C. is 2° C./sec or greater, a precipitation heat treatment which is performed at temperatures of 350° C. to 540° C. for 2 to 24 hours and satisfies the relationship of $265 \leq (T-100\times th^{-1/2}-110\times(1-RE/100)^{1/2} \leq 400$ where a heat treatment temperature is denoted by T(° C.), a holding period of time is denoted by th (h) and a rolling ratio of the cold rolling before the precipitation heat treatment is denoted by RE(%), or a precipitation heat treatment in which the highest reached temperature is in the range of 540° C. to 770° C., a holding period of time from "the highest reached temperature-50° C." to the highest reached temperature is in the range of 0.1 to 5 minutes and the relationship of $340 \leq (Tmax-100\times tm^{-1/2}-100\times(1-RE/100)^{1/2}) \leq 515$ is satisfied where the highest reached temperature is denoted by Tmax(° C.) and a holding period of time is denoted by tm(min) is performed before, after or during the cold rolling, and a recovery heat treatment in which the highest reached temperature is in the range of 200° C. to 560° C., a holding period of time from "the highest reached temperature-50° C." to the highest reached temperature is in the range of 0.03 to 300 minutes and the relationship of $150\ (Tmax-60\times tm^{-1/2}-50\times(1-RE2/100)^{1/2}) \leq 320$ is satisfied where a rolling ratio of the cold rolling after a final precipitation heat treatment is denoted by RE2(%) is performed after final cold rolling. In this manner, fine precipitates of Co and P are precipitated by the manufacturing conditions and thus the strength, conductivity, ductility and heat resistance of a high-strength and high-electrical conductivity copper alloy rolled sheet are improved.

BRIEF DESCRIPTION OF THE DRAWINGS

FIG. 2(*a*) is a photograph of the metal structure of a recrystallization portion of the same high-performance copper alloy rolled sheet, and FIG. 2(*b*) is a photograph of the metal structure of a fine crystal portion of the same high-performance copper alloy rolled sheet.

BEST MODE FOR CARRYING OUT THE INVENTION

Figure 1:
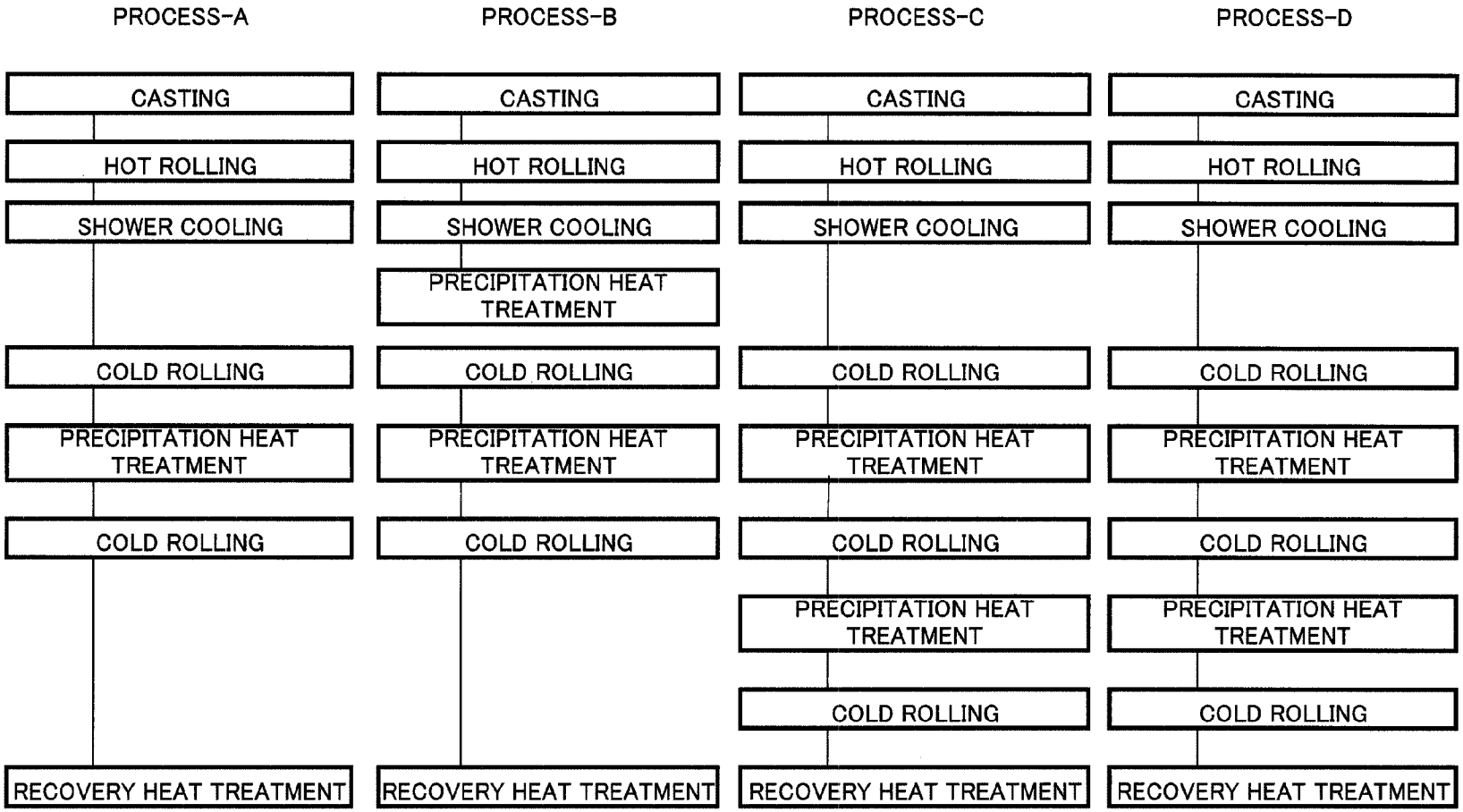
FIG. 1 shows flow diagrams of manufacturing processes of a high-performance copper alloy rolled sheet according to an embodiment of the invention.

A high-strength and high-electrical conductivity copper alloy rolled sheet (hereinafter, abbreviated to a high-performance copper alloy rolled sheet) according to embodiments of the invention will be described. In this specification, the sheet includes a so-called "coiled material" which is wound in a coil or traverse form. The invention proposes a high-strength and high-electrical conductivity copper alloy rolled sheet having an alloy composition, wherein the alloy composition comprises 0.14 to 0.34 mass % of Co, 0.046 to 0.098 mass % of P, 0.005 to 1.4 mass % of Sn and the balance including Cu and inevitable impurities and is manufactured by a manufacturing process including a hot rolling process, a cold rolling process and a precipitation heat treatment process, wherein [Co] mass % representing a Co content and [P] mass % representing a P content satisfy the relationship of $3.0 \leq ([Co]-0.007)/([P]-0.009) \leq 5.9$, a total cold rolling ratio is equal to or greater than 70%, after a final precipitation heat treatment process, a recrystallization ratio is equal to or less than 45%, an average grain size of recrystallized grains in a recrystallization portion is in the range of 0.7 to 7 μm and substantially circular or substantially elliptical precipitates are present in the metal structure, the precipitates are fine precipitates which have an average grain diameter of 2.0 to 11 nm, or alternatively, 90% or greater of which is equal to or less than 25 nm in diameter, and the precipitates are uniformly dispersed, in a fibrous metal structure extending in a rolling direction in the metal structure after the final precipitation heat treatment or final cold rolling, fine crystals are present which have no annealing twin crystals and in which an average long/short ratio, which is observed from an inverse pole figure (IPF) map and a grain boundary map in an EBSP analysis result, is equal to or greater than 2 and equal to or less than 15, and an average grain size of the fine crystals is in the range of 0.3 to 4 μm and a proportion of the area of the fine crystals to the whole metal structure in an observation plane is in the range of 0.1% to 25%, or alternatively, an average grain size of both of the fine crystals and recrystallized grains is in the range of 0.5 to 6 μm and a proportion of the area of both of the fine crystals and recrystallized grains to the whole metal structure in the observation plane is in the range of 0.5% to 45%. Additional, particular beneficial, embodiments of the invention are provided in accordance with the following subsidiary high-strength and high-electrical conductivity copper alloy rolled sheets. In a second high-strength and high-electrical conductivity copper alloy rolled sheet embodiment of the invention, the first embodiment is modified so that 0.16 to 0.33 mass % of Co, 0.051 to 0.096 mass % of P and 0.005 to 0.045 mass % of Sn are contained and [Co] mass % representing a Co content and [P] mass % representing a P content satisfy the relationship of $3.2 \leq ([Co]-0.007)/([P]-0.009) \leq 4.9$. In a third high-strength and high-electrical conductivity copper alloy rolled sheet embodiment of the invention, the first embodiment is modified so that 0.16 to 0.33 mass % of Co, 0.051 to 0.096 mass % of P and 0.32 to 0.8 mass % of Sn are contained and [Co] mass % representing a Co content and [P] mass % representing a P content satisfy the relationship of $3.2 \leq ([Co]-0.007)/([P]-0.009) \leq 4.9$. The invention also proposes a high-strength and high-electrical conductivity copper alloy rolled sheet having an alloy composition according to a fourth embodiment of the invention, wherein the alloy composition comprises 0.14 to 0.34 mass % of Co, 0.046 to 0.098 mass % of P, 0.005 to 1.4 mass % of Sn, at least one of 0.01 to 0.24 mass % of Ni and 0.005 to 0.12 mass % of Fe and the balance including Cu and inevitable impurities and is manufactured by a manufacturing process including a hot rolling process, a cold rolling process and a precipitation heat treatment process, wherein [Co] mass % representing a Co content, [Ni] mass % representing a Ni content, [Fe] mass % representing a Fe content and [P] mass % representing a P content satisfy the relationships of $3.0 \leq ([Co]+0.85\times[Ni]+0.75\times[Fe]-0.007)/([P]-0.0090) \leq 5.9$ and $0.012 \leq 1.2\times[Ni]+2\times[Fe][Co]$, a total cold rolling ratio is equal to or greater than 70%, after a final precipitation heat treatment process, a recrystallization ratio is equal to or less than 45%, an average grain size of recrystallized grains in a recrystallization portion is in the range of 0.7 to 7 μm and substantially circular or substantially elliptical precipitates are present in the metal structure, the precipitates are fine precipitates which have an average grain diameter of 2.0 to 11 nm, or alternatively, 90% or greater of which is equal to or less than 25 nm in diameter, and the precipitates are uniformly dispersed, in a fibrous metal structure extending in a rolling direction in the metal structure after the final precipitation heat treatment or final cold rolling, fine crystals are present which have no annealing twin crystals and in which an average long/short ratio, which is observed from an inverse pole figure (IPF) map and a grain boundary map in an EBSP analysis result, is equal to or greater than 2 and equal to or less than 15, and an average grain size of the fine crystals is in the range of 0.3 to 4 μm and a proportion of the area of the fine crystals to the whole metal structure in an observation plane is in the range of 0.1% to 25%, or alternatively, an average grain size of both of the fine crystals and recrystallized grains is in the range of 0.5 to 6 μm and a proportion of the area of both of the fine crystals and recrystallized grains to the whole metal structure in the observation plane is in the range of 0.5% to 45%. Additional, particular beneficial, embodiments of the invention are provided in accordance with the following subsidiary high-strength and high-electrical conductivity copper alloy rolled sheets. In a fifth high-strength and high-electrical conductivity copper alloy rolled sheet embodiment of the invention, the first embodiment, the second embodiment, the third embodiment, or the fourth embodiment is modified so that at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr is further contained. In a sixth high-strength and high-electrical conductivity copper alloy rolled sheet embodiment of the invention, the first embodiment, the second embodiment, the third embodiment, the fourth embodiment, or the fifth embodiment is modified so that conductivity is equal to or greater than 45 (% IACS), and a value of $(R^{1/2}\times S\times(100+L)/100)$ is equal to or greater than 4300 when conductivity is denoted by R(% IACS), tensile strength is denoted by $S(N/mm^2)$ and elongation is denoted by L (%). In a seventh high-strength and high-electrical conductivity copper alloy rolled sheet embodiment of the invention, the first embodiment, the second embodiment, the third embodiment, the fourth embodiment, the fifth embodiment, or the sixth embodiment is modified so that the copper alloy rolled sheet is manufactured by a manufacturing process including hot rolling, wherein a rolled material subjected to the hot rolling has an average grain size equal to or greater than 6 μm and equal to or less than 50 μm, or satisfies the relationship of $5.5\times(100/RE0)\leq D\leq 70\times(60/RE0)$ where a rolling ratio of the hot rolling is denoted by RE0(%) and a grain size after the hot rolling is denoted by D μm, and when a cross-section of the crystal grain taken along a rolling direction is observed, when a length in the rolling direction of the crystal grain is denoted by L1 and a length in a direction perpendicular to the rolling direction of the crystal grain is denoted by L2, an average value of L1/L2 is equal to or greater than 1.02 and equal to or less than 4.5. In a eighth high-strength and high-electrical conductivity copper alloy rolled sheet embodiment of the invention, the first embodiment, the second embodiment, the third embodiment, the fourth embodiment, the fifth embodiment, the sixth embodiment, or the seventh embodiment is modified so that the tensile strength at 350° C. is equal to or greater than 300 ($N/mm^2$). In a ninth high-strength and high-electrical conductivity copper alloy rolled sheet embodiment of the invention, the first embodiment, the second embodiment, the third embodiment, the fourth embodiment, the fifth embodiment, the sixth embodiment, the seventh embodiment, or the eighth embodiment is modified so that Vickers hardness (HV) after heating at 700° C. for 30 seconds is equal to or greater than 100, or 80% or greater of a value of Vickers hardness before the heating, or, a recrystallization ratio in the metal structure after heating is equal to or less than 45%. In a tenth high-strength and high-electrical conductivity copper alloy rolled sheet embodiment of the invention, the first embodiment, the second embodiment, the third embodiment, the fourth embodiment, the fifth embodiment, the sixth embodiment, the seventh embodiment, the eighth embodiment, or the ninth embodiment is modified so that a method of manufacturing the high-strength and high-electrical conductivity copper alloy rolled sheet, comprises a hot rolling process; a cold rolling process; a precipitation heat treatment process; and a recovery heat treatment process, wherein a hot rolling start temperature is in the range of 830° C. to 960° C., an average cooling rate from the temperature of the rolled material subjected to the final pass of the hot rolling or from the temperature of 650° C. to 350° C. is 2° C./sec or greater, a precipitation heat treatment which is performed at temperatures of 350° C. to 540° C. for 2 to 24 hours and satisfies the relationship of $265\leq(T-100\times th^{-1/2}-110\times(1-RE/100)^{1/2}\leq 400$ where a heat treatment temperature is denoted by T(° C.), a holding period of time is denoted by th (h) and a rolling ratio of the cold rolling before the precipitation heat treatment is denoted by RE (%), or a precipitation heat treatment in which the highest reached temperature is in the range of 540° C. to 770° C., a holding period of time from "the highest reached temperature-50° C." to the highest reached temperature is in the range of 0.1 to 5 minutes and the relationship of $340\leq(Tmax-100\times tm^{-1/2}-100\times(1-RE/100)^{1/2})\leq 515$ is satisfied where the highest reached temperature is denoted by Tmax(° C.) and a holding period of time is denoted by tm(min) is performed before, after or during the cold rolling, and a recovery heat treatment in which the highest reached temperature after final cold rolling is in the range of 200° C. to 560° C., a holding period of time from "the highest reached temperature-50° C." to the highest reached temperature is in the range of 0.03 to 300 minutes and the relationship of $150\leq(Tmax-60\times tm^{-1/2}-50\times(1-RE2/100)^{1/2})\leq 320$ is satisfied where a rolling ratio of the cold rolling after a final precipitation heat treatment is denoted by RE2(%) is performed after final cold rolling. When an alloy composition is expressed in this specification, the bracketed element symbol such as [Co] represents a value of the content (mass %) of the corresponding element. In this specification, a plurality of calculation expressions is shown by using a displaying method of the content value. In the respective calculation expressions, the calculation is performed so that the content is 0 when the corresponding element is not contained. The first to fifth invention alloys are collectively referred to as the invention alloy.

The first invention alloy has, generally, an alloy composition containing 0.14 to 0.34 mass % (preferably 0.16 to 0.33 mass %, more preferably 0.18 to 0.33 mass %, and most preferably 0.18 to 0.29 mass %) of Co, 0.046 to 0.098 mass % (preferably 0.051 to 0.096, more preferably 0.054 to 0.096 mass %, and most preferably 0.054 to 0.0.092 mass %) of P, 0.005 to 1.4 mass % of Sn, and the balance including Cu and inevitable impurities, in which [Co] mass % representing a Co content and [P] mass % representing a P content satisfy the relationship of $X1=([Co]-0.007)/([P]-0.009)$ where X1 is in the range of 3.0 to 5.9, preferably in the range of 3.1 to 5.2, more preferably in the range of 3.2 to 4.9, and most preferably in the range of 3.4 to 4.2.

The second invention alloy has, generally, an alloy composition containing 0.16 to 0.33 mass % (preferably 0.18 to 0.33 mass % and most preferably 0.18 to 0.29 mass %) of Co, 0.051 to 0.096 mass % (preferably 0.054 to 0.094 mass % and most preferably 0.054 to 0.0.092 mass %) of P, 0.005 to 0.045 mass % of Sn, and the balance including Cu and inevitable impurities, in which [Co] mass % representing a Co content and [P] mass % representing a P content satisfy the relationship of $X1=([Co]-0.007)/([P]-0.009)$ where X1 is in the range of 3.2 to 4.9 (most preferably in the range of 3.4 to 4.2).

The third invention alloy has, generally, an alloy composition containing 0.16 to 0.33 mass % (preferably 0.18 to 0.33 mass % and most preferably 0.18 to 0.29 mass %) of Co, 0.051 to 0.096 mass % (preferably 0.054 to 0.094 mass % and most preferably 0.054 to 0.0.092 mass %) of P, 0.32 to 0.8 mass % of Sn, and the balance including Cu and inevitable impurities, in which [Co] mass % representing a Co content and [P] mass % representing a P content satisfy the relationship of $X1=([Co]-0.007)/([P]-0.009)$ where X1 is in the range of 3.2 to 4.9 (most preferably in the range of 3.4 to 4.2).

The fourth invention alloy has, generally, an alloy composition having the same composition ranges of Co, P and Sn as in the first invention alloy and containing one of 0.01 to 0.24 mass % (preferably 0.015 to 0.18 mass % and more preferably 0.02 to 0.09 mass %) of Ni and 0.005 to 0.12 mass % (preferably 0.007 to 0.06 mass % and more preferably 0.008 to 0.045 mass %) of Fe, and the balance including Cu and inevitable impurities, in which [Co] mass % representing a Co content, [Ni] mass % representing an Ni content, [Fe] mass % representing a Fe content and [P] mass % representing a P content satisfy the relationship of $X2=([Co]+0.85\times[Ni]+0.75\times[Fe]-0.007)/([P]-0.009)$ where X2 is in the range of 3.0 to 5.9, preferably in the range of 3.1 to 5.2, more preferably in the range of 3.2 to 4.9, and most preferably in the range of 3.4 to 4.2, and the relationship of $X3=1.2\times[Ni]+2\times[Fe]$ where X3 is in the range of 0.012 to [Co], preferably in the range of 0.02 to (0.9x[Co]), and more preferably in the range of 0.03 to (0.7×[Co]).

The fifth invention alloy has, generally, an alloy composition having the composition of the first invention alloy or the fourth invention alloy and further containing at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr.

Next, a high-performance copper alloy rolled sheet manufacturing process will be generally described. The manufacturing process has a hot rolling process, a cold rolling process, a precipitation heat treatment process and a recovery heat treatment process. In the hot rolling process, an ingot is heated at temperatures of 830° C. to 960° C. to perform hot rolling, and a cooling rate until the temperature of the material after the hot rolling or the temperature of the hot-rolled material goes down from 650° C. to 350° C. is 2° C./sec or greater. Due to these hot rolling conditions, Co, P and the like go into the state of solid solution so that the processes after the cold rolling, which will be described later, can be efficiently used. An average grain size of the metal structure after the cooling is in the range of 6 to 50 μm. This average grain size is important because it has an effect on a final sheet. After the hot rolling process, the cold rolling process and the precipitation heat treatment process are performed. The precipitation heat treatment process is performed before, after, or during the cold rolling process and may be performed more than once. The precipitation heat treatment process is a heat treatment which is performed at temperatures of 350° C. to 540° C. for 2 to 24 hours and satisfies the relationship of $265 \leq (T-100 \times th^{-1/2}-110 \times (1-RE/100)^{1/2}) \leq 400$ where a heat treatment temperature is denoted by T (° C.), a holding period of time is denoted by th (h) and a rolling ratio of the cold rolling before the precipitation heat treatment process is denoted by RE (%), or a heat treatment which is performed at temperatures of 540° C. to 770° C. for 0.1 to 5 minutes and satisfies the relationship of $340 \leq (T-100 \times tm^{-1/2}-100 \times (1-RE/100)^{1/2}) \leq 515$ where a holding period of time is denoted by tm(min). As the rolling ratio RE (%) in this calculation expression, the rolling ratio of the cold rolling before the precipitation heat treatment process which is a target of the calculation is used. When the second precipitation heat treatment process of a process of hot rolling-cold rolling-precipitation heat treatment-cold rolling-precipitation heat treatment is set as a target, a rolling ratio of the second cold rolling is used.

In this specification, an integrated rolling ratio of all the cold rolling processes which are performed between the hot rolling and the final precipitation heat treatment is referred to as a total cold rolling ratio. The rolling ratio of the cold rolling after the final precipitation heat treatment is not included. For example, when rolling into a sheet thickness of up to 20 mm is carried out by the hot rolling, rolling into a sheet thickness of 10 mm is carried out by the subsequent cold rolling, the precipitation heat treatment is performed, rolling into a sheet thickness of 1 mm is further carried out by the cold rolling, the precipitation heat treatment is performed, rolling into a sheet thickness of 0.5 mm is carried by the cold rolling and then the recovery heat treatment is performed, a total cold rolling ratio is 95%.

The recovery heat treatment is a heat treatment in which the highest reached temperature after the final cold rolling is in the range of 200° C. to 560° C., a holding period of time from "the highest reached temperature-50° C." to the highest reached temperature is in the range of 0.03 to 300 minutes and the relationship of $150 \leq (Tmax-60 \times tm^{-1/2}-50 \times (1-RE2/100)^{1/2}) \leq 320$ is satisfied where a rolling ratio of the cold rolling after the final precipitation heat treatment is denoted by RE2(%). The basic principle of the high-performance copper alloy rolled sheet manufacturing process will be generally described. As means for obtaining high strength and high electrical conductivity, there are structure controlling methods mainly including aging•precipitation hardening, solid solution hardening and making the crystal grains fine. However, in general, regarding high electrical conductivity, electrical conductivity is inhibited when additional elements are subjected to solid solution in the matrix, and depending on the elements, the electrical conductivity is markedly inhibited. Co, P and Fe, which are used in the invention, are elements markedly inhibiting the electrical conductivity. For example, about 10% loss occurs in the electrical conductivity by the single addition of only 0.02 mass % of Co, Fe or P to pure copper. Further, in the case of an aging precipitation type alloy, it is impossible for additional elements to be completely and efficiently precipitated without being subjected to solid solution and remaining in the matrix. The invention has an advantage in that when the additional elements Co, P and the like are added in accordance with predetermined numerical expressions, Co, P and the like, which are subjected to solid solution, can be almost entirely precipitated in the subsequent precipitation heat treatment while strength, ductility and other properties are satisfied. In this manner, high electrical conductivity can be ensured.

In the cases of titanium copper and a Corson alloy (Ni and Si are added thereto) as famous age-hardening copper alloys other than Cr—Zr copper, even when a complete solution heat-treating and aging treatment is performed, a large amount of Ni, Si or Ti remains in the matrix in comparison to the case of the invention. As a result, strength is increased but a disadvantage occurs in that electrical conductivity is inhibited. In addition, in the solution heat treatment at high temperatures which is generally required in the complete solution heat-treating and aging precipitation process, when a heating operation is performed at typical solution heat temperatures of 800° C. to 950° C. for several tens of seconds, in some cases, for several seconds or more, crystal grains become coarse at about 100 μm. The coarse crystal grains have a bad effect on various mechanical properties. Moreover, the complete solution heat-treating and aging precipitation process has a restriction on the amount and productivity in the manufacturing and thus leads to a large increase in cost. As for structure controlling, making the crystal grains fine is mainly employed, but when an additional element amount is small, the effect thereof is also small.

In the invention, a composition of Co, P and the like, solid solution of Co, P and the like by a hot rolling process, finely precipitating Co, P and the like and forming fine recrystallized grains or fine crystals at the same time to recover ductility of the matrix in a precipitation heat treatment after cold rolling, and work hardening by cold rolling are combined with each other. In this manner, it is possible to obtain high electrical conductivity, high strength and high ductility. In the invention alloy, not only can additional elements be subjected to solid solution during the hot working process as described above, but the solution heat sensitivity thereof is lower than that of age-hardening type precipitation alloys including Cr—Zr copper. In the case of a conventional alloy, solution heat-treating is not sufficiently carried out if cooling is not rapidly performed from a high temperature state at which elements are in the state of solid solution after hot rolling, that is, a solution heat-treated state. Otherwise, when the temperature of a material is lowered during hot rolling because of a long time required for the hot rolling, solution heat-treating is not sufficiently carried out. However, the invention alloy is characterized in that because of its low solution heat sensitivity, solution heat-treating is sufficiently carried out even at a cooling rate of a normal hot rolling process. In this specification, the phenomenon in which, even when a temperature decrease occurs during the hot rolling, the hot rolling takes a long time, and the cooling rate during cooling after the hot rolling is low, it is difficult for atoms which are in the state of solid solution at high temperatures to be precipitated is referred to as "the solution heat sensitivity is low", and the phenomenon in which, when a temperature decrease occurs during the hot rolling or the cooling rate after the hot rolling is low, the atoms are easily precipitated is referred to as "the solution heat sensitivity is high".

Next, reasons for the addition of elements will be described. High strength and electrical conductivity cannot be obtained with the single addition of Co. However, when P and Sn are also added, high strength, high heat resistance and high ductility are obtained without damaging heat and electrical conductivity. With such a single addition, the strength is increased to some degree, but there is no significant effect. When the amount of Co is greater than the upper limit of the composition range of the invention alloy, the effect is saturated. In addition, since Co is rare metal, the cost is increased and the electrical conductivity is damaged. When the amount of Co is smaller than the lower limit of the composition range of the invention alloy, an effect of high strength cannot be exhibited even when P is also added. The lower limit of Co is 0.14 mass %, preferably 0.16 mass %, more preferably 0.18 mass %, and further more preferably 0.20 mass %. The upper limit is 0.34 mass %, preferably 0.33 mass %, and more preferably 0.29 mass %.

By also adding P in addition to Co and Sn, high strength and high heat resistance are obtained without damaging heat and electrical conductivity. With such a single addition, fluidity and strength are improved and crystal grains are made fine. When the amount of P is greater than the upper limit of the composition range, the above-described effects of fluidity, strength and fine crystal grains are saturated. Heat and electrical conductivity are also damaged. In addition, cracking occurs easily during the casting or hot rolling. Moreover, ductility, bendability in particular, becomes worse. When the amount of P is smaller than the lower limit of the composition range, high strength cannot be obtained. The upper limit of P is 0.098 mass %, preferably 0.096 mass %, and more preferably 0.092 mass %. The lower limit thereof is 0.046 mass %, preferably 0.051 mass %, and more preferably 0.054 mass %.

The strength, electrical conductivity, ductility, stress relaxation properties, heat resistance, high-temperature strength, hot deformation resistance and deformability become better by adding Co and P in the above-described ranges. When even one of the compositions of Co and P is smaller than the range, the effects of all of the above-described properties are not significantly exhibited and the electrical conductivity becomes extremely worse. In many cases, the electrical conductivity becomes far worse in this manner and drawbacks occur as in the single addition of the respective elements. Both of the elements Co and P are essential elements for achieving the object of the invention, and by a proper mixing ratio of Co and P, the strength, heat resistance, high-temperature strength and the stress relaxation properties are improved without damaging the electrical and heat conductivity and ductility. As the contents of Co and P come closer to the upper limits in the composition ranges of the invention alloy, all the above properties are improved. Basically, by the binding of Co to P, ultrafine precipitates are precipitated in an amount contributing to the strength. The addition of Co and P suppresses the growth of recrystallized grains during the hot rolling and allows fine crystal grains to be maintained from the tip end to the rear end of a hot-rolled material even at high temperatures. Also, the addition of Co and P allows softening and recrystallization of the matrix to be markedly slowed during the precipitation heat treatment. However, also in the case of the above effect, when the contents of Co and P exceed the composition ranges of the invention alloy, an improvement in properties is almost never apparent and the above-described drawbacks are caused.

It is desirable that the content of Sn is in the range of 0.005 to 1.4 mass %. However, the content is preferably in the range of 0.005 to 0.19 mass % when high electrical and heat conductivity is required even with the strength decreased to some degree. The content is more preferably in the range of 0.005 to 0.095 mass %, and particularly, when high electrical and heat conductivity is required, it is desired that the content is in the range of 0.005 to 0.045 mass %. Although also depending on the contents of other elements, when the content of Sn is equal to or less than 0.095 mass % or equal to or less than 0.045 mass %, high electrical conductivity of 66% IACS or 70% IACS or greater, or high electrical conductivity of 72% IACS or 75% IACS or greater is obtained in terms of conductivity. Conversely, in the case of high strength, although also depending on the balance with the contents of Co and P, the content of Sn is preferably in the range of 0.26 to 1.4 mass %, more preferably in the range of 0.3 to 0.95 mass %, and most preferably in the range of 0.32 to 0.8 mass %.

With only the addition of Co and P, that is, with only the precipitation hardening based on Co and P, the heat resistance of the matrix is insufficient and unstable because static and dynamic recrystallization temperatures are low. By adding Sn of a small amount equal to or greater than 0.005 mass %, the recrystallization temperature during the hot rolling is raised and thus crystal grains which are formed during the hot rolling are made fine. In the precipitation heat treatment, Sn can increase a softening temperature and a recrystallization temperature of the matrix, and thus a recrystallization start temperature is raised and recrystallized grains are made fine when the recrystallization is carried out. Further, in a stage just before the recrystallization, fine crystals having a low dislocation density are formed. Accordingly, that is, the addition of Sn suppresses the precipitation of Co and P even when the material temperature is lowered during the hot rolling and the hot rolling takes a long time. Due to these effects and actions, even when cold rolling with a high rolling ratio is performed in the precipitation heat treatment, the heat resistance of the matrix is increased and thus Co, P and the like can be precipitated in a large amount just before the stage of recrystallization.

That is, Sn allows Co, P and the like to be in a solid solution state in the hot rolling stage, and thus without the need for a special solution heat treatment in the subsequent process, the solid solution state of Co, P and the like is achieved by a combination of cold rolling and a precipitation heat treatment without a lot of cost and energy. In addition, in the precipitation heat treatment, Sn serves to precipitate Co, P and the like in a large amount before the recrystallization. That is, the addition of Sn lowers the solution heat sensitivity of Co, P and the like so as to further finely and uniformly disperse precipitates based on Co and P without the need for special solution heat-treating. Moreover, when cold rolling with a total cold rolling ratio equal to or greater than 70% is performed, precipitation is most actively caused just before the start of recrystallization in the precipitation heat treatment, and thus hardening occurring by the precipitation and a significant improvement in ductility occurring by the softening and recrystallization can be caused at the same time. Accordingly, by the addition of Sn, high electrical conductivity and high ductility can be ensured while maintaining high strength.

In addition, Sn improves the electrical conductivity, strength, heat resistance, ductility (particularly, bendability), stress relaxation properties and wear resistance. Particularly, since heat sinks or connection metal fittings such as terminals and connectors in vehicles, solar cells and the like in which high current flows require high electrical conductivity, strength, ductility (particularly, bendability) and stress relaxation properties, the high-performance copper alloy rolled sheet of the invention is most suitable. Further, heat sink materials, which are used in hybrid cars, electrical vehicles, computers and the like, require high reliability and are thus brazed. However, even after the brazing, the heat resistance showing high strength is important and the high-performance copper alloy rolled sheet of the invention is most suitable. Moreover, the invention alloy has high high-temperature strength and heat resistance. Accordingly, in Pb-free solder mounting of heat spreader materials, heat sink materials and the like, warpage or deformation does not occur even when the thickness is made thinner and the invention alloy is most suitable for these materials.

Meanwhile, when the strength is required, solid solution strengthening by the addition of 0.26 mass % or more of Sn can improve the strength while slightly sacrificing the electrical conductivity. When 0.32 mass % or more of Sn is added, the effect is further exhibited. In addition, since wear resistance depends on hardness or strength, the wear resistance is also influenced. For these reasons, the lower limit of Sn is 0.005 mass % and a preferable lower limit is equal to or greater than 0.008 mass % to obtain the strength, heat resistance of the matrix and bendability. When priority is given to electrical conductivity over solid solution strengthening by Sn, 0.095 mass % or less or 0.045 mass % or less of Sn is added to exhibit the effect. When the content of Sn exceeds the upper limit of 1.4 mass %, heat and electrical conductivity is lowered and hot deformation resistance is increased, so cracking easily occurs during the hot rolling. Moreover, when the content of Sn exceeds 1.4 mass %, a recrystallization temperature is lowered and thus the balance with the precipitation of Co, P and the like is disrupted. Accordingly, the matrix is recrystallized without the precipitation of Co, P and the like. From this point of view, the upper limit is preferably 1.3 mass % or less, more preferably 0.95 mass % or less, and most preferably 0.8 mass % or less. When 0.8 mass % or less of Sn is added, conductivity becomes 50% IACS or greater.

The contents of Co, P, Fe and Ni are required to satisfy the following relationships. [Co] mass % representing a Co content, [Ni] mass % representing a Ni content, [Fe] mass % representing a Fe content and [P] mass % representing a P content satisfy the relationship of $X1=([Co]-0.007)/([P]-0.009)$ where X1 is in the range of 3.0 to 5.9, preferably in the range of 3.1 to 5.2, more preferably in the range of 3.2 to 4.9, and most preferably in the range of 3.4 to 4.2.

In addition, when Ni and Fe are added, the relationship of $X2=([Co]+0.85\times[Ni]+0.75\times[Fe]-0.007)/([P]-0.0090)$ is satisfied where X2 is in the range of 3.0 to 5.9, preferably in the range of 3.1 to 5.2, more preferably in the range of 3.2 to 4.9, and most preferably in the range of 3.4 to 4.2. When the values of X1 and X2 are greater than the upper limits thereof, heat and electrical conductivity, strength and heat resistance are lowered, the growth of crystal grains cannot be suppressed and hot deformation resistance is also increased. When the values of X1 and X2 are lower than the lower limits, a decrease in heat and electrical conductivity is caused, heat resistance and stress relaxation properties are lowered and hot and cold ductility is damaged. In addition, the high-level relationship between heat and electrical conductivity and strength cannot be obtained and the balance with ductility becomes worse. In addition, when the values of X1 and X2 are beyond the ranges of the upper limit and the lower limit, the combination form and diameter of target precipitates cannot be obtained and thus a high-strength and high-electrical conductivity material cannot be obtained.

In order to obtain the high strength and high electrical and heat conductivity as the object of the invention, a ratio of Co to P is very important. When conditions such as the composition, heating temperature of hot rolling and cooling rate after hot rolling are met, by a precipitation heat treatment, Co and P form fine precipitates in which a mass concentration ratio of Co:P is about 4:1 to 3.5:1. The precipitates are expressed by a formula such as $CO_2P$, $CO_{2.a}P$ or $CO_xP_y$, are nearly spherical or nearly elliptical in shape and have a grain diameter of about several nanometers. In greater detail, the precipitates are in the range of 2.0 to 11 nm (preferably in the range of 2.0 to 8.8 nm, more preferably in the range of 2.4 to 7.2 nm, most preferably in the range of 2.5 to 6.0 nm) when defined by an average grain diameter of the precipitates shown in a plane. Alternatively, 90%, preferably 95% or more of the precipitates are in the range of 0.7 to 25 nm or in the range of 2.5 to 25 nm when viewed from the distribution of diameters of the precipitates. By uniformly precipitating these precipitates, high strength can be obtained with a combination with the metal structure. In the description "in the range of 0.7 to 25 nm or in the range of 2.5 to 25 nm", 0.7 nm and 2.5 nm are limit diameters which can be identified and dimensionally measured when observed with 750,000 magnifications and 150,000 magnifications, respectively, by using an ultrahigh voltage electron microscope (TEM) and when using dedicated software. Accordingly, the ranges in the description "in the range of 0.7 to 25 nm or in the range of 2.5 to 25 nm" have the same meaning as that of "25 nm or less" (hereinafter, the same in this specification).

The precipitates are uniformly and finely distributed and also uniform in diameter, and the finer the grain diameters thereof are, the more the grain sizes of the recrystallization portion, strength, high-temperature strength and ductility are influenced. In the precipitates, the crystallized grains which are formed in the casting are definitely not included. Further, when particularly defining a uniform dispersion of the precipitates, it can be defined that in the TEM observation with 150,000 magnifications, in an arbitrary area of 500 nm×500 nm of a microscope observation position (with the exception of unusual portions such as the outmost surface layer) to be described later, an inter-nearest neighboring precipitated grain distance of at least 90% of precipitated grains is equal to or less than 200 nm, and preferably equal to or less than 150 nm, or is at most 25 times the average grain diameter, or, in an arbitrary area of 500 nm×500 nm of a microscope observation position to be described later, the number of precipitated grains is at least 25, and preferably at least 50, that is, there are no large non-precipitation zones affecting the characteristics even in any micro-portion in a typical micro-region, that is, there are no non-uniform precipitation zones. The precipitates having an average grain diameter smaller than about 7 nm are measured with 750,000 magnifications and the precipitates having an average grain diameter equal to or larger than 7 nm are measured with 150,000 magnifications. The precipitates having an average grain diameter equal to or smaller than the measurement limit are not added to the calculation of the average grain diameter. As described above, the detection limit of the grain diameter with 150,000 magnifications is set to 2.5 nm and the detection limit of the grain diameter with 750,000 magnifications is set to 0.7 nm.

Since a lot of dislocations exist in a final material subjected to the cold working, the TEM observation was carried out in a recrystallization portion subjected to the final precipitation heat treatment and/or in a fine crystallized portion. Obviously, since the heat causing the growth of precipitates is not applied after the final precipitation heat treatment, the grain diameter of the precipitates hardly changes. The precipitates become larger with the formation and growth of recrystallized grains. The formation and growth of the nuclei of precipitates depend on the temperature and time, and particularly, as the temperature is increased, the degree of growth is increased. Since the formation and growth of recrystallized grains also depend on the temperature, whether or not the formation and growth of recrystallized grains and the formation and growth of precipitates are performed in a timely manner has a large effect on strength, electrical conductivity, ductility, stress relaxation properties and heat resistance. When an average size of grains, including the diameter of precipitates of a recrystallization portion, is larger than 11 nm, a contribution to strength becomes smaller. Meanwhile, by a combination of Co and P under the addition of a small amount of Sn and the hot rolling conditions and the like of the preceding process, fine precipitates making a large contribution to strength are formed, and when the heat is applied until just before the recrystallization, an average grain diameter of the precipitates is equal to or larger than 2.0 nm. When too much heat is applied, a proportion of a recrystallization portion is more than half and thus the number of precipitates increases, the precipitates become larger and an average grain diameter thereof becomes 12 nm or larger. Precipitates having a grain diameter of about 25 nm also increase. When the precipitates are smaller than 2.0 nm, a precipitation amount is insufficient and electrical conductivity deteriorates. In addition, when the precipitates are smaller than 2.0 nm, strength is saturated. In view of strength, the precipitates are preferably equal to or smaller than 8.8 nm, more preferably equal to or smaller than 7.2 nm, and most preferably in the range of 2.5 to 6.0 nm from the relationship with electrical conductivity. In addition, even when an average grain diameter is small, when a proportion of coarse precipitates is large, the precipitates do not contribute to strength. That is, since large precipitated grains larger than 25 nm hardly contribute to strength, it is preferable that a proportion of precipitates having a grain diameter equal to or smaller than 25 nm is equal to or greater than 90% or equal to or greater than 95%. Moreover, when the precipitates are not uniformly dispersed, the strength is low. Regarding the precipitates, it is most preferable that three conditions, that is, a small average grain diameter, no coarse precipitates and uniform precipitation are satisfied.

In the invention, even when Co and P are ideally mixed and even when the precipitation heat treatment is performed under the ideal conditions, not all the Co and P are used to form precipitates. In the invention, when the precipitation heat treatment is performed with the industrially practicable mixing of Co and P and precipitation heat treatment condition, about 0.007 mass % of Co and about 0.009 mass % of P are not used to form the precipitates and are present in a solid solution state in the matrix. Accordingly, it is required to determine amass ratio of Co to P by deducting 0.007 mass % and 0.009 mass % from the mass concentrations of Co and P, respectively. That is, it is not enough to simply determine a ratio of [Co] to [P], and a value of ([Co]-0.007)/([P]-0.009) which is in the range of 3.0 to 5.9 (preferably in the range of 3.1 to 5.2, more preferably in the range of 3.2 to 4.9, and most preferably in the range of 3.4 to 4.2) is an essential condition. When the most preferable ratio of ([Co]−0.007) to ([P]−0.009) is achieved, target fine precipitates are formed and thus an essential requirement for a high-electrical conductivity and high-strength material is satisfied. The target precipitates are expressed by a formula such as $CO_2P$, $CO_{2.a}P$ or $CO_xP_y$, as described above. When the ratio is beyond the above-described range, one of Co or P forms precipitates and remains in a solid solution state, and thus a high-strength material cannot be obtained and the electrical conductivity becomes worse. Moreover, since precipitates contrary to the purpose of the combination ratio are formed and thus the diameter of the precipitated grains becomes larger or the precipitates hardly contribute to the strength, a high-electrical conductivity and high-strength material cannot be obtained.

Since fine precipitates are formed in this manner, a material having sufficiently high strength can be obtained by a small amount of Co and P. In addition, as described above, although Sn does not directly form precipitates, the addition of Sn causes the recrystallization in the hot rolling to be delayed. That is, the addition of Sn causes an increase in a recrystallization temperature and thus a sufficient amount of Co and P can be subjected to solid solution in a hot rolling stage. In addition, a high-strength and high-electrical conductivity rolled sheet can be obtained with a combination of a precipitation heat treatment with cold rolling of the preceding process. When the cold rolling with a high working ratio is carried out, the recrystallization temperature of the matrix is raised by the addition of Sn and thus a large amount of fine precipitates of Co, P and the like can be precipitated simultaneously with the recovery of ductility caused by the softening of the matrix, formation of fine crystals and partial recrystallization. Obviously, when the recrystallization precedes the precipitation, most of the matrix is recrystallized and thus strength is decreased. Conversely, when the precipitation goes ahead while the matrix is not recrystallized, a big problem occurs in ductility. Otherwise, when raising a heat treatment condition up to a recrystallized state, the precipitates become coarse and the number of precipitates decreases. Accordingly, precipitation hardening cannot be exhibited.

Next, Ni and Fe will be described. In order to obtain the high strength and high electrical conductivity as the object of the invention, a ratio among Co, Ni, Fe and P is very important. In the cases of Co and P, fine precipitates are formed in which a mass concentration ratio of Co:P is about 4:1 or 3.5:1. However, Ni and Fe replace functions of Co under certain concentration conditions, and when Ni and Fe are added, precipitates of Co, Ni, Fe and P where a part of Co of basic $CO_2P$, $CO_{2.a}P$, or $CO_{b.c}P$ is substituted with Ni or Fe by the precipitation process, for example, combination forms such as $CO_xNi_yP_z$ and $CO_xFe_yP_z$ are obtained. These precipitates are nearly spherical or nearly elliptical in shape and have a grain diameter of about several nanometers. The precipitates are in the range of 2.0 to 11 nm (preferably in the range of 2.0 to 8.8 nm, more preferably in the range of 2.4 to 7.2 nm, and most preferably in the range of 2.5 to 6.0 nm when being defined by an average grain diameter of the precipitates shown in a plane. Alternatively, 90%, preferably 95% or more of the precipitates are in the range of 0.7 to 25 nm or in the range of 2.5 to 25 nm (the same as "25 nm or less", as described above). By uniformly precipitating these precipitates, high strength and high electrical conductivity can be obtained with a combination with the metal structure.

When an element is added to copper, electrical conductivity deteriorates. For example, in general, heat and electrical conductivity is damaged by about 10% only with a 0.02 mass % single addition of Co, Fe or P to pure copper. However, when 0.02 mass % of Ni is singly added, heat and electrical conductivity is lowered only by about 1.5%.

In the above-described numerical expression ([Co]+0.85×[Ni]+0.75×[Fe]−0.007), the coefficient 0.85 of [Ni] and the coefficient 0.75 of [Fe] indicate proportions of the binding of Ni and Fe to P when a proportion of the binding of Co to P is set to 1. In addition, when a mixing ratio of Co and P is beyond the most preferable range, a combination state of the precipitates changes and thus the fineness and uniform dispersion of the precipitates are damaged. Alternatively, Co or P which is not given to the precipitation is excessively subjected to solid solution in the matrix and the recrystallization temperature is lowered. Accordingly, the balance between the precipitation and the recovery of the matrix is disrupted, the various characteristics of the object of the invention cannot be achieved and the electrical conductivity deteriorates. When Co, P and the like are properly mixed and fine precipitates are uniformly distributed, an excellent effect is exhibited in ductility such as bendability by the synergetic effect with Sn. As described above, since about 0.007 mass % of Co and 0.009 mass % of P are not used to form precipitates and are present in a solid solution state in the matrix, electrical conductivity is equal to or less than 89% IACS. When considering additional elements such as Sn, electrical conductivity is about 87% IACS or less, or is about 355 W/m·K or less in terms of heat conductivity. In this regard, these values show electrical conductivity of the same high level or greater than in pure copper (phosphorus-deoxidized copper) including 0.025 mass % of P.

Fe and Ni act for the effective binding of Co to P. The single addition of these elements lowers the electrical conductivity and rarely contributes to an improvement in all the characteristics such as heat resistance and strength. Ni has an alternate function of Co on the basis of the addition of Co and P, and an amount of decrease in conductivity is small even when Ni is in the state of solid solution. Accordingly, even when a value of ([Co]+0.85×[Ni]+0.75×[Fe]−0.007)/([P]−0.009) is outside the center value of 3.0 to 5.9, Ni has a function of minimizing a decrease in electrical conductivity. In addition, Ni improves stress relaxation properties which are required for connectors when not contributing to the precipitation. Moreover, Ni prevents the diffusion of Sn during Sn plating of connectors. However, when Ni is contained in an excessive amount equal to or greater than 0.24 mass % or beyond the range of the numerical expression (1.2×[Ni]+2×[Fe][Co]), the composition of precipitates gradually changes and a contribution to an improvement in strength is thus not made. In addition, hot deformation resistance increases and electrical conductivity and heat resistance are lowered. The upper limit of Ni is 0.24 mass %, preferably 0.18 mass %, and more preferably 0.09 mass %. The lower limit thereof is 0.01 mass %, preferably 0.015 mass %, and more preferably 0.02 mass %.

The addition of a small amount of Fe, based on the addition of Co and P, leads to an improvement in strength, an increase of the non-recrystallized structure and fineness of the recrystallization portion. Regarding the formation of precipitates together with Co and P, Fe is stronger than Ni. However, when Fe is added in an excessive amount equal to or greater than 0.12 mass % or beyond the range of the numerical expression (1.2×[Ni]+2×[Fe][Co]), the composition of precipitates gradually changes and a contribution to an improvement in strength is thus not made. In addition, hot deformation resistance increases, and ductility and electrical conductivity are also lowered. When a calculated value of the numerical expression ([Co]+0.85x[Ni]+0.75×[Fe]−0.007)/([P]−0.009) is greater than 4.9, much of the Fe is subjected to solid solution and the electrical conductivity becomes worse. For this reason, the upper limit of Fe is 0.12 mass %, preferably 0.06 mass %, and more preferably 0.045 mass %. The lower limit thereof is 0.005 mass %, preferably 0.007 mass %, and more preferably 0.008 mass %.

Al, Zn, Ag, Mg or Zr decreases intermediate temperature embrittlement while hardly damaging the electrical conductivity, detoxifies S formed and incorporated during a recycle process and improves the ductility, strength and heat resistance. For this, each of Al, Zn, Ag and Mg is required to be contained in an amount equal to or greater than 0.002 mass % and Zr is required to be contained in an amount equal to or greater than 0.001 mass %. Zn improves solder wettability and brazing properties. Meanwhile, the content of Zn is at least equal to or less than 0.045 mass %, and preferably less than 0.01 mass % when a manufactured high-performance copper alloy rolled sheet is subjected to brazing in a vacuum melting furnace or the like, used under vacuum or used at high temperatures. When the content exceeds the upper limit thereof, the above effect is not only saturated but a decrease in electrical conductivity starts, hot deformation resistance increases, and thus hot deformability becomes worse. When the electrical conductivity is emphasized, the additional amount of Sn is preferably equal to or less than 0.095 mass %, and most preferably equal to or less than 0.045 mass %. Additional amounts of Al and Mg are preferably equal to or less than 0.095 mass %, and more preferably equal to or less than 0.045 mass %, additional amounts of Zn and Zr are preferably equal to or less than 0.045 mass %, and an additional amount of Ag is preferably equal to or less than 0.3 mass %, and more preferably equal to or less than 0.095 mass %.

Next, manufacturing processes will be described with reference to FIG. 1. FIG. 1 shows examples of the manufacturing process. In a manufacturing process A, casting, hot rolling and shower cooling are performed, and after the shower cooling, cold rolling, a precipitation heat treatment, cold rolling and a recovery heat treatment are performed. In a manufacturing process B, after the shower cooling, a precipitation heat treatment, cold rolling, a precipitation heat treatment, cold rolling and a recovery heat treatment are performed. In a manufacturing process C, after the shower cooling, cold rolling, a precipitation heat treatment, cold rolling, a precipitation heat treatment, cold rolling and a recovery heat treatment are performed. In a manufacturing process D, after the shower cooling, cold rolling, a precipitation heat treatment, cold rolling, a precipitation heat treatment, cold rolling and a recovery heat treatment are performed as in the manufacturing process C, but a different method is employed for the precipitation heat treatment. In the processes A, B and C, medium thick sheets and thin sheets are manufactured, and in the process D, thin sheets are manufactured. In the processes A, B, C and D, a facing process or a pickling process is properly performed in accordance with surface properties which are required for a rolled sheet. In this specification, when the thickness of a final product is equal to or greater than about 1 mm, the final product is set as a medium thick sheet, and when the thickness is less than about 1 mm, the final product is set as a thin sheet. However, there is no strict boundary between the medium thick sheet and the thin sheet.

In these manufacturing processes A to D, thin sheets are mainly manufactured, and thus these processes have a high total cold rolling ratio. When cold rolling is performed, the material is work hardened and strength thereof increases. However, the material becomes poorer in ductility. In general, the recrystallization is carried out by means of annealing to soften the matrix, thereby recovering the ductility. However, when the matrix is completely recrystallized, the strength of the matrix is not only significantly lowered, but precipitated grains become larger and do not contribute to the strength and stress relaxation properties become worse. In view of the strength, first, it is important to maintain the smallness of the diameter of the precipitated grains. After complete recrystallization, the precipitates become coarse even when performing cold rolling in the next process, so the precipitation hardening is lost and thus high strength cannot be obtained. Meanwhile, it is important that how ductility and cold bendability are to be increased while decreasing the processing strain caused by work hardening and obtaining high strength. In the case of the invention alloy, a heat treatment is performed with the precipitation heat treatment condition for obtaining a matrix state just before the start of the recrystallization or a slightly recrystallized matrix state, so ductility is increased. Since the recrystallization ratio is low, the strength of the matrix is increased and the precipitates are fine. Accordingly, high strength is ensured. In the case of the invention alloy, when heating is performed with the heat treatment condition for obtaining a state just before the recrystallization, fine crystals having a low dislocation density are formed, and unlike typical copper alloys, ductility is dramatically improved. For this, it is necessary that a total cold rolling ratio is equal to or greater than 70% (preferably equal to or greater than 80% or 90%, and more preferably equal to or greater than 94%). When a precipitation heat treatment is performed with the temperature condition for obtaining a matrix state just before the recrystallization or a recrystallized matrix state of 45% or less, preferably 20% or less, and particularly 10% or less, fine crystals are formed although viewed as one kind of rolled structure by a metallograph. When observing the metal structure of a sample with a recrystallization ratio of 10% by an electron back scattering diffraction pattern (EBSP) technique, fine grains, which have an average grain size of 0.3 to 4 μm and have an elliptical shape elongated to be long in a rolling direction, can be confirmed mainly around original crystal grain boundaries elongated in the rolling direction. According to the inverse pole figure (IPF) map and the grain boundary map in the EBSP analysis result, these fine crystals have a random orientation, a low dislocation density and small strain. It is thought that these fine crystals are in the recrystallization category since they have a low dislocation density and small strain. However, a large difference of these fine crystals from the recrystallization is that no annealing twin crystals are observed. These fine crystals greatly improve the ductility of the work hardened material and hardly damage the stress relaxation properties. In order to form fine crystals, from the relationship of crystal nuclei forming sites of the fine crystals, cold rolling (working) with a total cold rolling ratio of 70% or greater and a heat treatment condition for obtaining a state just before the recrystallization or a state having a recrystallization ratio of 45% or less are required. Increasing a total cold rolling ratio and lowering a recrystallization ratio are conditions for forming fine crystals having a smaller grain size. When a recrystallization ratio increases, fine crystals are changed into recrystallized grains and a proportion of the fine crystals decreases. When a cold rolling ratio is greater than, for example, 90% or 94%, it is desirable that a precipitation heat treatment process is added in the mid-course to obtain a metal structure having fine crystals and some recrystallized grains and a precipitation heat treatment process is added again after cold rolling. When a material including fine crystals is cold-rolled and is subjected to a precipitation heat treatment under the condition of a recrystallization ratio of 45% or less, and preferably 20% or less, the formation of fine crystals is further promoted. In this manner, the formation of fine crystals depends on a total cold rolling ratio.

When being observed with a microscope, the fine crystals are viewed as a fibrous metal structure extending in the rolling direction as in the cold-rolled structure before the heat treatment even when the etched pattern is different between the structures. However, when observing the fine crystals with EBSP, fine crystal grains having a low dislocation density can be confirmed. In the fine crystal grains, twin crystals typical of a recrystallization phenomenon of a copper alloy are not detected. Regarding the distribution and form of the fine crystals, the fine crystals are formed in the rolling direction as if the strongly-worked crystals elongated in the rolling direction were divided. In addition, a number of grains having a crystal orientation other than the orientation of the rolled texture can be observed. Next, differences between the fine crystals and the recrystallized grains will be shown. In the case of general recrystallized grains, twin crystals typical of a copper alloy can be observed and the shape is a nearly circular shape, like regular hexagon or regular octagon. Accordingly, an average ratio of the long side to the short side of the crystal grain is close to 1, and at least less than 2. On the other hand, in the case of fine crystals, there are no twin crystals and the shape elongates in the rolling direction. An average ratio of the long side length to the short side length of the crystal grain is in the range of 2 to 15 and an average grain size is also roughly smaller than that of the recrystallized grains. As described above, from the existence of twin crystals and the ratio of the long side to the short side of the crystal grain, it is possible to distinguish the fine crystals from the recrystallized grains. Similarities between the recrystallized grains and the fine crystals are that both of them are formed by applying heat, the nuclei of the crystals are formed around the original crystal grain boundaries subjected to strong working strain, the dislocation density is low and a lot of strain caused by cold working is released.

An average size of the fine crystals is in the range of 0.3 to 4 μm, and a proportion of the fine crystals is required to be equal to or greater than 0.1% in order to ensure good ductility even after final cold rolling. The upper limit is equal to or less than 25%. In addition, the higher the total cold rolling ratio and the lower the recrystallization ratio are, the smaller the size of the fine crystals becomes. From the point of view of stress relaxation properties and strength, it is desirable that the size of the fine crystals is small in the limit range, and from the point of view of ductility, it is desirable that the size of the fine crystals is large in the limit range. Accordingly, the size is preferably in the range of 0.5 to 3 μm, and more preferably in the range of 0.5 to 2 μm. As described above, since the fine crystals appear in a state just before the recrystallization or a state having a recrystallization ratio of 45% or less, preferably 20% or less, and particularly 10% or less, the precipitated grains are maintained to be small, the strength and stress relaxation properties are maintained and the ductility is recovered. Moreover, since the precipitation of the precipitates further proceeds simultaneously with the formation of the fine crystals, the electrical conductivity also becomes better. In addition, the higher the recrystallization ratio is, the better the electrical conductivity and ductility are. However, when the range of the upper limit is exceeded, the precipitates become coarse and the strength of the matrix is lowered. Accordingly, the strength of the material is lowered and the stress relaxation properties are also lowered. When it is difficult to distinguish the fine crystals from the recrystallized grains, the evaluation may be made by putting the fine crystals and the recrystallized grains together. The reason is that the fine crystals are low-dislocation-density-crystals which are newly formed by heat, and thus the fine crystals belong to the category of recrystallized grains. That is, by putting the fine crystals and the recrystallized grains together, a proportion thereof in the metal structure may be adjusted to be equal to or greater than 0.5% and equal to or less than 45%, preferably in the range of 3% to 35%, and more preferably in the range of 5% to 20%, and an average grain size of the crystal grains may be in the range of 0.5 to 6 μm, and preferably in the range of 0.7 to 5 μm.

Next, hot rolling will be described. For example, an ingot which is used in the hot rolling is in the range of about 100 to 400 mm in thickness, in the range of about 300 to 1500 mm in width and in the range of about 500 to 10000 mm in length. The ingot is heated at temperatures of 830° C. to 960° C. and is generally hot-rolled into a thickness of from 10 mm to 20 mm in order to obtain a cold-rolled material for a thin sheet or a medium thick sheet. It takes a time of about 100 to 500 seconds until the hot rolling ends. During the hot rolling, the temperature of the rolled material is lowered, and particularly, when the thickness is decreased to 25 mm or 18 mm or less, a long time is required to perform the rolling due to the effect of the thickness and the increasing length of the rolled material, and thus the temperature of the rolled material markedly decreases. It is definitely preferable that the material is hot-rolled in a state in which a decrease in temperature is small. However, in the hot rolling stage, since a precipitation rate of Co, P and the like is low, industrially sufficient solution heat-treating is possible on the condition that an average cooling rate from the temperature immediately after the hot rolling or 650° C. to 350° C. is equal to or greater than 2° C. When the sheet thickness after the hot rolling is small, the temperature of the final hot-rolled material is lowered and the length of the rolled sheet increases. Accordingly, it is difficult to carry out uniform cooling and solution heat-treating. Even in this state, in the case of the invention alloy, precipitates of Co, P and the like are partially formed during the cooling, but many of the elements Co, P and the like are subjected to uniform solid solution That is, regarding the characteristics of the portion which is initially cooled after the hot rolling and the portion which is finally cooled, there is no large difference between the portions in the mechanical properties such as tensile strength and a conductivity of the final product.

When the heating temperature of an ingot is lower than 830° C., Co, P and the like are not sufficiently subjected to solid solution and solution heat-treated. In addition, since the invention alloy has high heat resistance, there is concern that a cast structure will not be completely destroyed and will remain, although also depending on the relationship with the rolling ratio in the hot rolling. Meanwhile, when the heating temperature is higher than 960° C., the solution heat-treated state is also generally saturated, crystal grains of a hot-rolled material become coarse and the material characteristics are affected. An ingot heating temperature is preferably in the range of 850° C. to 950° C., and more preferably in the range of 885° C. to 930° C. When considering a temperature decrease of the ingot (hot-rolled material) during the rolling, it is preferable that a high rolling rate is employed and a high draft (rolling ratio) of one pass is employed. In greater detail, it is preferable that the number of rolling operations is reduced by adjusting an average rolling ratio after the fifth pass to 20%. Because of this, recrystallized grains are made fine and the growth of crystals can be suppressed. Moreover, when a strain rate is increased, recrystallized grains are made fine. By increasing a rolling ratio and a strain rate, Co and P are maintained in a solid solution state at a lower temperature.

The invention alloy has a boundary temperature determining whether or not static and dynamic recrystallization is caused at about 750° C. during the hot rolling process. Although also depending on the hot rolling ratio, strain rate, composition and the like at that time, at temperatures higher than about 750° C., almost all the parts are recrystallized by the static and dynamic recrystallization. When the temperature is lower than about 750° C., a recrystallization ratio is lowered, and when the temperature is 670° C. or 700° C., the recrystallization hardly occurs. As the working ratio is increased and as strong strain is applied in a short time, the boundary temperature moves to the low-temperature side. A decrease in boundary temperature causes Co, P and the like to be in a solid solution state at a lower temperature and causes precipitates in the subsequent precipitation heat treatment to be larger in amount and to be finer. Accordingly, a hot rolling end temperature is preferably equal to or higher than 670° C., more preferably equal to or higher than 700° C., and still more preferably equal to or higher than 720° C. Although also depending on the heating temperature and the rolling condition, the hot-rolled structure enters a warm-rolled state in the final rolling stage when a thickness of the hot-rolled material is equal to or less than 20 mm or equal to or less than 15 mm. In this process, the metal structure of the hot-rolled material is not completely recrystallized by a precipitation heat treatment of the later process. Accordingly, even when the material is made into a thin sheet, the non-recrystallized structure remains and affects the characteristics of the thin sheet, particularly ductility and strength. For this reason, the metal structure of the average grain size or the like in the hot rolling stage is also important. When the average grain size is larger than 50 μm, bendability and ductility become worse, and when the average grain size is smaller than 6 μm, a state of solution heat-treating is insufficient and the recrystallization of the matrix is accelerated when a precipitation heat treatment is performed. The average grain size is equal to or larger than 6 μm and equal to or smaller than 50 μm, preferably in the range of 7 to 45 μm, more preferably in the range of 8 to 35 μm, and most preferably in the range of 10 to 30 μm. Alternatively, the relationship of $5.5\times(100/RE0)\leq D\leq 75\times(60/RE0)$ is satisfied where a rolling ratio of the hot rolling is denoted by RE0(%) and a grain size after the hot rolling is denoted by D μm. Regarding the upper limit, the ingot structure is almost completely destroyed at a hot rolling ratio of 60% and becomes a recrystallized structure, and recrystallized grains thereof become smaller with the increasing rolling ratio. Accordingly, 60/RE0 is multiplied. Conversely, regarding the lower limit, the lower the rolling ratio, the larger the side of the recrystallized grain, so 100/RE0 is multiplied. The average grain size preferably satisfies the relationship of $7\times(100/RE0)\leq D\leq 60\times(60/RE0)$, and most preferably satisfies the relationship of $9\times(100/RE0)\leq D\leq 50\times(60/RE0)$.

In addition, it is important that when a cross-section of the crystal grain after the hot rolling taken along the rolling direction is observed, an average value of L1/L2 is equal to or greater than 1.02 and equal to or less than 4.5 when a length in the rolling direction of the crystal grain is denoted by L1 and a length in a direction perpendicular to the rolling direction of the crystal grain is denoted by L2. The metal structure in the hot rolling also has an effect on a final sheet. As described above, in the last half of the hot rolling, non-recrystallized grains appear and the crystal grains enter a warm-rolled state in some cases. In addition, the crystal grains have a shape slightly extending in the rolling direction. Since the crystal grains in a warm-rolled state have a low dislocation density, sufficient ductility is achieved. However, in the case of the invention alloy which is subjected to cold rolling with a total cold rolling ratio of 70% or greater, when an average long/short ratio (L1/L2) of the crystal grains already exceeds 4.5 in the hot rolling stage, ductility of the sheet becomes poorer. In addition, since a recrystallization temperature is lowered and the recrystallization of the matrix precedes the precipitation, strength is decreased. The average value of L1/L2 is preferably equal to or less than 3.9, more preferably equal to or less than 2.9, and most preferably equal to or less than 1.9. The average L1/L2 value less than 1.02 indicates that some of the crystal grains are grown and a mixed grain state thus occurs, and ductility or strength of a thin sheet becomes poorer. More preferably, the average L1/L2 value is equal to or greater than 1.05.

In the case of the invention alloy, in order to solution heat-treat Co, P and the like, that is, cause Co, P and the like to be subjected to solid solution in the matrix, an ingot is required to be heated at least at 830° C. or higher, preferably 885° C. or higher in the hot rolling. In the ingot in a solution heat-treated state, a temperature decrease occurs during the hot rolling and a long time is required to perform the hot rolling. Accordingly, in view of the temperature decrease and the rolling time, it is thought that a hot-rolled material is already not in a solution heat-treated state. However, despite this, a hot-rolled material of the invention alloy is in an industrially sufficient solution heat-treated state. For example, when the invention alloy is hot-rolled into a thickness of up to about 15 mm, the temperature of the material at that time is decreased up to about 700° C., which is lower than a solution heat temperature or a rolling start temperature by at least 100° C., and a time period for the rolling is in the range of 100 to 500 seconds. However, a hot-rolled material of the invention alloy is in an industrially sufficient solution heat-treated state. A final hot-rolled material has a material length of 10 to 50 m and is subsequently cooled. However, the rolled material cannot be cooled at one time by general shower cooling.

Even when there is a temperature difference or a temporal difference when performing the cooling over the range from the front end of the start of the water cooling to the back end at which the water cooling ends, in the case of the invention alloy, a difference in characteristics is hardly caused in a final sheet. One reason for the low solution heat sensitivity is the addition of a small amount of Sn in addition to Co, P and the like. However, by a series of processes such as cold rolling to be described later and a heat treatment condition, fine precipitates of Co, P and the like are uniformly precipitated, and by the formation of fine grains or the formation of fine recrystallized grains, the invention alloy has uniform and excellent ductility, strength and electrical conductivity. In the case of other precipitation type copper alloys including Cr—Zr copper, as well as a temperature difference or a temporal difference of the final cooling, the temperature of a hot-rolled material is lower than a solution heat temperature by 100° C. or greater, and when 100 seconds or more elapse during that period, an industrially sufficient solution heat-treated state cannot be obtained. That is, the precipitation hardening can hardly be expected and there is no formation of fine grains, so the other precipitation type copper alloys above are distinguished from the invention alloy.

In the cooling after the hot rolling, since the invention alloy has much lower solution heat sensitivity than Cr—Zr copper and the like, for example, a cooling rate greater than 100° C./sec for preventing the precipitation during the cooling is not particularly required. However, since it is definitely desirable that a larger amount of Co, P and the like is in a solid solution state, it is desirable to perform the cooling at a cooling rate equal to or greater than several degrees C./sec after the hot rolling. In greater detail, an average cooling rate of the material until the temperature of the rolled material after the hot rolling or the temperature of the rolled material goes down from 650° C. to the temperature range of 350° C. is 2° C./sec or greater, preferably 3° C./sec or greater, more preferably 5° C./sec or greater, and most preferably 10° C./sec or greater. High strength is obtained by solid solution as much Co and P as possible and precipitating a large amount of fine precipitated grains through a precipitation heat treatment.

After the hot rolling, cold rolling is performed. When a precipitation heat treatment is performed after the cold rolling, fine precipitates of 5 nm or less are precipitated simultaneously with the start of softening the matrix as the temperature gets higher. In the case of a sheet subjected to the rolling with a cold rolling ratio of 70% or greater, when a temperature of the precipitation heat treatment condition is raised so that the rolled sheet is in a state just before the formation of recrystallized grains, the formation of fine crystals starts in accordance with the condition and a precipitation amount of precipitates increases substantially. High strength is maintained until just before recrystallized grains are formed. The reason is that, even when the matrix starts to be softened, precipitates are fine and a precipitation amount thereof also increases, so the matrix is precipitation-hardened and thus these offset each other and the matrix has about the same strength before and after the precipitation heat treatment. In this stage, Co, P and the like are subjected to solid solution in the matrix and thus electrical conductivity is low. With the precipitation heat treatment condition under which recrystallized grains start to be formed, the precipitation is further promoted and thus electrical conductivity is improved and ductility of the matrix is significantly improved. When the cold rolling is performed at a high rolling ratio, the softening phenomenon of the matrix shifts to the low-temperature side and the recrystallization occurs. Further, since the diffusion easily occurs, the precipitation also moves to the low-temperature side. Since the shift of the recrystallization temperature of the matrix to the low-temperature side is larger than in the above case, it is difficult to balance excellent strength, electrical conductivity and ductility. Also in the case of the invention alloy, when a precipitation heat treatment temperature is lower than a proper temperature condition to be described later, strength is ensured because of the work hardening by the cold working but ductility becomes worse. In addition, since the precipitation occurs slightly, a precipitated and hardened amount is small and electrical conductivity is poor. When a precipitation heat treatment temperature is higher than the proper temperature condition, the recrystallization of the matrix proceeds, so excellent ductility is obtained but it is not possible to get the benefit of the work hardening by the cold working. In addition, since the precipitation proceeds, the maximum electrical conductivity is obtained, but as the recrystallization proceeds, precipitated grains are rapidly grown and thus the contribution of precipitates to the strength becomes lower. In addition, stress relaxation properties become worse.

When describing the relationship between the precipitation heat treatment condition and the precipitation state, hardness and metal structure, a state of the rolled material after a proper heat treatment, that is, a specific state after a precipitation heat treatment is that the softening of the matrix, the formation of fine crystals and a decrease in strength by partial recrystallization are offset with the hardening by the precipitation of Co, P and the like and thus a level slightly lower than that in a state cold-rolled at a high rolling ratio is obtained in terms of strength. For example, it is desirable to retain the rolled material to be lowered by several points to 50 points in Vickers hardness. The matrix has, in greater detail, a metal structure state with a recrystallization ratio of 45% or less, preferably 30% or less, more preferably 20% or less, and if emphasizing strength, 10% or less from a state just before the recrystallization. Even when a recrystallization ratio is equal to or less than 10%, the precipitation is only slightly insufficient as compared with a structure with a high recrystallization ratio, and thus electrical conductivity deteriorates. However, since precipitated grains are fine, the precipitation hardening makes a contribution, and meanwhile, since the state is a stage just before the recrystallization, good ductility is obtained and ductility is maintained even when performing final cold rolling. In addition, when a recrystallization ratio is greater than 45%, electrical conductivity and ductility are improved, but due to further softening of the matrix and precipitate coarsening, a high-strength material cannot be obtained and stress relaxation properties also becomes worse. In the case in which the electrical conductivity is emphasized, when a precipitation heat treatment is performed between hot rolling and cold rolling to precipitate precipitates in advance, the precipitation at the time of performing a precipitation heat treatment which is performed after the cold rolling is promoted and the electrical conductivity is improved.

In the case of a thin sheet, which is rolled at a total cold rolling ratio of 90% or greater or 94% or greater or which has a sheet thickness of 1 mm or equal to or less than 0.7 mm, significant working strain is applied to the thin sheet by cold rolling and thus a precipitation heat treatment is preferably performed more than once. In this case, when Co, P and the like, which are subjected to solid solution in the matrix, are not precipitated at one time, but the capacity to precipitate Co and P is left in the first heat treatment to perform the precipitation heat treatment in twice, a thin sheet can be made which is excellent in all the characteristics such as electrical conductivity, strength, ductility and stress relaxation properties. If the first precipitation heat treatment and the second precipitation heat treatment take the same period of time, it is desirable that the temperature of the first precipitation heat treatment is higher than the temperature of the second precipitation heat treatment. The reason is that since the second rolling is performed in a non-recrystallized state, crystal nuclei forming sites of fine crystals and recrystallized grains increase and the capacity to precipitate decreases due to the first precipitation heat treatment. In the case of the invention alloy, since fine precipitates are formed, a decrease in electrical conductivity by cold rolling is large as compared with other copper alloys. Since atomic-level movement is made by performing a recovery heat treatment after final cold rolling, the electrical conductivity before the rolling can be ensured and stress relaxation properties, spring properties and ductility are improved.

As the precipitation heat treatment, a long-time precipitation heat treatment which is performed by a batch system or a short-time precipitation heat treatment which is performed by a so-called AP line (continuous annealing and cleaning line) is employed. In the case of the long-time precipitation heat treatment which is performed by a batch system, when a time period for the heat treatment is short, the temperature is definitely increased, and when a cold working ratio is high, precipitation sites increase. Accordingly, the heat treatment temperature is lowered or the holding period of time is shortened. The conditions of the long-time heat treatment are that the temperature is in the range of 350° C. to 540° C. and the period of time is in the range of 2 to 24 h, and preferably, the temperature is in the range of 370° C. to 520° C. and the period of time is in the range of 2 to 24 h, and a heat treatment index It1, which is equal to $(T-100\times th^{-1/2}-110\times(1-RE/100)^{1/2})$ where a heat treatment temperature is denoted by T(° C.), a holding period of time is denoted by th (h) and a rolling ratio of cold rolling is denoted by RE (%), satisfies the relationship of $265\leq It1\leq 400$, preferably the relationship of $295\leq It1\leq 395$, and most preferably the relationship of $315\leq It1\leq 385$. The temperature condition at which a time period for the heat treatment is prolonged moves to the low-temperature side. However, the effect on the temperature is generally given by a reciprocal of a square root of the time. In addition, with the increasing rolling ratio, precipitation sites increase and the movement of atoms increases, so the precipitation easily occurs and thus the heat treatment temperature moves to the low-temperature side. Regarding the effect on the temperature, a square root of the rolling ratio is generally given. A two-stage heat treatment in which initially, for example, a heat treatment is performed at 500° C. for 2 hours, furnace cooling is then performed and a heat treatment is performed at 480° C. for 2 hours has an effect on an improvement in electrical conductivity, particularly. The long-time precipitation heat treatment, which is used in the intermediate process of a thin sheet manufacturing process, and an initial precipitation heat treatment when the precipitation heat treatment is performed more than once most preferably satisfy the relationship of $320\leq It1\leq 400$, and a final precipitation heat treatment when the precipitation heat treatment is performed more than once most preferably satisfies the relationship of $275\leq It1\leq 375$. In this manner, in the precipitation heat treatment condition after the first precipitation heat treatment, the value of It1 is slightly smaller than in the condition for the first precipitation heat treatment. The reason is that in the first or preceding precipitation heat treatment, Co, P and the like are already precipitated to some extent, and since a part of the matrix is recrystallized or fine crystals are formed, the precipitation, recrystallization or formation of fine crystals occurs under the low heat treatment condition in the precipitation heat treatments after the first precipitation heat treatment. However, the precipitation heat treatment condition after the first precipitation heat treatment depends on a recrystallization ratio or a precipitation state of Co, P and the like of the preceding precipitation heat treatment. These precipitation heat treatment conditions also relate to the solution heat-treated state of the hot rolling and the solid solution state of Co, P and the like. For example, the higher the cooling rate of the hot rolling, and the higher the hot rolling start or end temperature, the more the most preferable condition moves to the upper-limit side in the above inequality expression.

Since the short-time precipitation process is performed for a short time, it is advantageous from the point of view of energy and productivity. In addition, since the same effect as in the long-time precipitation heat treatment is obtained, the short-time precipitation heat treatment is particularly effective in the intermediate process of a thin sheet. The conditions of the short-time precipitation heat treatment are that the highest reached temperature is in the range of 540° C. to 770° C. and a holding period of time from "the highest reached temperature-50° C." to the highest reached temperature is in the range of 0.1 to 5 minutes, and preferably, the highest reached temperature is in the range of 560° C. to 720° C. and a holding period of time from "the highest reached temperature-50° C." to the highest reached temperature is in the range of 0.1 to 2 minutes, and a heat treatment index It2, which is equal to $(Tmax-100\times tm^{-1/2}-100\times(1-RE/100)^{1/2})$ where the highest reached temperature is denoted by Tmax (° C.), a holding period of time is denoted by tm(min) and a rolling ratio of cold rolling is denoted by RE(%), satisfies the relationship of $340\leq It2\leq 515$, and preferably the relationship of $360\leq It2\leq 500$. It is natural that when the upper limit of the precipitation heat treatment condition is exceeded, a recrystallization ratio of the matrix rises and the strength of a final sheet decreases. The important thing is that the higher the temperature and the longer the time period are, the more the precipitated grains are grown and thus do not contribute to strength. In addition, basically, once the precipitated grains become larger, they do not become smaller. When the lower limit of the precipitation heat treatment condition is reached or exceeded, the matrix is not softened and thus a problem occurs in ductility and the precipitation does not proceed. Accordingly, the precipitation heat treatment has no effect.

In a normal precipitation hardening type alloy, in a solution heat-treated state, precipitates become coarse even for a short time when heating is performed at 700° C. Alternatively, the precipitation takes a long time, and thus precipitates of a target diameter or a target amount of precipitates are not obtained, or formed precipitates disappear and are subjected to solid solution. Accordingly, a final high-strength and high-electrical conductivity material cannot be obtained. Unless a special solution heat treatment is performed in the subsequent process, even when the heating at 700° C. is an intermediate precipitation heat treatment, precipitates do not become smaller after becoming coarse once. The most suitable precipitation condition for a normal precipitation type alloy is that the precipitation is carried out for several hours or tens of hours. However, performing the precipitation heat treatment at high temperatures for a short time of about 1 minute is a big feature of the invention alloy.

In addition, in the case of the present alloy, ductility of the matrix is recovered simultaneously with the precipitation. Accordingly, even in a non-recrystallized state, essentially required bendability can be dramatically improved. Of course, when some recrystallization occurs, ductility is further improved. That is, by using this property, the following two types of products can be made.

1. High strength is considered to be the top priority, and good electrical conductivity and ductility are retained.

2. Strength is sacrificed to some degree, and a material which is more excellent in electrical conductivity and ductility is provided.

In a manufacturing method of the first type, a precipitation heat treatment temperature is set to be slightly low and a recrystallization ratio in intermediate and final precipitation processing heat treatments is adjusted to 25% or less, and preferably 10% or less. Fine crystals are formed in a larger amount. A state of the matrix is a state in which a recrystallization ratio is low, but ductility can be ensured. Under this precipitation heat treatment condition, since Co, P and the like are not completely precipitated, conductivity is slightly low. At this time, an average grain size of the recrystallization portion is preferably in the range of 0.7 to 7 μm, and more preferably in the range of 0.8 to 5.5 μm due to the low recrystallization ratio. A proportion of fine crystals is preferably in the range of 0.1% to 25%, and more preferably in the range of 1% to 20%, and an average grain size thereof is preferably in the range of 0.3 to 4 μm, and more preferably in the range of 0.3 to 3 μm. In some cases, it is difficult to distinguish recrystallized grains from fine crystals even in EBSP. In this case, a proportion of all the recrystallized grains and fine crystals in the metal structure is preferably in the range of 0.5% to 45%, and more preferably in the range of 1% to 25%. An average grain size of the recrystallized grains and fine crystals is preferably in the range of 0.5 to 6 μm, and more preferably in the range of 0.6 to 5 μm.

In a manufacturing method of the second type, a precipitation heat treatment is performed under the condition where fine recrystallized grains are formed. Accordingly, a recrystallization ratio is preferably in the range of 3% to 45%, and more preferably in the range of 5% to 35%. At this time, an average grain size of the recrystallization portion is preferably in the range of 0.7 to 7 μm, and more preferably in the range of 0.8 to 6 μm. Due to the high recrystallization ratio, a proportion of fine crystals is inevitably lower than in the first type, and preferably in the range of 0.1% to 10%. An average grain size is also larger than in the first type, and preferably in the range of 0.5 to 4.5 μm. A proportion of all the recrystallized grains and fine crystals in the metal structure is preferably in the range of 3% to 45%, and more preferably in the range of 10% to 35%. An average grain size of all the recrystallized grains and fine crystals is preferably in the range of 0.5 to 6 μm, and more preferably in the range of 0.8 to 5.5 μm. The matrix is composed of recrystallized grains, fine crystals and non-recrystallized grains, and as the recrystallization is proceeding, the precipitation further proceeds and the diameter of precipitated grains becomes larger. Strength and stress relaxation properties slightly lower than in the first type are obtained, but ductility is further improved and the precipitation of Co, P and the like almost ends, and thus electrical conductivity is also improved.

For the first type, specific preferable heat treatment conditions are that in the case of the long-time heat treatment, the temperature is in the range of 350° C. to 510° C., the period of time is in the range of 2 to 24 hours, and the relationship of $280\leq It1\leq 375$ is satisfied. In the case of the short-time heat treatment, the highest reached temperature is in the range of 540° C. to 770° C., a holding period of time from "the highest reached temperature-50° C." to the highest reached temperature is in the range of 01.1 to 5 minutes and the relationship of $350\leq It2\leq 480$ is satisfied.

For the second type, in the case of the long-time heat treatment, the temperature is in the range of 380° C. to 540° C., the period of time is in the range of 2 to 24 hours and the relationship of $320\leq It1\leq 400$ is satisfied. In the case of the short-time heat treatment, the highest reached temperature is in the range of 540° C. to 770° C., a holding period of time from "the highest reached temperature-50° C." to the highest reached temperature is in the range of 0.1 to 5 minutes and the relationship of $380\leq It2\leq 500$ is satisfied.

When a precipitation heat treatment is performed, precipitated grains in a recrystallization portion become larger in addition to the formation of twin crystals as a feature of the recrystallization or the recrystallization of a copper alloy. As the precipitated grains become larger, the strengthening by the precipitation becomes smaller. That is, the contribution to strength is small. Basically, once the precipitates are precipitated, the grains are not decreased in diameter unless they are subjected to the solution heat treatment and the precipitation heat treatment. By prescribing a recrystallization ratio, the diameter of the precipitates can be controlled. When the precipitated grains become larger, stress relaxation properties also become worse.

The precipitates obtained as a result of the treatments have a substantially circular or substantially elliptical shape on a plane. The precipitates have an average grain diameter of 2.0 to 11 nm (preferably 2.0 to 8.8 nm, more preferably 2.4 to 7.2 nm, and most preferably 2.5 to 6.0 nm), and, alternatively, the fine precipitates, 90% or more, and preferably 95% or more of which is in the range of 0.7 to 25 nm or in the range of 2.5 to 25 nm, are uniformly dispersed. 0.7 nm and 2.5 nm in the description "in the range of 0.7 to 25 nm or in the range of 2.5 to 25 nm" are the lower limits which are measured by an electron microscope as described above. Accordingly, the ranges of "in the range of 0.7 to 25 nm or in the range of 2.5 to 25 nm" have the same meaning as "25 nm or less".

It is desirable that in the metal structure after the precipitation heat treatment in the high-performance copper alloy rolled sheet manufacturing process, the matrix is not completely changed into a recrystallized structure and a recrystallization ratio thereof is in the range of 0% to 45% (preferably in the range of 0.5% to 35%, and more preferably in the range of 3% to 25%). When two or more precipitation heat treatments are performed with cold rolling interposed therebetween, a recrystallization ratio when performing an initial precipitation heat treatment is preferably the same as or higher than a recrystallization ratio when performing a subsequent precipitation heat treatment. For example, when two precipitation heat treatments are performed, a first recrystallization ratio is in the range of 0% to 45% (preferably in the range of 5% to 40%) and a second recrystallization ratio is in the range of 0% to 35% (preferably in the range of 3% to 25%).

In a conventional copper alloy, when a high rolling ratio greater than, for example, 50% is employed, work hardening is caused by cold rolling and thus ductility becomes poor. In addition, when a metal structure is changed into a completely recrystallized structure by annealing, it becomes soft and thus ductility is recovered. However, when non-recrystallized grains remain during the annealing, ductility is not sufficiently recovered, and when a proportion of the non-recrystallized structure is equal to or greater than 50%, ductility is particularly insufficient. On the other hand, in the case of the invention alloy, even when the proportion of the remaining non-recrystallized structure is 55% or greater, and cold rolling and annealing are repeatedly carried out in a state in which 55% or greater of the non-recrystallized structure remains, good ductility is obtained.

In the case of a sheet, a final sheet thickness of which is small, it is basically required that after finishing cold rolling, a recovery heat treatment is performed in the end. However, the recovery heat treatment is not necessarily required when a precipitation heat treatment is a final process, when a final cold rolling ratio is low, that is, equal to less than 10%, or when heat is applied once again to a rolled material and a worked material thereof by brazing, solder plating or the like, when heat is further applied to a final sheet by soldering, brazing or the like, and when a sheet is punched out into a product shape by pressing and then subjected to a recovery process. In addition, in accordance with a product, a recovery heat treatment is performed even after a heat treatment such as brazing in some cases. The significance of the recovery heat treatment is as follows.

1. Bendability and ductility of a material are increased. Strain generated by cold rolling is reduced to a micro level and elongation is improved. Regarding local deformation caused by a bend test, cracks are hardly formed.

2. Since an elastic limit is increased and a longitudinal elasticity modulus is increased, spring properties required for connectors are improved.

3. In a usage environment of temperatures near 100° C. for a vehicle or the like, stress relaxation properties are improved. When the stress relaxation properties are poor, permanent deformation occurs during use and predetermined stress is not generated.

4. Electrical conductivity is improved. When fine precipitates are formed in a large amount in a precipitation heat treatment before final rolling, electrical conductivity is decreased more markedly than in the case in which a material with a recrystallized structure is subjected to cold rolling. By the final rolling, the increasing number of micro-vacancies and the turbulence of atoms near fine precipitates of Co, P and the like cause electrical conductivity to be lowered. However, by this recovery heat treatment, an atomic-level change to a state approaching the preceding precipitation heat treatment occurs and thus electrical conductivity is improved. In addition, when a recrystallized material is cold-rolled at a rolling ratio of 40%, a decrease in conductivity is not much more than 1% to 2%. However, in the case of the invention alloy with a recrystallization ratio of 10%, conductivity is lowered by 4%. By the recovery heat treatment, about 3% of conductivity is recovered and this improvement in conductivity has a pronounced effect in a high-electrical conductivity material.

5. Residual stress generated by cold rolling is released.

Conditions of the recovery heat treatment are that the highest reached temperature Tmax (° C.) is in the range of 200° C. to 560° C., a holding period of time tm (min) from "the highest reached temperature-50° C." to the highest reached temperature is in the range of 0.03 to 300 minutes and the relationship of $150 \leq It3 \leq 320$ is satisfied, and preferably the relationship of $170 \leq It3 \leq 295$ is satisfied where a rolling ratio of cold rolling after the final precipitation heat treatment is denoted by RE2(%) and a heat treatment index It3 is equal to $(Tmax-60\times tm^{-1/2}-50\times(1-RE2/100)^{1/2})$. In this recovery heat treatment, the precipitation hardly occurs. By atomic-level movement, stress relaxation properties, electrical conductivity, spring properties and ductility are improved. When the upper limit of the precipitation heat treatment condition of the above inequality expression is exceeded, the matrix is softened, and depending on circumstances, recrystallization starts and thus strength decreases. Before the recrystallization, or when the recrystallization starts as described above, precipitated grains are grown and do not contribute to strength. When the lower limit is exceeded, atomic-level movement is less and thus stress relaxation properties, electrical conductivity, spring properties and ductility are not improved.

A high-performance copper alloy rolled sheet obtained by this series of hot rolling processes has excellent electrical conductivity and strength and its conductivity is equal to or greater than 45% IACS. When conductivity is denoted by R(% IACS), tensile strength is denoted by S(N/mm$^2$) and elongation is denoted by L(%), a value (hereinafter, referred to as a performance index Is) of $(R^{1/2}\times S\times(100+L)/100)$ is equal to or greater than 4300 and also may be equal to or greater than 4600. When an additional amount of Sn is equal to or less than 0.095%, a high-electrical conductivity sheet of 66% IACS or greater can be obtained, and when an additional amount of Sn is equal to or less than 0.045%, a high-electrical conductivity sheet of 72% IACS or greater can be obtained. At the same time, the high-performance copper alloy rolled sheet has excellent bendability and stress relaxation properties. Regarding characteristics thereof, a variation in characteristics in rolled sheets manufactured by the same ingot is small. Regarding tensile strength of a heat-treated material or a final sheet, a ratio of (minimum tensile strength/maximum tensile strength) in rolled sheets manufactured by the same ingot is equal to or greater than 0.9 and also may be equal to or greater than 0.95. Also in the case of conductivity, a ratio of (minimum conductivity/maximum conductivity) in rolled sheets manufactured by the same ingot is equal to or greater than 0.9 and also may be equal to or greater than 0.95. Like this, the high-performance copper alloy rolled sheet has uniform mechanical properties and electrical conductivity in rolled sheets manufactured by the same ingot.

In addition, since a high-performance copper alloy rolled sheet according to the invention has excellent heat resistance, tensile strength thereof at 350° C. is equal to or greater than 300 (N/mm$^2$). Vickers hardness (HV) after heating at 700° C. for 30 seconds is equal to or greater than 100 or is 80% or more of a value of Vickers hardness before the heating, or, a recrystallization ratio in a metal structure after heating is equal to or less than 45%.

In summary, a high-performance copper alloy rolled sheet of the invention is achieved by a combination of composition and process. First, during a hot rolling process, Co, P and the like are in a target solution heat-treated (solid solution) state, and the metal structure is composed of crystal grains which have small strain while flowing in a rolling direction due to a decrease in final hot rolling temperature. Then, by the most suitable combination of a precipitation heat treatment and cold rolling, in the work hardened matrix, ductility is recovered by the formation of fine crystals and partial recrystallization, and at the same time, Co, P and the like in a solution heat-treated state are finely precipitated, and finally, finishing cold rolling and a recovery heat treatment are performed and thus high strength, high electrical conductivity, good bendability and stress relaxation properties are obtained. Regarding a suitable combination of rolling and a precipitation heat treatment, in the case in which a final thickness is large, that is, in the range of 1 to 4 mm, a total cold working ratio is about 70% to 90%, so when a precipitation heat treatment is performed so that a state just before the formation of recrystallization is changed into a state of a recrystallization ratio of 45% by a single precipitation heat treatment process, a material in which strength, electrical conductivity, ductility and stress relaxation properties are balanced is finally obtained. When obtaining high electrical conductivity, it is desirable to employ a high recrystallization ratio or add a precipitation heat treatment process after hot rolling. When a final thickness is about 1 mm or less, or further 0.7 mm or less, the precipitation heat treatment is performed twice. In the first precipitation heat treatment, a metal structure state which focuses on an improvement in electrical conductivity and the recovery of ductility while remaining the capacity to precipitate is made. In the second precipitation heat treatment, Co and P in a non-precipitated state are precipitated, fine crystals are easily formed by an increase in a total cold rolling ratio and the recrystallization partially occurs. Accordingly, good ductility is obtained while minimizing a decrease in strength of the matrix. In addition, by the work hardening caused by the finishing rolling and a final recovery heat treatment, a copper alloy material is obtained which has good bendability maintained therein, high strength, high electrical conductivity and good stress relaxation properties.

EXAMPLES

By using the above-described first to fifth invention alloys and copper alloys each having a composition for comparison, high-performance copper alloy rolled sheets were created. Table 1 shows compositions of alloys used to create the high-performance copper alloy rolled sheets.

TABLE 1

| | Alloy | Alloy composition (mass %) | | | | | | | | | | | | | |
|---|---|---|---|---|---|---|---|---|---|---|---|---|---|---|---|
| | No. | Cu | Co | P | Sn | Ni | Fe | Al | Zn | Ag | Mg | Zr | X1 | X2 | X3 |
| First invention alloy | 11 | Rem. | 0.32 | 0.08 | 1.02 | | | | | | | | 4.41 | | |
| Second invention alloy | 21 | Rem. | 0.27 | 0.081 | 0.04 | | | | | | | | 3.65 | | |
| | 22 | Rem. | 0.19 | 0.058 | 0.03 | | | | | | | | 3.73 | | |
| Third invention alloy | 31 | Rem. | 0.25 | 0.069 | 0.62 | | | | | | | | 4.05 | | |
| Fourth invention alloy | 41 | Rem. | 0.23 | 0.082 | 0.02 | 0.07 | | | | | | | | 3.87 | 0.08 |
| | 42 | Rem. | 0.19 | 0.067 | 0.03 | 0.03 | 0.03 | | | | | | | 3.98 | 0.10 |
| | 43 | Rem. | 0.21 | 0.065 | 0.11 | | 0.02 | | | | | | | 3.89 | 0.04 |
| Fifth invention alloy | 51 | Rem. | 0.29 | 0.087 | 0.03 | | | 0.03 | | | 0.02 | | 3.63 | | |
| | 52 | Rem. | 0.24 | 0.068 | 0.03 | | | | 0.03 | | | 0.007 | 3.95 | | |
| | 53 | Rem. | 0.22 | 0.079 | 0.04 | 0.05 | 0.02 | | 0.04 | | | | | 3.86 | 0.10 |
| | 54 | Rem. | 0.19 | 0.077 | 0.43 | 0.08 | | | 0.13 | | | | | 3.69 | 0.10 |
| | 55 | Rem. | 0.27 | 0.073 | 0.48 | | | | 0.04 | | 0.01 | | 4.11 | | |
| | 56 | Rem. | 0.24 | 0.074 | 0.02 | 0.04 | | 0.02 | | | | 0.02 | | 4.11 | 0.05 |
| | 57 | Rem. | 0.26 | 0.076 | 0.03 | | | | | 0.1 | | | 3.78 | | |
| Comparative alloy | 61 | Rem. | 0.12 | 0.05 | 0.03 | | | | | | | | 2.76 | | |
| | 62 | Rem. | 0.19 | 0.041 | 0.05 | | | | | | | | 5.72 | | |
| | 63 | Rem. | 0.25 | 0.065 | 0.001 | | | | | | | | 4.34 | | |
| | 64 | Rem. | 0.25 | 0.047 | 0.04 | | | | | | | | 6.39 | | |

TABLE 1-continued

| | Alloy No. | Alloy composition (mass %) Cu | Co | P | Sn | Ni | Fe | Al | Zn | Ag | Mg | Zr | X1 | X2 | X3 |
|---|---|---|---|---|---|---|---|---|---|---|---|---|---|---|---|
| | 65 | Rem. | 0.16 | 0.08 | 0.05 | 0.16 | | | | | | | | 4.07 | 0.19 |
| | 66 | Rem. | 0.17 | 0.069 | 0.04 | | 0.12 | | | | | | | 4.22 | 0.24 |
| | 67 | Rem. | 0.26 | 0.071 | 1.7 | | | | | | | | 4.08 | | |
| | 68 | Rem. | 0.17 | 0.062 | 0.002 | 0.06 | | | | | | | | 4.04 | 0.07 |
| CrZr—Cu | 70 | Rem. | 0.85Cr—0.08Zr | | | | | | | | | | | | |

X1 = ([Co] − 0.007)/([P] − 0.009)
X2 = ([Co] + 0.85[Ni] + 0.75[Fe] − 0.007)/([P] − 0.009)
X3 = 1.2[Ni] + 2[Fe]

As alloys, an alloy No. 11 as the first invention alloy, alloys No. 21 and 22 as the second invention alloy, an alloy No. 31 as the third invention alloy, alloys No. 41 to 43 as the fourth invention alloy, alloys No. 51 to 57 as the fifth invention alloy, alloys No. 61 to 68 as comparative alloys, each having a composition similar to that of the invention alloy and an alloy No. 70 as conventional Cr—Zr copper were prepared, and from an arbitrary alloy, high-performance copper alloy rolled sheets were created by a plurality of processes.

Tables 2 and 3 show conditions of the manufacturing processes. Following the processes of Table 2, the processes of Table 3 were performed.

TABLE 2

| | Process | Final thickness mm | Hot rolling: Start temperature ° C. | Hot rolling: Final temperature ° C. | Hot rolling: Sheet thickness mm | Cooling rate ° C./sec (rear end) | Heat treatment ° C.-time | Cold rolling: mm | Cold rolling: Red | Precipitation heat treatment: ° C.-time | Heat treatment index It1 | Heat treatment index It2 |
|---|---|---|---|---|---|---|---|---|---|---|---|---|
| Actual machine test | A A1 | 0.4 | 905 | 690 | 13 | 3 | | 0.7 | 94.6 | | | |
| | A11 | 2.0 | 905 | 690 | 13 | 3 | | 3.2 | 75.4 | | | |
| | A12 | 2.0 | 905 | 690 | 13 | 3 | | 3.2 | 75.4 | | | |
| | A13H | 2.0 | 905 | 690 | 13 | 3*[1] | | 3.2 | 75.4 | | | |
| | A14H | 2.0 | 905 | 690 | 13 | 3 | | 3.2 | 75.4 | | | |
| | A15H | 2.0 | 905 | 690 | 13 | 3 | | 3.2 | 75.4 | | | |
| | A16 | 2.0 | 905 | 735 | 18 | 8 | | 3.2 | 82.2 | | | |
| | A17 | 2.0 | 905 | 765 | 18 | 20 | | 3.2 | 82.2 | | | |
| | A18H | 2.0 | 965 | 820 | 18 | 20 | | 3.2 | 82.2 | | | |
| | B B1 | 0.4 | 905 | 690 | 13 | 3 | 450-8 h | 0.7 | 94.6 | | | |
| | B11 | 2.0 | 905 | 690 | 13 | 3 | 455-8 h | 3.2 | 75.4 | | | |
| | C C1 | 0.4 | 905 | 690 | 13 | 3 | | 2.0 | 84.6 | 440-5 h | 352.1 | |
| | C2 | 0.4 | 905 | 690 | 13 | 3 | | 2.0 | 84.6 | 440-5 h | 352.1 | |
| | C4 | 0.4 | 870 | 670 | 13 | 2.8 | | 2.0 | 84.6 | 440-5 h | 352.1 | |
| | C5 | 0.4 | 920 | 700 | 13 | 3.3 | | 2.0 | 84.6 | 440-5 h | 352.1 | |
| | C6 | 0.4 | 905 | 725 | 18 | 10 | | 2.0 | 88.9 | 450-6 h | 372.5 | |
| | C61 | 0.4 | 905 | 765 | 18 | 20 | | 2.0 | 88.9 | 450-6 h | 372.5 | |
| | C7H | 0.4 | 810 | 640 | 13 | 2.2 | | 2.0 | 84.6 | 440-5 h | 352.1 | |
| | C8H | 0.4 | 965 | 730 | 13 | 3.8 | | 2.0 | 84.6 | 440-5 h | 352.1 | |
| | C9H | 0.4 | 905 | 690 | 13 | 3 | | 2.0 | 84.6 | 520-5 h | 432.1 | |
| | C10H | 0.4 | 905 | 690 | 13 | 1.5 | | 2.0 | 84.6 | 440-5 h | 352.1 | |
| | C11H | 0.4 | 905 | 690 | 13 | 3 | | 2.0 | 84.6 | 440-5 h | 352.1 | |
| | C12H | 0.4 | 905 | 690 | 13 | 3 | | 2.0 | 84.6 | 440-5 h | 352.1 | |
| | C13H | 0.4 | 905 | 690 | 13 | 3 | | 2.0 | 84.6 | 440-5 h | 352.1 | |
| | D D1 | 0.4 | 905 | 690 | 13 | 3 | | 2.0 | 84.6 | 630-0.8 min | | 479.0 |
| | D2 | 0.4 | 905 | 690 | 13 | 3 | | 2.0 | 84.6 | 585-2.2 min | | 478.9 |
| | D3 | 0.4 | 905 | 690 | 13 | 3 | | 2.0 | 84.6 | 630-0.8 min | | 479.0 |
| | D4 | 0.4 | 905 | 725 | 18 | 10 | | 2.0 | 88.9 | 630-0.6 min | | 467.6 |
| | D5 | 0.4 | 905 | 690 | 13 | 3 | | 2.0 | 84.6 | 700-0.2 min | | 437.7 |
| | D6H | 0.4 | 905 | 690 | 13 | 3 | | 2.0 | 84.6 | 630-0.8 min | | 479.0 |
| Laboratory test | C LC1 | 0.36 | 910 | 695 | 8 | 4 | | 1.8 | 77.5 | 440-5 h | 343.1 | |
| | LC6 | 0.36 | 910 | 735 | 10 | 10 | | 1.8 | 82.0 | 440-5 h | 348.6 | |
| | D LD3 | 0.36 | 910 | 695 | 8 | 4 | | 1.8 | 77.5 | 630-0.8 min | | 470.8 |

*[1]Heating at 900° C. for 30 minutes and then water cooling

TABLE 3

| | | | Cold rolling | | Total cold rolling | Precipitation heat treatment | | | Cold rolling | | Recovery heat treatment | |
|---|---|---|---|---|---|---|---|---|---|---|---|---|
| | Process | | mm | Red | ratio | ° C.-time | Heat treatment index It1 | Heat treatment index It2 | mm | Red | ° C.-time (min) | Heat treatment index It3 |
| Actual machine test | A | A1 | | | 94.6 | 430-6 h | 363.6 | | 0.4 | 42.9 | 460-0.2 min | 288.0 |
| | | A11 | | | 75.4 | 440-6 h | 344.6 | | 2.0 | 37.5 | 300-60 min | 252.7 |
| | | A12 | | | 75.4 | 460-6 h | 364.6 | | 2.0 | 37.5 | 450-0.3 min | 300.9 |
| | | A13H | | | 75.4 | 460-6 h | 364.6 | | 2.0 | 37.5 | 300-60 min | 252.7 |
| | | A14H | | | 75.4 | 510-6 h | 414.6 | | 2.0 | 37.5 | 300-60 min | 252.7 |
| | | A15H | | | 75.4 | 340-6 h | 244.6 | | 2.0 | 37.5 | 300-60 min | 252.7 |
| | | A16 | | | 82.2 | 460-6 h | 372.8 | | 2.0 | 37.5 | 300-60 min | 252.7 |
| | | A17 | | | 82.2 | 460-6 h | 372.8 | | 2.0 | 37.5 | 300-60 min | 252.7 |
| | | A18H | | | 82.2 | 460-6 h | 372.8 | | 2.0 | 37.5 | 300-60 min | 252.7 |
| | B | B1 | | | 94.6 | 410-6 h | 343.6 | | 0.4 | 42.9 | 460-0.2 min | 288.0 |
| | | B11 | | | 75.4 | 430-6 h | 334.6 | | 2.0 | 37.5 | 300-60 min | 252.7 |
| | C | C1 | 0.7 | 65.0 | 94.6 | 410-6 h | 304.1 | | 0.4 | 42.9 | 460-0.2 min | 288.0 |
| | | C2 | 0.7 | 65.0 | 94.6 | 410-6 h | 304.1 | | 0.4 | 42.9 | 300-60 min | 254.5 |
| | | C4 | 0.7 | 65.0 | 94.6 | 410-6 h | 304.1 | | 0.4 | 42.9 | 460-0.2 min | 288.0 |
| | | C5 | 0.7 | 65.0 | 94.6 | 420-6 h | 314.1 | | 0.4 | 42.9 | 460-0.2 min | 288.0 |
| | | C6 | 0.7 | 65.0 | 96.1 | 410-6 h | 304.1 | | 0.4 | 42.9 | 460-0.2 min | 288.0 |
| | | C61 | 0.7 | 65.0 | 96.1 | 420-6 h | 314.1 | | 0.4 | 42.9 | 460-0.2 min | 288.0 |
| | | C7H | 0.7 | 65.0 | 94.6 | 410-6 h | 304.1 | | 0.4 | 42.9 | 460-0.2 min | 288.0 |
| | | C8H | 0.7 | 65.0 | 94.6 | 410-6 h | 304.1 | | 0.4 | 42.9 | 460-0.2 min | 288.0 |
| | | C9H | 0.7 | 65.0 | 94.6 | 410-6 h | 304.1 | | 0.4 | 42.9 | 460-0.2 min | 288.0 |
| | | C10H | 0.7 | 65.0 | 94.6 | 410-6 h | 304.1 | | 0.4 | 42.9 | 460-0.2 min | 288.0 |
| | | C11H | 0.7 | 65.0 | 94.6 | 380-2 h | 244.2 | | 0.4 | 42.9 | 460-0.2 min | 288.0 |
| | | C12H | 0.7 | 65.0 | 94.6 | 410-6 h | 304.1 | | 0.4 | 42.9 | — | — |
| | | C13H | 0.7 | 65.0 | 94.6 | 505-8 h | 404.6 | | 0.4 | 42.9 | 460-0.2 min | 288.0 |
| | D | D1 | 0.7 | 65.0 | 94.6 | 580-1.5 min | | 439.2 | 0.4 | 42.9 | 300-60 min | 254.5 |
| | | D2 | 0.7 | 65.0 | 94.6 | 410-6 h | 304.1 | | 0.4 | 42.9 | 460-0.2 min | 288.0 |
| | | D3 | 0.7 | 65.0 | 94.6 | 410-6 h | 304.1 | | 0.4 | 42.9 | 460-0.2 min | 288.0 |
| | | D4 | 0.7 | 65.0 | 96.1 | 410-6 h | 304.1 | | 0.4 | 42.9 | 460-0.2 min | 288.0 |
| | | D5 | 0.7 | 65.0 | 94.6 | 410-6 h | 304.1 | | 0.4 | 42.9 | 460-0.2 min | 288.0 |
| | | D6H | 0.7 | 65.0 | 94.6 | 580-0.25 min | | 320.8 | 0.4 | 42.9 | 460-0.2 min | 288.0 |
| Laboratory test | C | LC1 | 0.63 | 65.0 | 92.1 | 410-6 h | 304.1 | | 0.36 | 42.9 | 460-0.2 min | 288.0 |
| | | LC6 | 0.63 | 65.0 | 93.7 | 410-6 h | 304.1 | | 0.36 | 42.9 | 460-0.2 min | 288.0 |
| | D | LD3 | 0.63 | 65.0 | 92.1 | 410-6 h | 304.1 | | 0.36 | 42.9 | 460-0.2 min | 288.0 |

The manufacturing process was performed by changing the condition in or outside the range of the manufacturing conditions of the invention in the processes A to D. In the tables, for each changed condition, a number was added after the symbol of the process so as to create a symbol such as A1, A11 etc. At this time, for the condition outside the range of the manufacturing conditions of the invention, a symbol H was added after the number so as to create a symbol such as A13H.

In the process A, a raw material was dissolved in a medium frequency melting furnace having an inner volume of 10 tons, so that an ingot, which was 190 mm thick and 630 mm wide in the cross-section, was prepared by semicontinuous casting. The ingot was cut into a 1.5 m length and then subjected to hot rolling-shower cooling-cold rolling-precipitation heat treatment-cold rolling-recovery heat treatment. In the process A1, a final sheet thickness was set to 0.4 mm, and in other processes, a final sheet thickness was set to 2.0 mm. A hot rolling start temperature was set to 905° C., and after hot rolling into a thickness of up to 13 mm or 18 mm was performed, shower cooling was performed. In this specification, a hot rolling start temperature and an ingot heating temperature have the same meaning. An average cooling rate after hot rolling was set to a cooling rate until the temperature of a rolled material after final hot rolling or the temperature of a rolled material went down from 650° C. to 350° C. The average cooling rate after hot rolling was measured at the rear end of the rolled sheet. The measured average cooling rate was in the range of 3 to 20° C./sec.

The shower cooling was performed as follows (also performed in the same manner in the processes B to D). Shower facilities are provided at a position distant from a roller for hot rolling on a transport roller for transporting a rolled material in the hot rolling. When the final pass of the hot rolling ends, a rolled material is transported to the shower facilities by the transport roller and passes through a position at which a shower operation is performed so as to be sequentially cooled from the top end to the rear end. A cooling rate was measured as follows. A rear-end portion (accurately, a position of 90% of the length of a rolled material from the top end of the rolling in a longitudinal direction of the rolled material) of the rolled material at the final pass of the hot rolling was set as a measurement position of the temperature of the rolled material. The temperature measurement was performed just before the transportation of the rolled material, in which the final pass had ended, to the shower facilities and at the time of the end of the shower cooling. On the basis of the temperatures measured at this time and a time interval in which the measurement was performed, a cooling rate was calculated. The temperature measurement was performed by a radiation thermometer. As the radiation thermometer, an infrared thermometer Fluke-574, manufactured by TAKACHIHO SEIKI CO., LTD, was used. Accordingly, an air-cooling state is applied until the rear end of the rolled material reaches the shower facilities and shower water arrives at the rolled material. A cooling rate at that time is low. In addition, the smaller the thickness of the final sheet is, the more time is consumed to reach the shower facilities, and thus the cooling rate becomes low. A test piece to be described later, which is used to examine all the characteristics, is the rear end portion of the hot-rolled material and is collected from a site corresponding to the rear end portion of the shower cooling.

In the process A13H, after hot rolling, heating was performed at 900° C. for 30 minutes and then water cooling was performed. In the cold rolling after the hot rolling, rolling into a thickness of 0.7 mm was performed in the process A1 and rolling into a thickness of 3.2 mm was performed in other processes. After the cold rolling, a precipitation heat treatment was performed at temperatures of 340° C. to 510° C. for 6 hours. After the precipitation heat treatment, cold rolling was performed. In the process A1, rolling into a thickness of 0.4 mm was performed, and in other processes, rolling into a thickness of 2.0 mm was performed. After that, in the processes A1 and A12, a recovery heat treatment was performed at high temperatures for a short time, and in other processes, a recovery heat treatment was performed at 300° C. for 60 minutes. In the processes A14H and A15H of the process A, a heat treatment index It1 of the precipitation heat treatment is outside the manufacturing conditions of the invention. In the process A18H, a hot rolling start temperature is outside the manufacturing conditions.

In the process B, casting and cutting were performed in the same manner as in the process A. Then, hot rolling-shower cooling-precipitation heat treatment-cold rolling-precipitation heat treatment-cold rolling-recovery heat treatment was performed. In the process B1, a final sheet thickness was set to 0.4 mm, and in the process B11, a final sheet thickness was set to 2.0 mm. A hot rolling start temperature was set to 905° C., and after hot rolling into a thickness of up to 13 mm was performed, shower cooling was performed at 3° C./sec. After the water cooling, a precipitation heat treatment was performed at 450° C. for 8 hours and then cold rolling into a thickness of 0.7 mm or 3.2 mm was performed. After the cold rolling, a precipitation heat treatment was performed at 410° C. or 430° C. for 6 hours and then cold rolling into a thickness of 0.4 mm or 2 mm was performed. After that, a recovery heat treatment was performed at 460° C. for 0.2 minutes, or at 300° C. for 60 minutes.

In the process C, casting and cutting were performed in the same manner as in the process A. Then, hot rolling-shower cooling-cold rolling-precipitation heat treatment-cold rolling-precipitation heat treatment-cold rolling-recovery heat treatment were performed. A final sheet thickness was set to 0.4 mm. Hot rolling was performed under the condition of a start temperature of 810° C. to 965° C. A cooling rate of shower cooling was set in the range of 1.5 to 10° C./sec. The first precipitation heat treatment was performed at temperatures of 440° C. to 520° C. for 5 to 6 hours. The second precipitation heat treatment was performed at temperatures of 380° C. to 505° C. for 2 to 8 hours. The recovery heat treatment was performed under three conditions. That is, the recovery heat treatment was performed at 460° C. for 0.2 minutes, or at 300° C. for 60 minutes, or alternatively, the recovery heat treatment was not performed. In the processes C7H and C8H, a hot rolling start temperature is outside the manufacturing conditions of the invention. In the process C9H, a heat treatment index It1 of the first precipitation heat treatment is outside the manufacturing conditions of the invention. In the process C10H, a cooling rate after the hot rolling is outside the manufacturing conditions of the invention. In the processes C11H and C13H, a heat treatment index It1 of the second precipitation heat treatment is outside the manufacturing conditions of the invention. In the process C12H, the recovery heat treatment is not performed and this is outside the manufacturing conditions of the invention. In the process D, casting and cutting were performed in the same manner as in the process A. Then, hot rolling-shower cooling-cold rolling-precipitation heat treatment-cold rolling-precipitation heat treatment-cold rolling-recovery heat treatment were performed as in the process C. However, one or both of the precipitation heat treatments were performed for a short time. A final sheet thickness was set to 0.4 mm. Hot rolling was performed under the condition of a start temperature of 905° C. 3° C./sec and 10° C./sec were set as a cooling rate of shower cooling. The first precipitation heat treatment was set to a short-time heat treatment which is performed at 585° C. to 700° C. for 0.2 to 2.2 minutes. The second precipitation heat treatment was set to a long-time heat treatment which is performed at 410° C. for 6 hours and a high-temperature and short-time heat treatment which is performed at 580° C. for 0.25 to 1.5 minutes. The recovery heat treatment was performed at 460° C. for 0.2 minutes, and 300° C. for 60 minutes. In the process D6H, a heat treatment index It2 of the second precipitation heat treatment is outside the manufacturing conditions of the invention.

As laboratory tests, the processes LC1, LC6 and LD3 were performed as follows. From the ingot of the manufacturing process C1 and the like, a laboratory test ingot having a thickness of 40 mm, a width of 80 mm and a length of 190 mm was cut out. Then, by using test facilities, the processes LC1, LC6 and LD3 were performed under the conditions based on the processes C1, C6 and D3, respectively. In the laboratory test, a process corresponding to a recovery heat treatment or short-time precipitation heat treatment of an AP line or the like was substituted by the dipping of a rolled material in a salt bath. The highest reached temperature was considered as a solution temperature of the salt bath and a dipping period of time was considered as a holding period of time. Air cooling was performed after the dipping. As the salt (solution), a mixture of BaC, KCl and NaCl was used.

As an evaluation of the high-performance copper alloy rolled sheets created by the above-described methods, tensile strength, Vickers hardness, elongation, bendability, stress relaxation properties, conductivity, heat resistance and 350° C. high-temperature tensile strength were measured. In addition, by observing a metal structure, an average grain size and a recrystallization ratio of a recrystallization portion were measured. In addition, an average grain size and a fine crystal ratio of a fine crystal portion were measured. Here, the fine crystal ratio is an area ratio of the fine crystal portion in the metal structure. In addition, an average grain diameter of precipitates and a proportion of the number of precipitates having a grain size equal to or less than a predetermined value among all the diameters of precipitates were measured. Moreover, in a hot-rolled material, a length L1 in the rolling direction of the crystal grain and a length L2 in a direction perpendicular to the rolling direction of the crystal grain were measured, and in a final precipitation heat-treated material, the long side and the short side of the fine grain were also measured.

Tensile strength was measured as follows. For the shape of a test piece, a No. 5 test piece specified in JIS Z 2201 was used.

A bending test (W bending, 180-degree bending) was performed as follows. When a thickness was equal to or greater than 2 mm, 180-degree bending was carried out. A bending radius was one time (1 t) the thickness of the material. When a thickness was 0.4 mm or 0.5 mm, the evaluation was performed by W bending specified in JIS. R of the R portion was the thickness of the material. The sample was carried out in a direction, referred to as a so-called Bad Way, perpendicular to the rolling direction. Regarding determination of bendability, no cracks was evaluation A, crack formation or small cracks not causing destruction was evaluation B, and crack formation or destruction was evaluation C.

A stress relaxation test was performed as follows. In the stress relaxation test of a test material, a cantilever screw jig was used. The shape of a test piece had a size of sheet thickness t×width 10 mm×length 60 mm. Load stress to a test material was 80% of 0.2% proof stress and exposure to an atmosphere of 150° C. for 1000 hours was carried out. A stress-relaxation rate was obtained by the following expression.

Stress-relaxation rate=(displacement after relief/displacement at the time of stress loading)×100(%)

A stress-relaxation rate equal to or less than 25% was evaluation A (excellent), a stress-relaxation rate greater than 25% and equal to or less than 35% was evaluation B (acceptable), and a stress-relaxation rate greater than 35% was evaluation C (unacceptable).

Conductivity was measured by using a conductivity measurement device (SIGMATEST D2.068), manufactured by FOERESTER JAPAN Limited. In this specification, the expression "electrical conduction" and the expression "conductive" are used as having the same meaning. Since heat conductivity is significantly associated with electrical conductivity, it can be said that the higher the conductivity is, the better the heat conductivity is.

Regarding heat resistance, a material cut into a size of sheet thickness×20 mm×20 mm was dipped in a salt bath of 700° C. (a mixture in which NaCl and $CaCl_2$ were mixed at about 3:2) for 30 seconds and then cooled. Then, Vickers hardness and conductivity were measured. The condition that holding is carried out at 700° C. for 30 seconds is roughly coincident with a condition of manual brazing when a brazing filler material BAg-7 is used.

350° C. high-temperature tensile strength was measured as follows. After holding at 350° C. for 30 minutes, a high-temperature tensile test was performed. A gage length was 50 mm and a test part was worked by a lathe to have an external diameter of 10 mm.

The measurement of a recrystallization ratio and an average grain size of recrystallized grains was performed in accordance with a comparison method of a test method of the grain size of an elongated copper product in JIS H 0501 by properly selecting a magnification depending on the sizes of crystal grains in 500-, 200- and 100-fold metal microscope photographs. In a hot-rolled material, an average grain size when L1/L2 was equal to or greater than 2.0 was obtained by a quadrature of the test method of the grain size of an elongated copper product in JIS H 0501. In addition, in the hot-rolled material, when a metal structure was observed in the cross-section of the crystal grain taken along a rolling direction, a length L1 in the rolling direction of the crystal grain and a length L2 in a direction perpendicular to the rolling direction of the crystal grain were measured to obtain a value of L1/L2 in each of arbitrary 20 crystal grains, and an average value thereof was calculated. In the measurement of a recrystallization ratio, classification into non-recrystallized grains and recrystallized grains was carried out, a recrystallization portion was binari zed by image analysis software "WinROOF" and an area ratio thereof was set as a recrystallization ratio. When it was difficult to make a judgment from a metallograph, the measurement was performed by an electron back scattering diffraction pattern (FE-SEM-EBSP) method. In addition, from a crystal grain boundary map of a 3000- or 5000-fold analysis magnification, crystal grains made of crystal grain boundaries having an orientation difference of 15° or more were daubed by markers and the daubed portion was binarized by image analysis software "WinROOF" to calculate a recrystallization ratio. The measurement of a fine crystal ratio and an average grain size of fine crystals was performed in the same manner as in the measurement of a recrystallization ratio and an average grain size of recrystallized grains. At this time, crystals having a long side and short side ratio less than 2 were recrystallized grains, and crystals not including twin crystals and having a long side and short side ratio equal to or greater than 2 were fine crystals. The measurement limit is about 0.2 μm, and even when fine crystals of 0.2 μm or less are present, they are not added to the measurements. Regarding the measurement positions of the fine crystal and the recrystallized grain, two positions inside the two sides, that is, the front side and the back side, by one-fourth length of the sheet thickness were set and measured values at the two positions were averaged. FIG. 2(*a*) shows an example of the recrystallized grains (part marked out in black) and FIG. 2(*b*) shows an example of fine crystals (part marked out in black).

Figure 3:
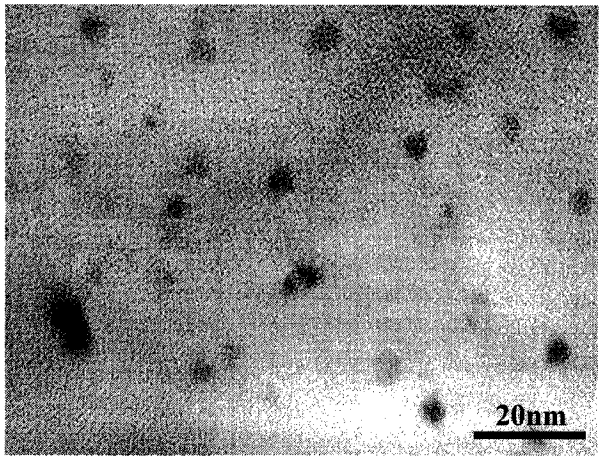
FIG. 3 is a photograph of the metal structure of precipitates of the same high-performance copper alloy rolled sheet.

An average grain diameter of precipitates was obtained as follows. FIG. 3 shows precipitates. In 750.000-fold and 150.000-fold transmission electron images (detection limits were 0.7 nm and 2.5 nm, respectively) obtained by TEM, the contrast of precipitates was elliptically approximated by using image analysis software "WinROOF" and a geometric mean value of the long axis and the short axis was obtained in all the precipitated grains in the field of view. An average value thereof was set an average grain diameter. In the 750.000-fold and 150.000-fold measurement, detection limits of the grain diameter were 0.7 nm and 2.5 nm, respectively. Grains having a diameter less than the limits were treated as noise and these were not included in the calculation of the average grain diameter. In addition, grains having an average grain diameter equal to or less than a boundary diameter of 6 to 8 nm were measured at 750,000 fold and grains having an average grain diameter equal to or greater than the boundary size were measured at 150,000 fold. In the case of a transmission electron microscope, it is difficult to accurately recognize the information of precipitates because a dislocation density is high in a cold-worked material. The diameter of precipitates does not change by the cold working. Accordingly, the observation was carried out in a recrystallization portion or a fine crystal portion after the precipitation heat treatment before the final cold working. Regarding the measurement position, two positions inside the two sides, that is, the front side and the back side, by one-fourth length of the sheet thickness were set, and measured values at the two positions were averaged.

Results of the above-described tests will be described. Tables 4 and 5 show results of the process C1 of the alloys. The same sample on which the test was performed may be described to have a different test No. in the tables of test results to be described later (for example, the sample of test No. 1 of Tables 4 and 5 is the same as the sample of test No. 1 of Tables 18 and 19).

TABLE 4

| | | | | After hot rolling | | | After final precipitation heat treatment: Recrystallization + Fine crystals | | Recrystallization | | Fine crystals | | Precipitates | |
|---|---|---|---|---|---|---|---|---|---|---|---|---|---|---|
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 21 | C1 | 0.4 | 20 | 10 | 2.8 | 11 | 1 | 6 | 1.5 | 5 | 0.9 | 4.3 | 98 |
| 2 | 31 | C1 | 0.4 | 15 | 10 | 2.6 | 17 | 1.2 | 15 | 2 | 2 | 1 | 5.6 | 97 |
| 3 | 41 | C1 | 0.4 | 20 | 10 | 3 | 12 | 1.1 | 9 | 1.5 | 3 | 1 | 4.3 | 99 |
| 4 | 51 | C1 | 0.4 | 20 | 10 | 3.4 | 9 | 1 | 6 | 1.5 | 3 | 0.8 | 4 | 98 |
| 5 | 52 | C1 | 0.4 | 20 | 10 | 3.4 | 14 | 2 | 12 | 2.5 | 2 | 1 | 4.9 | 97 |
| 6 | 53 | C1 | 0.4 | 20 | | | 11 | 1 | 8 | 1.5 | 3 | 0.9 | 4.4 | 99 |
| 7 | 54 | C1 | 0.4 | 20 | 10 | 2.6 | 14 | 1.5 | 12 | 2 | 2 | 1 | 4.9 | 98 |
| 8 | 61 | C1 | 0.4 | 55 | | | 100 | 25 | 100 | 25 | 0 | | 25 | 15 |
| 9 | 62 | C1 | 0.4 | 55 | | | 100 | 20 | 100 | 20 | 0 | | | |
| 10 | 63 | C1 | 0.4 | 40 | | | 65 | 10 | 65 | 10 | 0 | | 13 | 86 |
| 11 | 64 | C1 | 0.4 | 50 | | | 85 | 10 | 85 | 10 | 0 | | 17 | 60 |
| 12 | 70 | C1 | 0.4 | 20 | | | 65 | 8 | 65 | 10 | 0 | | | |

TABLE 5

| | | | | | | | | | | Heat resistance of heating at 700° C. for seconds | | | 350° C. high-temperature |
|---|---|---|---|---|---|---|---|---|---|---|---|---|---|
| Test No. | Alloy No. | Process | Tensile strength N/mm$^2$ | Hardness HV | Elongation % | Bendability | Stress relaxation % | Conductivity % IACS | Performance index Is | Vickers hardness HV | Recrystallization ratio % | Conductivity % IACS | tensile strength N/mm$^2$ |
| 1 | 21 | C1 | 528 | 165 | 8 | A | A | 80 | 5100 | | | | |
| 2 | 31 | C1 | 574 | 179 | 6 | A | A | 61 | 4752 | | | | |
| 3 | 41 | C1 | 535 | 167 | 7 | A | A | 81 | 5152 | | | | |
| 4 | 51 | C1 | 531 | 167 | 8 | A | A | 80 | 5129 | | | | |
| 5 | 52 | C1 | 508 | 161 | 8 | A | A | 81 | 4938 | | | | |
| 6 | 53 | C1 | 533 | 167 | 8 | A | A | 79 | 5116 | | | | |
| 7 | 54 | C1 | 550 | 168 | 8 | A | A | 68 | 4898 | | | | |
| 8 | 61 | C1 | 385 | 108 | 9 | A | C | 74 | 3610 | | | | |
| 9 | 62 | C1 | 381 | 108 | 9 | A | C | 72 | 3524 | | | | |
| 10 | 63 | C1 | 447 | 141 | 7 | A | C | 78 | 4224 | | | | |
| 11 | 64 | C1 | 418 | 123 | 8 | A | C | 72 | 3831 | | | | |
| 12 | 70 | C1 | 422 | 130 | 6 | B | C | 84 | 4100 | | | | |

In the case of the invention alloy, the size of crystal grains after the hot rolling is about 20 μm and is the same as in Cr—Zr copper, but is smaller than in other comparative alloys. In the invention alloy, a final fine crystal ratio is about 5% and an average grain size of fine crystals is about 1 μm. However, in the comparative alloys and Cr—Zr copper, fine crystals are not formed. In addition, the invention alloy has a lower final recrystallization ratio and a smaller average grain size of recrystallized grains than the comparative alloys and Cr—Zr copper. In the invention alloy, a value obtained by adding the fine crystal ratio to the recrystallization ratio after the final precipitation heat treatment is lower than in the comparative alloys and Cr—Zr copper. An average grain size of fine crystals and recrystallized grains is also smaller than in the comparative alloys and Cr—Zr copper. The invention alloy has a smaller average grain diameter of precipitates than the comparative alloys, and has a high proportion of grains of 25 nm or less. The invention alloy also has more excellent results than the comparative alloys and Cr—Zr copper in tensile strength, Vickers hardness, bendability, stress relaxation properties, conductivity and performance index.

Tables 6 to 13 show results of the processes LC1, D3, LD3 and A11 of the alloys.

TABLE 6

| | | | | | | | After final precipitation heat treatment | | | | | | | |
|---|---|---|---|---|---|---|---|---|---|---|---|---|---|---|
| | | | | After hot rolling | | | Recrystallization + Fine crystals | | Recrystallization | | Fine crystals | | Precipitates | |
| Test No. | Alloy No. | Process | Final sheet thickness mm | grain size μm | Recrystal-lization ratio % | L1/L2 | Area ratio of crystals % | Average grain size μm | Recrystal-lization ratio % | Average grain size μm | Fine crystal ratio % | Average grain size μm | Average grain diameter nm | Proportion of grains of 25 mm or less % |
| 1 | 11 | LC1 | 0.36 | 20 | 20 | 2.5 | 26 | 2.5 | 25 | 3.5 | 0.5 | 1.2 | 5.8 | 97 |
| 2 | 21 | LC1 | 0.36 | 25 | 15 | 2.8 | 13 | 1.2 | 10 | 2 | 3 | 1 | 4.8 | 98 |
| 3 | 22 | LC1 | 0.36 | 25 | 25 | 2.4 | 31 | 3.5 | 30 | 4.5 | 1 | 1.5 | 6.6 | 98 |
| 4 | 31 | LC1 | 0.36 | 20 | 20 | 2.5 | 20 | 2 | 18 | 2.5 | 2 | 1 | 5.8 | 96 |
| 5 | 41 | LC1 | 0.36 | 25 | 15 | 3.1 | 14 | 1.2 | 12 | 2 | 2 | 1 | 4.8 | 98 |
| 6 | 42 | LC1 | 0.36 | 25 | 20 | 2.7 | 21 | 2.5 | 20 | 3 | 1 | 1 | 5.7 | 98 |
| 7 | 43 | LC1 | 0.36 | 25 | | | 14 | 2 | 12 | 2.5 | 2 | 1 | 5 | 98 |
| 8 | 51 | LC1 | 0.36 | 25 | 15 | 3 | 13 | 1.2 | 10 | 2 | 3 | 1 | 4.4 | 99 |
| 9 | 52 | LC1 | 0.36 | 25 | 20 | 2.5 | 14 | 2 | 12 | 2 | 1.5 | 1 | 4.5 | 98 |
| 10 | 53 | LC1 | 0.36 | 25 | | | 12 | 1.5 | 10 | 1.5 | 2 | 1 | 4.5 | 97 |
| 11 | 54 | LC1 | 0.36 | 25 | | | 14 | 1.5 | 12 | 2 | 2 | 1 | 4.9 | 97 |
| 12 | 55 | LC1 | 0.36 | 20 | 15 | 3 | 17 | 2 | 15 | 2.5 | 1.5 | 1 | 5.3 | 98 |
| 13 | 56 | LC1 | 0.36 | 25 | | | 14 | 2 | 12 | 2.5 | 1.5 | 1.2 | 5 | 98 |
| 14 | 57 | LC1 | 0.36 | 25 | | | 11 | 1.5 | 8 | 2 | 3 | 1.2 | 4.5 | 98 |
| 15 | 61 | LC1 | 0.36 | 55 | | | 100 | 25 | 100 | 25 | 0 | | | |
| 16 | 62 | LC1 | 0.36 | 55 | | | 100 | 25 | 100 | 25 | 0 | | | |
| 17 | 63 | LC1 | 0.36 | 40 | | | 65 | 12 | 65 | 12 | | | 12 | 87 |
| 18 | 64 | LC1 | 0.36 | 50 | | | | | 95 | 10 | | | | |
| 19 | 65 | LC1 | 0.36 | 45 | | | 60 | 8 | 60 | 8 | 0 | | 12 | 84 |
| 20 | 66 | LC1 | 0.36 | 40 | | | 50 | 7 | 50 | 7 | 0 | | 13 | 85 |
| 21 | 67 | LC1 | 0.36 | 45 | | | 55 | 8 | 55 | 8 | 0 | | 12 | 83 |
| 22 | 68 | LC1 | 0.36 | 45 | | | 70 | 10 | 70 | 10 | 0 | | 13 | 86 |

TABLE 7

| | | | | | | | | | | Heat resistance of heating at 700° C. for 30 seconds | | | 350° C. high-temperature |
|---|---|---|---|---|---|---|---|---|---|---|---|---|---|
| Test No. | Alloy No. | Process | Tensile strength N/mm$^2$ | Hard-ness HV | Elonga-tion % | Bend-ability | Stress relaxation % | Conduc-tivity % IACS | Performance index Is | Vickers hardness HV | Recrystallization ratio % | Conduc-tivity % IACS | tensile strength N/mm$^2$ |
| 1 | 11 | LC1 | 598 | 179 | 7 | B | A | 51 | 4570 | | | | |
| 2 | 21 | LC1 | 522 | 160 | 8 | A | A | 79 | 5011 | | | | |
| 3 | 22 | LC1 | 480 | 154 | 8 | A | B | 84 | 4751 | | | | |
| 4 | 31 | LC1 | 570 | 175 | 7 | A | A | 62 | 4802 | | | | |
| 5 | 41 | LC1 | 530 | 162 | 7 | A | A | 80 | 5072 | | | | |
| 6 | 42 | LC1 | 499 | 157 | 9 | A | A | 80 | 4865 | | | | |
| 7 | 43 | LC1 | 513 | 160 | 7 | A | A | 76 | 4785 | | | | |
| 8 | 51 | LC1 | 530 | 163 | 8 | A | A | 79 | 5088 | | | | |
| 9 | 52 | LC1 | 504 | 157 | 8 | A | A | 81 | 4899 | | | | |
| 10 | 53 | LC1 | 524 | 163 | 8 | A | A | 78 | 4998 | | | | |
| 11 | 54 | LC1 | 553 | 170 | 9 | A | A | 68 | 4971 | | | | |
| 12 | 55 | LC1 | 562 | 173 | 8 | A | A | 67 | 4968 | | | | |
| 13 | 56 | LC1 | 515 | 160 | 8 | A | A | 80 | 4975 | | | | |
| 14 | 57 | LC1 | 521 | 161 | 8 | A | A | 83 | 5126 | | | | |
| 15 | 61 | LC1 | 382 | 109 | 9 | A | C | 74 | 3582 | | | | |
| 16 | 62 | LC1 | 384 | 108 | 9 | A | C | 71 | 3527 | | | | |
| 17 | 63 | LC1 | 449 | 140 | 7 | A | C | 78 | 4243 | | | | |
| 18 | 64 | LC1 | 417 | 122 | 8 | A | C | 73 | 3848 | | | | |
| 19 | 65 | LC1 | 439 | 136 | 9 | A | C | 75 | 4144 | | | | |
| 20 | 66 | LC1 | 450 | 145 | 6 | B | C | 72 | 4047 | | | | |
| 21 | 67 | LC1 | 602 | 182 | 7 | C | C | 41 | 4125 | | | | |
| 22 | 68 | LC1 | 443 | 138 | 7 | B | C | 78 | 4186 | | | | |

TABLE 8

| | | | | After hot rolling | | | After final precipitation heat treatment: Recrystallization + Fine crystals | | Recrystallization | | Fine crystals | | Precipitates | |
|---|---|---|---|---|---|---|---|---|---|---|---|---|---|---|
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 21 | D3 | 0.4 | 20 | 10 | 2.8 | 12 | 1.2 | 8 | 1.5 | 4 | 1 | 4.2 | 98 |
| 2 | 31 | D3 | 0.4 | 15 | 10 | 2.6 | 15 | 1.2 | 10 | 2 | 5 | 1 | 4.8 | 98 |
| 3 | 41 | D3 | 0.4 | 20 | 10 | 3 | 13 | 1.2 | 9 | 2.5 | 4 | 1 | 4.4 | 96 |
| 4 | 51 | D3 | 0.4 | 20 | 10 | 3.4 | 11 | 1.2 | 8 | 2 | 3 | 1 | 4.2 | 98 |
| 5 | 52 | D3 | 0.4 | 20 | 10 | 3.2 | 17 | 2.5 | 15 | 3 | 2 | 1 | 5.5 | 98 |
| 6 | 53 | D3 | 0.4 | 20 | | | 13 | 1.1 | 10 | 1.5 | 3 | 1 | 4.3 | 98 |
| 7 | 54 | D3 | 0.4 | 20 | | | 14 | 1.5 | 12 | 2 | 2 | 1 | 5 | 98 |
| 8 | 61 | D3 | 0.4 | 55 | | | 100 | 20 | 100 | 20 | 0 | | | |
| 9 | 62 | D3 | 0.4 | 55 | | | 100 | 20 | 100 | 20 | 0 | | 27 | 20 |
| 10 | 63 | D3 | 0.4 | 40 | | | 65 | 8 | 65 | 10 | 0 | | 13 | 85 |
| 11 | 64 | D3 | 0.4 | 50 | | | 85 | 10 | 85 | 10 | 0 | | | |

TABLE 9

| | | | | | | | | | | Heat resistance of heating at 700° C. for 30 seconds | | | 350° C. high-temperature |
|---|---|---|---|---|---|---|---|---|---|---|---|---|---|
| Test No. | Alloy No. | Process | Tensile strength N/mm$^2$ | Hardness HV | Elongation % | Bendability | Stress relaxation % | Conductivity % IACS | Performance index Is | Vickers hardness HV | Recrystallization ratio % | Conductivity % IACS | tensile strength N/mm$^2$ |
| 1 | 21 | D3 | 527 | 164 | 7 | A | A | 80 | 5044 | | | | |
| 2 | 31 | D3 | 568 | 175 | 9 | A | A | 62 | 4875 | | | | |
| 3 | 41 | D3 | 518 | 160 | 8 | A | A | 80 | 5004 | | | | |
| 4 | 51 | D3 | 533 | 165 | 7 | A | A | 79 | 5069 | | | | |
| 5 | 52 | D3 | 513 | 160 | 7 | A | A | 82 | 4971 | | | | |
| 6 | 53 | D3 | 530 | 165 | 7 | A | A | 78 | 5008 | | | | |
| 7 | 54 | D3 | 552 | 170 | 8 | A | A | 69 | 4952 | | | | |
| 8 | 61 | D3 | 387 | 109 | 8 | A | C | 75 | 3620 | | | | |
| 9 | 62 | D3 | 386 | 104 | 8 | A | C | 73 | 3562 | | | | |
| 10 | 63 | D3 | 445 | 139 | 7 | B | C | 79 | 4232 | | | | |
| 11 | 64 | D3 | 420 | 121 | 7 | A | C | 73 | 3840 | | | | |

TABLE 10

| | | | | After hot rolling | | | After final precipitation heat treatment: Recrystallization + Fine crystals | | Recrystallization | | Fine crystals | | Precipitates | |
|---|---|---|---|---|---|---|---|---|---|---|---|---|---|---|
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 11 | LD3 | 0.36 | 20 | 20 | 2.5 | 21 | 2 | 20 | 2.5 | 1 | 1 | 5.3 | 98 |
| 2 | 21 | LD3 | 0.36 | 25 | 15 | 2.8 | 14 | 2 | 12 | 3 | 2 | 1.2 | 5 | 98 |
| 3 | 31 | LD3 | 0.36 | 20 | 20 | 2.5 | 17 | 1.5 | 15 | 2 | 2 | 1 | 5.2 | 97 |
| 4 | 41 | LD3 | 0.36 | 25 | 15 | 3.1 | 13 | 1.5 | 10 | 2.5 | 3 | 1 | 4.6 | 98 |
| 5 | 55 | LD3 | 0.36 | 20 | | | 19 | 2.5 | 18 | 3 | 1 | 1 | 5.6 | 97 |
| 6 | 56 | LD3 | 0.36 | 25 | | | 13 | 1.8 | 10 | 2 | 2.5 | 1 | 4.7 | 98 |
| 7 | 67 | LD3 | 0.36 | 45 | | | 55 | 7 | 55 | 7 | 0 | | 9.5 | 87 |

TABLE 11

| Test No. | Alloy No. | Process | Tensile strength N/mm$^2$ | Hardness HV | Elongation % | Bendability | Stress relaxation % | Conductivity % IACS | Performance index Is | Heat resistance of heating at 700° C. for 30 seconds: Vickers hardness HV | Recrystallization ratio % | Conductivity % IACS | 350° C. high-temperature tensile strength N/mm$^2$ |
|---|---|---|---|---|---|---|---|---|---|---|---|---|---|
| 1 | 11 | LD3 | 597 | 180 | 8 | A | A | 52 | 4649 | | | | |
| 2 | 21 | LD3 | 520 | 162 | 7 | A | A | 80 | 4977 | | | | |
| 3 | 31 | LD3 | 571 | 177 | 8 | A | A | 63 | 4895 | | | | |
| 4 | 41 | LD3 | 522 | 161 | 7 | A | A | 80 | 4996 | | | | |
| 5 | 55 | LD3 | 560 | 174 | 8 | A | A | 68 | 4987 | | | | |
| 6 | 56 | LD3 | 510 | 161 | 8 | A | A | 81 | 4957 | | | | |
| 7 | 67 | LD3 | 598 | 183 | 7 | B | C | 42 | 4147 | | | | |

TABLE 12

| Test No. | Alloy No. | Process | Final sheet thickness mm | After hot rolling: grain size μm | After hot rolling: Recrystallization ratio % | After hot rolling: L1/L2 | After final precipitation heat treatment: Recrystallization + Fine crystals: Area ratio of crystals % | Recrystallization + Fine crystals: Average grain size μm | Recrystallization: Recrystallization ratio % | Recrystallization: Average grain size μm | Fine crystals: Fine crystal ratio % | Fine crystals: Average grain size μm | Precipitates: Average grain diameter nm | Precipitates: Proportion of grains of 25 mm or less % |
|---|---|---|---|---|---|---|---|---|---|---|---|---|---|---|
| 1 | 21 | A11 | 2 | 20 | 10 | 2.8 | 12 | 3.0 | 10 | 3.5 | 1.5 | 2.0 | 5.3 | 98 |
| 2 | 31 | A11 | 2 | 15 | 10 | 2.6 | 16 | 2.5 | 15 | 3.0 | 1.0 | 2.0 | 5.5 | 98 |
| 3 | 41 | A11 | 2 | 15 | 10 | 3.0 | 13 | 3.0 | 12 | 3.5 | 1.0 | 2.0 | 5.2 | 98 |
| 4 | 51 | A11 | 2 | 20 | 10 | 3.4 | 11 | 2.5 | 10 | 3.0 | 1.0 | 1.5 | 4.8 | 97 |
| 5 | 52 | A11 | 2 | 20 | 10 | 3.2 | 21 | 4.0 | 20 | 4.0 | 0.5 | 2.0 | 6.1 | 97 |
| 6 | 53 | A11 | 2 | 20 | | | 16 | 3.0 | 15 | 3.5 | 1.0 | 1.5 | 5.5 | 98 |
| 7 | 54 | A11 | 2 | 20 | | | 21 | 3.5 | 20 | 4.0 | 0.5 | 1.5 | 6.2 | 97 |
| 8 | 63 | A11 | 2 | 40 | | | 75 | 10 | 75 | 10 | 0 | | 12 | 82 |
| 9 | 64 | A11 | 2 | 50 | | | 90 | 12 | 90 | 12 | 0 | | | |
| 10 | 21 | A11 Front end | 2 | 20 | 15 | 2.6 | 14 | 3.0 | 8 | 3.0 | 2.0 | 1.5 | 5.0 | 99 |
| 11 | 41 | A11 Front end | 2 | 20 | 10 | 3.0 | 14 | 3.0 | 12 | 3.5 | 1.5 | 2.0 | 5.3 | 98 |
| 12 | 51 | A11 Front end | 2 | 20 | 10 | 3.2 | 11 | 2.5 | 10 | 3.5 | 1.0 | 1.5 | 4.7 | 98 |
| 13 | 52 | A11 Front end | 2 | 20 | 10 | 3.2 | 20 | 4.0 | 20 | 3.5 | 1.0 | 2.0 | 6.0 | 97 |

TABLE 13

| Test No. | Alloy No. | Process | Tensile strength N/mm$^2$ | Hardness HV | Elongation % | Bendability | Stress relaxation % | Conductivity % IACS | Performance index Is | Heat resistance of heating at 700° C. for 30 seconds: Vickers hardness HV | Recrystallization ratio % | Conductivity % IACS | 350° C. high-temperature tensile strength N/mm$^2$ |
|---|---|---|---|---|---|---|---|---|---|---|---|---|---|
| 1 | 21 | A11 | 512 | 158 | 10 | A | A | 78 | 4974 | 135 | 15 | 74 | 367 |
| 2 | 31 | A11 | 555 | 172 | 9 | A | A | 61 | 4725 | | | | |
| 3 | 41 | A11 | 507 | 162 | 10 | A | A | 78 | 4925 | 139 | 10 | 74 | 369 |

TABLE 13-continued

| Test No. | Alloy No. | Process | Tensile strength N/mm² | Hardness HV | Elongation % | Bendability | Stress relaxation % | Conductivity % IACS | Performance index Is | Heat resistance of heating at 700° C. for 30 seconds: Vickers hardness HV | Recrystallization ratio % | Conductivity % IACS | 350° C. high-temperature tensile strength N/mm² |
|---|---|---|---|---|---|---|---|---|---|---|---|---|---|
| 4 | 51 | A11 | 520 | 161 | 9 | A | A | 77 | 4974 | 143 | 5 | 74 | 374 |
| 5 | 52 | A11 | 499 | 155 | 9 | A | A | 77 | 4773 | 126 | 25 | 75 | 350 |
| 6 | 53 | A11 | 516 | 160 | 9 | A | A | 76 | 4903 | 134 | 15 | 72 | 367 |
| 7 | 54 | A11 | 540 | 166 | 10 | A | A | 67 | 4862 | | | | |
| 8 | 63 | A11 | 440 | 138 | 9 | A | C | 77 | 4208 | 92 | 70 | 69 | 258 |
| 9 | 64 | A11 | 410 | 117 | 10 | A | C | 72 | 3827 | 71 | 90 | 62 | 199 |
| 10 | 21 | A11 Front end | 516 | 159 | 10 | A | A | 79 | 5045 | 136 | 15 | 74 | 369 |
| 11 | 41 | A11 Front end | 507 | 161 | 10 | A | A | 78 | 4925 | 138 | 10 | 74 | 368 |
| 12 | 51 | A11 Front end | 522 | 161 | 9 | A | A | 77 | 4993 | 145 | 5 | 74 | 375 |
| 13 | 52 | A11 Front end | 498 | 154 | 10 | A | A | 77 | 4807 | 128 | 20 | 75 | 353 |

In each process, the invention alloy shows the same result as in the process C1 as compared with the comparative alloys and Cr—Zr copper. In the process A11 of Tables 12 and 13 in which heat resistance was evaluated, the invention alloy has a smaller grain size, a lower recrystallization ratio, higher Vickers hardness and higher conductivity than the comparative alloys.

From the above-described processes C1, LC1, D3, LD3 and A11, the following results were obtained. A rolled sheet of the alloy No. 61 in which the amount of Co is smaller than the composition range of the invention alloy, the alloy No. 62 in which the amount of P is smaller than the composition range of the invention alloy or the alloy No. 64 in which the balance between Co and P is poor is low in strength, electrical conductivity, heat resistance, high-temperature strength and stress relaxation properties. In addition, the rolled sheet has a low performance index. It is thought that this is because a precipitation amount is small and an element Co or P is excessively subjected to solid solution or precipitates are different from the form prescribed in the invention.

In a rolled sheet of the alloys No. 63 or No. 68 in which the amount of Sn is smaller than the composition range of the invention alloy, the recrystallization of the matrix occurs more rapidly than the precipitation. Accordingly, a recrystallization ratio increases, and thus precipitated grains become larger and fine crystals are not formed. It is thought that, as a result, strength is low, a performance index is low, stress relaxation properties are poor and heat resistance is low.

In a rolled sheet of the alloy No. 67 in which the amount of Sn is larger than the composition range of the invention alloy, the recrystallization of the matrix occurs more rapidly than the precipitation. Accordingly, a recrystallization ratio increases, and thus precipitated grains become larger and fine crystals are not formed. It is thought that, as a result, conductivity is low, a performance index is low and stress relaxation properties are poor.

In a rolled sheet of the alloy No. 65 or No. 66 in which the amount of Fe and the amount of Ni are large and the relationship of $1.2\times[Ni]+2\times[Fe]>[Co]$ is satisfied, the form of precipitates is not a predetermined form of the invention. In addition, since elements not relating to the precipitation are excessively subjected to solid solution, the recrystallization of the matrix occurs more rapidly than the precipitation. Accordingly, a recrystallization ratio increases, and thus precipitated grains become larger and fine crystals are not formed. It is thought that, as a result, strength is low, a performance index is low, conductivity is slightly low and stress relaxation properties are poor.

In the process A11, the examination was also performed on a tip end portion of the rolled sheet (test Nos. 10 to 13 of Tables 12 and 13). In the cases of the alloy Nos. 21, 41, 51 and 52, the rolling end temperature of a tip end portion was 705° C. and an average cooling rate was 5° C./sec. Since a recrystallization ratio of the tip end portion is substantially the same as in the rear end portion, substantially the same characteristics as in the rear end portion are obtained and thus it can be confirmed that the rolled material has uniform characteristics from the top end to the rear end. In the process A, which is the simplest manufacturing process in which a precipitation heat treatment is performed just once, a difference in characteristics between the tip end portion and the rear end portion is small, and thus it is assumed that a difference in characteristics between the tip end portion and the rear end portion is small in the manufacturing process in which a precipitation heat treatment is performed more than once.

Tables 14 and 15 show results of a change in conditions of the process A using the invention alloy.

TABLE 14

| | | | | After hot rolling | | | After final precipitation heat treatment | | | | | | | |
|---|---|---|---|---|---|---|---|---|---|---|---|---|---|---|
| | | | | | | | Recrystallization + Fine crystals | | Recrystallization | | Fine crystals | | Precipitates | |
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 21 | A11 | 2 | 20 | 10 | 2.8 | 12 | 3 | 10 | 3.5 | 1.5 | 2 | 5.3 | 98 |
| 2 | 21 | A12 | 2 | 20 | 10 | 2.8 | 26 | 4.5 | 25 | 5 | 0.5 | 2.5 | 7.7 | 94 |
| 3 | 21 | A13H | 2 | 120 | 100 | 2.8 | 5 | 1.5 | 3 | 2 | 2 | 1.2 | 3.5 | 99 |
| 4 | 21 | A14H | 2 | 20 | 10 | 2.8 | 95 | 11 | 95 | 11 | 0 | | 12 | 86 |
| 5 | 21 | A15H | 2 | 20 | | | 0 | | 0 | | 0 | | | |
| 6 | 21 | A16 | 2 | 25 | 40 | 1.8 | 7 | 1.5 | 5 | 2 | 2 | 1.5 | 3.8 | 98 |
| 7 | 21 | A17 | 2 | 30 | 80 | 1.4 | 8 | 1.2 | 5 | 1.5 | 2.5 | 1 | 3.6 | 99 |
| 8 | 21 | A18H | 2 | 70 | 100 | 1.00 | 7 | 1.2 | 5 | 1.5 | 2.5 | 1.2 | 3.7 | 99 |
| 9 | 31 | A11 | 2 | 15 | 10 | 2.6 | 16 | 2.5 | 15 | 3.0 | 1 | 2.0 | 5.5 | 98 |
| 10 | 31 | A16 | 2 | 15 | 40 | 2.6 | 12 | 1.8 | 10 | 2.0 | 2 | 1.5 | 4.5 | 98 |
| 11 | 41 | A11 | 2 | 15 | 10 | 3.0 | 13 | 3 | 12 | 3.5 | 1 | 2 | 5.2 | 98 |
| 12 | 41 | A12 | 2 | 15 | 10 | 3.0 | 28 | 4.5 | 27 | 5 | 0.5 | 2.5 | 7.8 | 96 |
| 13 | 41 | A13H | 2 | 120 | 100 | 3.0 | 7 | 1.6 | 5 | 2 | 1.5 | 1.5 | 3.6 | 99 |
| 14 | 41 | A14H | 2 | 20 | 10 | 3.0 | 95 | 12 | 95 | 12 | 0 | | 13 | 86 |
| 15 | 41 | A15H | 2 | 20 | | | 0 | | 0 | | 0 | | | |
| 16 | 41 | A16 | 2 | 15 | 40 | 1.9 | 8 | 1.5 | 6 | 2 | 1.5 | 1.5 | 4 | 98 |
| 17 | 41 | A17 | 2 | 25 | 90 | 1.5 | 8 | 1.2 | 5 | 1.5 | 3 | 1 | 3.7 | 99 |
| 18 | 41 | A18H | 2 | 70 | 100 | 1.01 | 8 | 1.2 | 5 | 1.5 | 2.5 | 1.2 | 3.6 | 99 |
| 19 | 54 | A11 | 2 | 20 | 10 | | 21 | 3.5 | 20 | 4 | 0.5 | 1.5 | 6.2 | 97 |
| 20 | 54 | A16 | 2 | 15 | 40 | | 13 | 1.8 | 12 | 2.5 | 1.0 | 1.0 | 5.3 | 98 |
| 21 | 54 | A17 | 2 | 20 | 95 | | 10 | 1.5 | 8 | 2.0 | 2.0 | 1.0 | 4.6 | 99 |

TABLE 15

| | | | | | | | | | | Heat resistance of heating at 700° C. for 30 seconds | | | 350° C. high- |
|---|---|---|---|---|---|---|---|---|---|---|---|---|---|
| Test No. | Alloy No. | Process | Tensile strength N/mm$^2$ | Hardness HV | Elongation % | Bendability | Stress relaxation % | Conductivity % IACS | Performance index Is | Vickers hardness HV | Recrystallization ratio % | Conductivity % IACS | temperature tensile strength N/mm$^2$ |
| 1 | 21 | A11 | 512 | 158 | 10 | A | A | 78 | 4974 | 135 | 15 | 74 | 367 |
| 2 | 21 | A12 | 477 | 154 | 9 | A | B | 82 | 4708 | 134 | 15 | 74 | 360 |
| 3 | 21 | A13H | 511 | 160 | 6 | C | A | 77 | 4753 | 137 | 10 | 73 | 370 |
| 4 | 21 | A14H | 441 | 136 | 9 | A | C | 82 | 4353 | 92 | 80 | 74 | 283 |
| 5 | 21 | A15H | 506 | 158 | 5 | C | A | 65 | 4283 | | | | |
| 6 | 21 | A16 | 522 | 162 | 8 | A | A | 77 | 4947 | 138 | 10 | 74 | 370 |
| 7 | 21 | A17 | 549 | 168 | 8 | A | A | 76 | 5075 | 137 | 5 | 73 | 375 |
| 8 | 21 | A18H | 530 | 164 | 6 | C | A | 75 | 4865 | | | | |
| 9 | 31 | A11 | 555 | 172 | 9 | A | A | 61 | 4725 | | | | |
| 10 | 31 | A16 | 569 | 179 | 9 | A | A | 61 | 4844 | | | | |
| 11 | 41 | A11 | 507 | 162 | 10 | A | A | 78 | 4925 | 139 | 10 | 74 | 369 |
| 12 | 41 | A12 | 485 | 156 | 12 | A | B | 82 | 4919 | 137 | 10 | 74 | 362 |
| 13 | 41 | A13H | 507 | 162 | 8 | C | A | 78 | 4836 | | | | |
| 14 | 41 | A14H | 442 | 135 | 9 | A | C | 84 | 4416 | 96 | 75 | 75 | 285 |
| 15 | 41 | A15H | 511 | 160 | 5 | C | A | 64 | 4292 | | | | |
| 16 | 41 | A16 | 506 | 158 | 12 | | | 78 | 5005 | 138 | 10 | 74 | 375 |
| 17 | 41 | A17 | 537 | 166 | 10 | A | A | 78 | 5032 | | | | |
| 18 | 41 | A18H | 512 | 160 | 7 | C | A | 76 | 4776 | | | | |
| 19 | 54 | A11 | 540 | 166 | 10 | A | B | 67 | 4862 | | | | |
| 20 | 54 | A16 | 564 | 173 | 9 | A | A | 66 | 4994 | | | | |
| 21 | 54 | A17 | 596 | 180 | 8 | A | A | 65 | 5190 | | | | |

The rolled sheets of the processes A11, A12, A16 and A17 satisfying the manufacturing conditions of the invention show good results. The rolled sheet of the process A13H in which a solution heat treatment is performed at 900° C. for 30 minutes after hot rolling has poor bendability and elongation. It is thought that this is because the crystal grains become coarse due to the solution heat treatment. In addition, the rolled sheet of the process A14H in which the temperature of a precipitation heat treatment is high has good electrical conductivity, but the strength, performance index and stress relaxation properties thereof are low. It is thought that this is because the recrystallization of the matrix proceeds and a recrystallization ratio increases, and thus precipitated grains become larger and the precipitation is substantially completed without the formation of fine crystals. The rolled sheet of the process A15H in which the temperature of a precipitation process is low has low bendability, elongation and conductivity. It is thought that this is a result of the fact that due to a small value of the heat treatment index It1, recrystallized grains and fine crystals are not formed and thus ductility of the matrix is not recovered. In addition, it is thought that since the elements are subjected to solid solution without being precipitated, conductivity is low. The rolled sheet of the process A18H has good electrical conductivity and high strength, but also has low elongation and poor bendability. It is thought that this is a result of the fact that due to a high hot rolling temperature, the grain size of the hot-rolled material becomes larger and affects the characteristics.

Tables 16 and 17 show results of the manufacturing of 0.4 mm-thick rolled sheets in the process A1 using the invention alloy.

TABLE 16

| | | | | | | | After final precipitation heat treatment | | | | | | | |
|---|---|---|---|---|---|---|---|---|---|---|---|---|---|---|
| | | | | After hot rolling | | | Recrystallization + Fine crystals | | Recrystallization | | Fine crystals | | Precipitates | |
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 21 | A1 | 0.4 | 20 | | | 14 | 2 | 10 | 3 | 4 | 1.5 | 5.1 | 95 |
| 2 | 41 | A1 | 0.4 | 20 | | | 11 | 1.6 | 8 | 2.5 | 3 | 1.5 | 4.8 | 95 |

TABLE 17

| | | | | | | | | | | Heat resistance of heating at 700° C. for 30 seconds | | | 350° C. high- |
|---|---|---|---|---|---|---|---|---|---|---|---|---|---|
| Test No. | Alloy No. | Process | Tensile strength N/mm$^2$ | Hardness HV | Elongation % | Bendability | Stress relaxation % | Conductivity % IACS | Performance index Is | Vickers hardness HV | Recrystallization ratio % | Conductivity % IACS | temperature tensile strength N/mm$^2$ |
| 1 | 21 | A1 | 500 | 156 | 7 | A | A | 75 | 4633 | | | | |
| 2 | 41 | A1 | 504 | 156 | 7 | A | A | 76 | 4701 | | | | |

In the above-described process A11 and the like, 2.0 mm-thick rolled sheets were manufactured. However, as in test Nos. 1 and 2 of Table 16 and 17, even when the sheet thickness is 0.4 mm, good results are obtained in the process A1 satisfying the manufacturing conditions of the invention.

Tables 18 and 19 show results of a change in a hot rolling start temperature in the process C using the invention alloy.

TABLE 18

| | | | | | | | After final precipitation heat treatment | | | | | | | |
|---|---|---|---|---|---|---|---|---|---|---|---|---|---|---|
| | | | | After hot rolling | | | Recrystallization + Fine crystals | | Recrystallization | | Fine crystals | | Precipitates | |
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 21 | C1 | 0.4 | 20 | 10 | 2.8 | 11 | 1 | 6 | 1.5 | 5 | 0.9 | 4.3 | 98 |
| 2 | 21 | C4 | 0.4 | 16 | 5 | 3.8 | 24 | 3.5 | 20 | 4.5 | 4 | 2 | 7.1 | 94 |
| 3 | 21 | C5 | 0.4 | 23 | 15 | 2.6 | 9 | 1 | 6 | 1.2 | 3 | 0.9 | 4.3 | 99 |
| 4 | 21 | C7H | 0.4 | 20 | 0 | 4.7 | 75 | 12 | 75 | 12 | 0 | | 13 | 87 |
| 5 | 21 | C8H | 0.4 | 55 | 30 | 2.0 | 11 | 1.2 | 7 | 1.5 | 4 | 1 | 5.1 | 96 |
| 6 | 31 | C1 | 0.4 | 15 | 10 | 2.6 | 17 | 1.2 | 15 | 2 | 2 | 1 | 5.6 | 97 |
| 7 | 31 | C5 | 0.4 | 20 | 10 | 2.5 | 10 | 1 | 5 | 2 | 5 | 0.9 | 4.5 | 99 |
| 8 | 41 | C1 | 0.4 | 20 | 10 | 3.0 | 12 | 1.1 | 9 | 1.5 | 3 | 1 | 4.3 | 99 |
| 9 | 41 | C4 | 0.4 | 18 | 5 | 3.6 | 22 | 2.5 | 18 | 3.5 | 4 | 2 | 7 | 95 |
| 10 | 41 | C5 | 0.4 | 25 | 20 | 2.7 | 9 | 1.2 | 5 | 1.5 | 4 | 1 | 4.1 | 99 |
| 11 | 41 | C7H | 0.4 | 20 | 0 | 4.9 | 80 | 10 | 80 | 10 | 0 | | 14 | 86 |
| 12 | 41 | C8H | 0.4 | 55 | 35 | 2.2 | 11 | 1.2 | 8 | 1.5 | 3 | 1 | 4.6 | 95 |
| 13 | 54 | C1 | 0.4 | 20 | 10 | | 14 | 1.5 | 12 | 2 | 2 | 1 | 4.9 | 98 |
| 14 | 54 | C5 | 0.4 | 20 | 10 | | 12 | 1.5 | 10 | 2 | 2 | 1 | 4.5 | 99 |

TABLE 19

| Test No. | Alloy No. | Process | Tensile strength N/mm² | Hardness HV | Elongation % | Bendability | Stress relaxation % | Conductivity % IACS | Performance index Is | Heat resistance of heating at 700° C. for 30 seconds: Vickers hardness HV | Recrystallization ratio % | Conductivity % IACS | 350° C. high-temperature tensile strength N/mm² |
|---|---|---|---|---|---|---|---|---|---|---|---|---|---|
| 1 | 21 | C1 | 528 | 165 | 8 | A | A | 80 | 5100 | | | | |
| 2 | 21 | C4 | 492 | 155 | 8 | A | A | 81 | 4782 | | | | |
| 3 | 21 | C5 | 536 | 168 | 7 | A | A | 79 | 5098 | | | | |
| 4 | 21 | C7H | 462 | 145 | 6 | B | C | 82 | 4435 | | | | |
| 5 | 21 | C8H | 543 | 172 | 4 | C | A | 77 | 4955 | | | | |
| 6 | 31 | C1 | 574 | 179 | 6 | A | A | 61 | 4752 | | | | |
| 7 | 31 | C5 | 592 | 183 | 7 | A | A | 61 | 4947 | | | | |
| 8 | 41 | C1 | 535 | 167 | 7 | A | A | 81 | 5152 | | | | |
| 9 | 41 | C4 | 497 | 155 | 8 | A | A | 82 | 4861 | | | | |
| 10 | 41 | C5 | 540 | 169 | 7 | A | A | 79 | 5136 | | | | |
| 11 | 41 | C7H | 456 | 144 | 6 | B | C | 81 | 4350 | | | | |
| 12 | 41 | C8H | 545 | 172 | 4 | C | A | 77 | 4974 | | | | |
| 13 | 54 | C1 | 550 | 168 | 8 | A | A | 68 | 4898 | | | | |
| 14 | 54 | C5 | 573 | 176 | 7 | A | A | 66 | 4981 | | | | |

The rolled sheet of the process C7H in which a hot rolling start temperature is low has low strength, performance index and stress relaxation properties. Regarding this, since the hot rolling start temperature is low, Co, P and the like are not sufficiently subjected to solid solution, the capacity to precipitate becomes smaller (the amount of Co, P and the like forming precipitates is small) and the recrystallization of the matrix occurs more rapidly than the precipitation. It is thought that for this reason, a recrystallization ratio increases, and thus precipitated grains become larger and fine crystals are not formed, and the reason for the low strength, performance index and stress relaxation properties is as described above. In addition, it is thought that the crystal grains of the hot-rolled material extending in a rolling direction (the value of L1/L2 is large) also have an effect, so it is thought that the shape of the crystal grains in the hot rolling has an effect producing slightly poor bendability and elongation. The rolled sheet of the process C8H in which a hot rolling start temperature is high has low elongation and poor bendability. It is thought that this is because due to the high hot rolling temperature, crystal grains become larger in the hot rolling stage.

Tables 20 and 21 show results of a change in a cooling rate after hot rolling in the process C using the invention alloy.

TABLE 20

| Test No. | Alloy No. | Process | Final sheet thickness mm | After hot rolling: grain size μm | After hot rolling: Recrystallization ratio % | After hot rolling: L1/L2 | After final precipitation heat treatment: Recrystallization + Fine crystals: Area ratio of crystals % | Recrystallization + Fine crystals: Average grain size μm | Recrystallization: Recrystallization ratio % | Recrystallization: Average grain size μm | Fine crystals: Fine crystal ratio % | Fine crystals: Average grain size μm | Precipitates: Average grain diameter nm | Precipitates: Proportion of grains of 25 mm or less % |
|---|---|---|---|---|---|---|---|---|---|---|---|---|---|---|
| 1 | 21 | C1 | 0.4 | 20 | 10 | 2.8 | 11 | 1 | 6 | 1.5 | 5 | 0.9 | 4.3 | 98 |
| 2 | 21 | C6 | 0.4 | 25 | 50 | 1.9 | 6 | 0.9 | 3 | 1.5 | 3 | 0.7 | 3.7 | 99 |
| 3 | 21 | C61 | 0.4 | 30 | 90 | 1.4 | 8 | 0.6 | 1 | 1 | 7 | 0.6 | 3.5 | 100 |
| 4 | 21 | C10H | 0.4 | 20 | 10 | 2.7 | 90 | 12 | 90 | 12 | 0 | | 14 | 85 |
| 5 | 31 | C1 | 0.4 | 15 | 10 | 2.6 | 17 | 1.2 | 15 | 2 | 2 | 1 | 5.6 | 97 |
| 6 | 31 | C6 | 0.4 | 18 | 40 | 2.1 | 9 | 0.8 | 3 | 1 | 6 | 0.8 | 4.2 | 99 |
| 7 | 41 | C1 | 0.4 | 20 | 10 | 3.0 | 12 | 1.1 | 9 | 1.5 | 3 | 1 | 4.3 | 99 |
| 8 | 41 | C6 | 0.4 | 20 | 40 | 2.0 | 10 | 0.8 | 2 | 1 | 8 | 0.8 | 3.6 | 99 |
| 9 | 41 | C61 | 0.4 | 25 | 90 | 1.5 | 9 | 0.7 | 1 | 1 | 8 | 0.7 | 3.3 | 100 |
| 10 | 41 | C10H | 0.4 | 20 | 10 | 2.8 | 95 | 10 | 95 | 10 | 0 | | 14 | 84 |
| 11 | 54 | C1 | 0.4 | 20 | 10 | 2.6 | 14 | 1.5 | 12 | 2 | 2 | 1 | 4.9 | 98 |
| 12 | 54 | C6 | 0.4 | 18 | 40 | 2.1 | 11 | 1 | 8 | 1.5 | 3 | 0.9 | 4.2 | 98 |
| 13 | 54 | C61 | 0.4 | 25 | 90 | 1.4 | 9 | 1 | 5 | 1.2 | 4 | 0.8 | 3.8 | 99 |
| 14 | 11 | LC1 | 0.36 | 20 | 20 | 2.5 | 26 | 2.5 | 25 | 3.5 | 0.5 | 1.2 | 5.8 | 97 |
| 15 | 11 | LC6 | 0.36 | 30 | 40 | 1.9 | 21 | 2 | 20 | 2.5 | 1 | 1 | 5.4 | 98 |
| 16 | 21 | LC1 | 0.36 | 25 | 15 | 2.8 | 13 | 1.2 | 10 | 2 | 3 | 1 | 4.8 | 98 |
| 17 | 21 | LC6 | 0.36 | 30 | 30 | 2.2 | 7 | 1 | 2 | 1.5 | 5 | 1 | 3.9 | 99 |
| 18 | 41 | LC1 | 0.36 | 25 | 15 | 3.1 | 14 | 1.2 | 12 | 2 | 2 | 1 | 4.8 | 98 |
| 19 | 41 | LC6 | 0.36 | 30 | 45 | 1.8 | 7 | 1 | 3 | 1.5 | 4 | 1 | 4 | 99 |
| 20 | 55 | LC1 | 0.36 | 20 | 15 | 3.0 | 17 | 2 | 15 | 2.5 | 1.5 | 1 | 5.3 | 98 |
| 21 | 55 | LC6 | 0.36 | 25 | 30 | 2.1 | 13 | 1 | 10 | 1.5 | 2.5 | 0.9 | 4.8 | 98 |
| 22 | 56 | LC1 | 0.36 | 25 | | | 14 | 2 | 12 | 2.5 | 1.5 | 1.2 | 5 | 98 |
| 23 | 56 | LC6 | 0.36 | 30 | | | 10 | 1 | 6 | 1.5 | 3.5 | 0.8 | 4.2 | 98 |

TABLE 21

| Test No. | Alloy No. | Process | Tensile Strength N/mm$^2$ | Hardness HV | Elongation % | Bendability | Stress relaxation % | Conductivity % IACS | Performance index Is | Heat resistance of heating at 700° C. for 30 seconds: Vickers hardness HV | Recrystallization ratio % | Conductivity % IACS | 350° C. high-temperature tensile strength N/mm$^2$ |
|---|---|---|---|---|---|---|---|---|---|---|---|---|---|
| 1 | 21 | C1 | 528 | 165 | 8 | A | A | 80 | 5100 | | | | |
| 2 | 21 | C6 | 545 | 172 | 7 | A | A | 78 | 5150 | | | | |
| 3 | 21 | C61 | 575 | 176 | 7 | A | A | 76 | 5364 | | | | |
| 4 | 21 | C10H | 430 | 134 | 6 | A | C | 83 | 4153 | | | | |
| 5 | 31 | C1 | 574 | 179 | 6 | A | A | 61 | 4752 | | | | |
| 6 | 31 | C6 | 596 | 185 | 6 | A | A | 60 | 4894 | | | | |
| 7 | 41 | C1 | 535 | 167 | 7 | A | A | 81 | 5152 | | | | |
| 8 | 41 | C5 | 544 | 171 | 7 | A | A | 79 | 5174 | | | | |
| 9 | 41 | C61 | 574 | 175 | 6 | A | A | 77 | 5339 | | | | |
| 10 | 41 | C10H | 433 | 133 | 7 | A | C | 83 | 4221 | | | | |
| 11 | 54 | C1 | 550 | 168 | 8 | A | A | 68 | 4898 | | | | |
| 12 | 54 | C6 | 580 | 180 | 7 | A | A | 65 | 5003 | | | | |
| 13 | 54 | C61 | 609 | 184 | 6 | A | A | 64 | 5164 | | | | |
| 14 | 11 | LC1 | 598 | 179 | 7 | A | B | 51 | 4570 | | | | |
| 15 | 11 | LC6 | 607 | 181 | 7 | B | A | 51 | 4638 | | | | |
| 16 | 21 | LC1 | 522 | 160 | 8 | A | A | 79 | 5011 | | | | |
| 17 | 21 | LC6 | 546 | 173 | 7 | A | A | 78 | 5160 | | | | |
| 18 | 41 | LC1 | 530 | 162 | 7 | A | A | 80 | 5072 | | | | |
| 19 | 41 | LC6 | 547 | 173 | 8 | A | A | 79 | 5251 | | | | |
| 20 | 55 | LC1 | 562 | 173 | 8 | A | A | 67 | 4968 | | | | |
| 21 | 55 | LC6 | 573 | 175 | 7 | A | A | 66 | 4981 | | | | |
| 22 | 56 | LC1 | 515 | 160 | 8 | A | A | 80 | 4975 | | | | |
| 23 | 56 | LC6 | 531 | 167 | 7 | A | A | 80 | 5082 | | | | |

The rolled sheet of the process C10H in which a cooling rate is low has low strength, performance index and stress relaxation properties. Regarding this, the precipitation of P, Co and the like occurs in the course of cooling after hot rolling and thus the capacity to precipitate decreases. Accordingly, the recrystallization of the matrix occurs more rapidly than the precipitation during the precipitation heat treatment. It is thought that for this reason, a recrystallization ratio increases, and thus precipitated grains become larger and fine crystals are not formed, and the reason for the low strength, performance index and stress relaxation properties is as described above. The rolled sheets of the processes C6 and C61 in which a cooling rate is high have high strength and also have a high performance index. Regarding this, since a large amount of P, Co and the like is still subjected to solid solution in the course of cooling after hot rolling, the recrystallization of the matrix and the precipitation occur at good timing when performing the precipitation heat treatment. It is thought that for this reason, a recrystallization ratio is decreased, the formation of fine crystals is promoted, precipitates become smaller and thus high strength is obtained, and the reason for the high strength and performance index is as described above.

Tables 22 and 23 show results of a change in conditions of the precipitation heat treatment in the process C using the invention alloy.

TABLE 22

| Test No. | Alloy No. | Process | Final sheet thickness mm | After hot rolling: grain size μm | After hot rolling: Recrystallization ratio % | After hot rolling: L1/L2 | After final precipitation heat treatment: Recrystallization + Fine crystals: Area ratio of crystals % | Recrystallization + Fine crystals: Average grain size μm | Recrystallization: Recrystallization ratio % | Recrystallization: Average grain size μm | Fine crystals: Fine crystal ratio % | Fine crystals: Average grain size μm | Precipitates: Average grain diameter nm | Precipitates: Proportion of grains of 25 mm or less % |
|---|---|---|---|---|---|---|---|---|---|---|---|---|---|---|
| 1 | 21 | C1 | 0.4 | 20 | | | 11 | 1 | 6 | 1.5 | 5 | 0.9 | 4.3 | 98 |
| 2 | 21 | C9H | 0.4 | 20 | | | 60 | 10 | 60 | 10 | 0 | | 9.5 | 88 |
| 3 | 21 | C11H | 0.4 | 20 | | | 0 | | 0 | | 0 | | | |
| 4 | 21 | C13H | 0.4 | 20 | | | 95 | 10 | 95 | 10 | 0 | | 12 | 93 |
| 5 | 41 | C1 | 0.4 | 20 | | | 12 | 1.1 | 9 | 1.5 | 3 | 1 | 4.3 | 99 |
| 6 | 41 | C9H | 0.4 | 20 | | | 65 | 8 | 65 | 8 | 0 | | 9 | 88 |
| 7 | 41 | C11H | 0.4 | 20 | | | 0 | | 0 | | 0 | | | |
| 8 | 41 | C13H | 0.4 | 20 | | | 95 | 10 | 95 | 10 | 0 | | 13 | 95 |

TABLE 23

| Test No. | Alloy No. | Process | Tensile strength N/mm² | Hardness HV | Elongation % | Bendability | Stress relaxation % | Conductivity % IACS | Performance index Is | Heat resistance of heating at 700° C. for 30 seconds: Vickers hardness HV | Recrystallization ratio % | Conductivity % IACS | 350° C. high-temperature tensile strength N/mm² |
|---|---|---|---|---|---|---|---|---|---|---|---|---|---|
| 1 | 21 | C1 | 528 | 165 | 8 | A | A | 80 | 5100 | | | | |
| 2 | 21 | C9H | 458 | 140 | 7 | A | C | 82 | 4438 | | | | |
| 3 | 21 | C11H | 490 | 155 | 2 | C | C | 71 | 4211 | | | | |
| 4 | 21 | C13H | 440 | 136 | 7 | A | C | 84 | 4315 | | | | |
| 5 | 41 | C1 | 535 | 167 | 7 | A | A | 81 | 5152 | | | | |
| 6 | 41 | C9H | 453 | 138 | 7 | A | C | 81 | 4362 | | | | |
| 7 | 41 | C11H | 493 | 155 | 4 | C | C | 70 | 4290 | | | | |
| 8 | 41 | C13H | 442 | 138 | 7 | A | C | 84 | 4335 | | | | |

The rolled sheets of the processes C9H and C13H in which a heat treatment index is larger than a proper range has low strength, performance index and stress relaxation properties. It is thought that this is because the recrystallization of the matrix proceeds during the precipitation heat treatment and thus a recrystallization ratio increases, so precipitated grains become larger and fine crystals are not formed. In addition, it is thought that when the heat treatment index of a first precipitation heat treatment is large in a process in which the precipitation heat treatment is performed twice as in the process C9H, precipitates are grown and become larger, and in addition, the precipitates do not become finer by a second precipitation heat treatment, and thus strength and stress relaxation properties are low. The rolled sheet of the process C11H in which a heat treatment index is smaller than a proper range has poor elongation and bendability, a low performance index and low stress relaxation properties. It is thought that the reason is that since recrystallized grains and fine crystals are not formed during a precipitation heat treatment, ductility of the matrix is not recovered and insufficient precipitation occurs.

Tables 24 and 25 show results of the case in which a recovery process is performed and the case in which the recovery process is not performed in the process C using the invention alloy.

TABLE 24

| Test No. | Alloy No. | Process | Final sheet thickness mm | After hot rolling: grain size μm | After hot rolling: Recrystallization ratio % | After hot rolling: L1/L2 | After final precipitation heat treatment: Recrystallization + Fine crystals: Area ratio of crystals % | Recrystallization + Fine crystals: Average grain size μm | Recrystallization: Recrystallization ratio % | Recrystallization: Average grain size μm | Fine crystals: Fine crystal ratio % | Fine crystals: Average grain size μm | Precipitates: Average grain diameter nm | Precipitates: Proportion of grains of 25 mm or less % |
|---|---|---|---|---|---|---|---|---|---|---|---|---|---|---|
| 1 | 21 | C1 | 0.4 | 20 | | | 11 | 1 | 6 | 1.5 | 5 | 0.9 | 4.3 | 98 |
| 2 | 21 | C2 | 0.4 | 20 | | | 11 | 1 | 6 | 1.5 | 5 | 0.9 | 4.3 | 98 |
| 3 | 21 | C12H | 0.4 | 20 | | | 11 | 1 | 6 | 1.5 | 5 | 0.9 | 4.3 | 98 |
| 4 | 41 | C1 | 0.4 | 20 | | | 12 | 1.1 | 9 | 1.5 | 3 | 1 | 4.3 | 99 |
| 5 | 41 | C2 | 0.4 | 20 | | | 12 | 1.1 | 9 | 1.5 | 3 | 1 | 4.3 | 99 |
| 6 | 41 | C12H | 0.4 | 20 | | | 12 | 1.1 | 9 | 1.5 | 3 | 1 | 4.3 | 99 |

TABLE 25

| Test No. | Alloy No. | Process | Tensile strength N/mm² | Hardness HV | Elongation % | Bendability | Stress relaxation % | Conductivity % IACS | Performance index Is | Heat resistance of heating at 700° C. for 30 seconds: Vickers hardness HV | Recrystallization ratio % | Conductivity % IACS | 350° C. high-temperature tensile strength N/mm² |
|---|---|---|---|---|---|---|---|---|---|---|---|---|---|
| 1 | 21 | C1 | 528 | 165 | 8 | A | A | 80 | 5100 | | | | |
| 2 | 21 | C2 | 530 | 167 | 9 | A | A | 81 | 5199 | | | | |
| 3 | 21 | C12H | 540 | 171 | 4 | B | C | 75 | 4864 | | | | |
| 4 | 41 | C1 | 535 | 167 | 7 | A | A | 81 | 5152 | | | | |
| 5 | 41 | C2 | 537 | 169 | 8 | A | A | 81 | 5220 | | | | |
| 6 | 41 | C12H | 542 | 172 | 4 | B | C | 74 | 4849 | | | | |

The rolled sheet of the process C12H in which a recovery heat treatment is not performed has high strength, but is poor in bendability and stress relaxation properties, and is low in conductivity. It is thought that this is because the recovery heat treatment is not performed, and thus strain remains in the matrix.

Tables 26 and 27 show results of a change in conditions of the process D using the invention alloy.

TABLE 26

| | | | | After hot rolling | | | After final precipitation heat treatment | | | | | | Precipitates | |
|---|---|---|---|---|---|---|---|---|---|---|---|---|---|---|
| | | | | | | | Recrystallization + Fine crystals | | Recrystallization | | Fine crystals | | | |
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 21 | D1 | 0.4 | 20 | | | 18 | 2 | 15 | 3.5 | 3 | 1.5 | 6.5 | 97 |
| 2 | 21 | D2 | 0.4 | 20 | | | 13 | 1.5 | 10 | 2.5 | 3 | 1 | 5.1 | 98 |
| 3 | 21 | D3 | 0.4 | 20 | | | 12 | 1.2 | 8 | 1.5 | 4 | 1 | 4.2 | 98 |
| 4 | 21 | D4 | 0.4 | 20 | | | 9 | 1 | 1 | 1.5 | 8 | 0.9 | 3.8 | 98 |
| 5 | 21 | D5 | 0.4 | 20 | | | 18 | 1.8 | 16 | 3.5 | 2 | 1.5 | 4.9 | 98 |
| 6 | 21 | D6H | 0.4 | 20 | | | 0 | | 0 | | 0 | | | |
| 7 | 31 | D1 | 0.4 | 15 | 10 | | 22 | 2 | 20 | 3.5 | 2 | 1.5 | 7.1 | 96 |
| 8 | 31 | D3 | 0.4 | 15 | 10 | | 15 | 1.2 | 10 | 2 | 5 | 1 | 4.8 | 98 |
| 9 | 31 | D4 | 0.4 | 18 | | | 10 | 1 | 4 | 1.5 | 6 | 0.9 | 4 | 99 |
| 10 | 41 | D1 | 0.4 | 20 | | | 17 | 2 | 15 | 3.5 | 2 | 1.2 | 6.1 | 97 |
| 11 | 41 | D2 | 0.4 | 20 | | | 13 | 1.2 | 10 | 2.5 | 3 | 1 | 4.8 | 98 |
| 12 | 41 | D3 | 0.4 | 20 | | | 13 | 1.2 | 9 | 2.5 | 4 | 1 | 4.4 | 96 |
| 13 | 41 | D4 | 0.4 | 20 | | | 10 | 1 | 2.5 | 2 | 7 | 0.9 | 3.8 | 98 |
| 14 | 41 | D5 | 0.4 | 20 | | | 18 | 2.5 | 16 | 3.5 | 2 | 1.8 | 4.9 | 97 |
| 15 | 41 | D6H | 0.4 | 20 | | | | | 0 | | | | | |

TABLE 27

| | | | | | | | | | | Heat resistance of heating at 700° C. for 30 seconds | | | 350° C. high- |
|---|---|---|---|---|---|---|---|---|---|---|---|---|---|
| Test No. | Alloy No. | Process | Tensile strength N/mm$^2$ | Hardness HV | Elongation % | Bendability | Stress relaxation % | Conductivity % IACS | Performance index Is | Vickers hardness HV | Recrystallization ratio % | Conductivity % IACS | temperature tensile strength N/mm$^2$ |
| 1 | 21 | D1 | 525 | 164 | 7 | A | A | 75 | 4865 | | | | |
| 2 | 21 | D2 | 530 | 165 | 7 | A | A | 80 | 5072 | | | | |
| 3 | 21 | D3 | 527 | 164 | 7 | A | A | 80 | 5044 | | | | |
| 4 | 21 | D4 | 541 | 171 | 7 | A | A | 80 | 5178 | | | | |
| 5 | 21 | D5 | 523 | 162 | 6 | A | A | 80 | 4959 | | | | |
| 6 | 21 | D6H | 493 | 157 | 4 | C | C | 69 | 4259 | | | | |
| 7 | 31 | D1 | 573 | 179 | 7 | A | A | 60 | 4749 | | | | |
| 8 | 31 | D3 | 568 | 175 | 9 | A | A | 62 | 4875 | | | | |
| 9 | 31 | D4 | 593 | 184 | 7 | A | A | 60 | 4915 | | | | |
| 10 | 41 | D1 | 532 | 168 | 7 | A | A | 76 | 4963 | | | | |
| 11 | 41 | D2 | 534 | 166 | 7 | A | A | 80 | 5111 | | | | |
| 12 | 41 | D3 | 518 | 160 | 8 | A | A | 80 | 5004 | | | | |
| 13 | 41 | D4 | 541 | 172 | 7 | A | A | 79 | 5145 | | | | |
| 14 | 41 | D5 | 519 | 163 | 6 | A | A | 79 | 4890 | | | | |
| 15 | 41 | D6H | 492 | 158 | 4 | C | C | 68 | 4219 | | | | |

In the process D1, two precipitation heat treatments are both performed as a short-time precipitation heat treatment. In the process D4, a cooling rate after hot rolling is set to be high. In the process D6H, the heat treatment index of a second precipitation heat treatment is low. All of the rolled sheets of the processes D1 to D5 show good results, but the rolled sheet of the process D6H has poor elongation and bendability, a low performance index and low stress relaxation properties. It is thought that the reason is that since recrystallized grains and fine crystals are not formed during a precipitation heat treatment, ductility of the matrix is not recovered and insufficient precipitation occurs.

Tables 28 and 29 show results of the process B using the invention alloy in addition to the results of the process A11.

TABLE 28

| | | | | After hot rolling | | | After final precipitation heat treatment: Recrystallization + Fine crystals | | After final precipitation heat treatment: Recrystallization | | After final precipitation heat treatment: Fine crystals | | Precipitates | |
|---|---|---|---|---|---|---|---|---|---|---|---|---|---|---|
| Test No. | Alloy No. | Process | Final sheet thickness mm | grain size μm | Recrystallization ratio % | L1/L2 | Area ratio of crystals % | Average grain size μm | Recrystallization ratio % | Average grain size μm | Fine crystal ratio % | Average grain size μm | Average grain diameter nm | Proportion of grains of 25 mm or less % |
| 1 | 21 | A11 | 2 | 20 | 10 | 2.8 | 12 | 3 | 10 | 3.5 | 1.5 | 2 | 5.3 | 98 |
| 2 | 21 | B11 | 2 | 20 | | | 16 | 4 | 15 | 4.5 | 1 | 2.5 | 5.7 | 97 |
| 3 | 21 | B1 | 0.4 | 20 | | | 15 | 1.5 | 10 | 2.5 | 5 | 1.2 | 5.5 | 96 |
| 4 | 31 | A11 | 2 | 15 | 10 | 2.6 | 16 | 2.5 | 15 | 3.0 | 1 | 2.0 | 5.5 | 98 |
| 5 | 31 | B11 | 2 | 15 | 10 | | 26 | 4 | 25 | 1.5 | 1.0 | 2 | 6.3 | 96 |
| 6 | 41 | A11 | 2 | 15 | 10 | 3 | 13 | 3 | 12 | 3.5 | 1 | 2 | 5.2 | 98 |
| 7 | 41 | B11 | 2 | 20 | | | 16 | 3.5 | 15 | 3.5 | 1 | 2 | 5.8 | 98 |
| 8 | 41 | B1 | 0.4 | 20 | | | 16 | 1.5 | 12 | 2.5 | 4 | 1.2 | 5.6 | 96 |

TABLE 29

| | | | | | | | | | | Heat resistance of heating at 700° C. for 30 seconds | | | 350° C. high- |
|---|---|---|---|---|---|---|---|---|---|---|---|---|---|
| Test No. | Alloy No. | Process | Tensile strength N/mm$^2$ | Hardness HV | Elongation % | Bendability | Stress relaxation % | Conductivity % IACS | Performance index Is | Vickers hardness HV | Recrystallization ratio % | Conductivity % IACS | temperature tensile strength N/mm$^2$ |
| 1 | 21 | A11 | 512 | 158 | 10 | A | A | 78 | 4974 | 135 | 15 | 74 | 367 |
| 2 | 21 | B11 | 506 | 157 | 11 | A | A | 82 | 5086 | | | | |
| 3 | 21 | B1 | 513 | 159 | 7 | A | A | 77 | 4817 | | | | |
| 4 | 31 | A11 | 555 | 172 | 9 | A | A | 61 | 4725 | | | | |
| 5 | 31 | B11 | 551 | 173 | 10 | A | B | 64 | 4849 | | | | |
| 6 | 41 | A11 | 507 | 162 | 10 | A | A | 79 | 4957 | 139 | 10 | 74 | 369 |
| 7 | 41 | B11 | 517 | 158 | 10 | A | A | 81 | 5118 | | | | |
| 8 | 41 | B1 | 516 | 159 | 7 | A | A | 77 | 4845 | | | | |

In the processes A11 and B11, a final sheet thickness is 2 mm, and in the process B1, a final sheet thickness is 0.4 mm. The processes B11 and B1 satisfy the manufacturing conditions of the invention and all the rolled sheets of the processes show good results. In B11 of a sheet thickness of 2 mm, the precipitation heat treatment is performed twice, and thus conductivity is higher than in A11.

In the above-described embodiments, a high-performance copper alloy rolled sheet was obtained in which a total cold rolling ratio is 70% or greater, and after a final precipitation heat treatment process, a recrystallization ratio is 45% or less, an average grain size of recrystallized grains is in the range of 0.7 to 7 μm, substantially circular or substantially elliptical precipitates are present in a metal structure, the precipitates have an average grain diameter of 2.0 to 11 nm and are uniformly dispersed, an average grain size of fine crystals is in the range of 0.3 to 4 μm and a fine crystal ratio is in the range of 0.1% to 25% (see test Nos. 1 to 7 of Tables 4 and 5, test Nos. 1 to 14 of Tables 6 and 7, test Nos. 1 to 7 of Tables 8 and 9, test Nos. 1 to 4 of Tables 10 and 11, test Nos. 1 to 7 of Tables 12 and 13, test Nos. 2, 3, 5, 7 and 8 of Tables 28 and 29).

A high-performance copper alloy rolled sheet having conductivity of 45 (% IACS) or greater and a performance index of 4300 or greater was obtained (see test Nos. 1 to 7 of Tables 4 and 5, test Nos. 1 to 14 of Tables 6 and 7, test Nos. 1 to 7 of Tables 8 and 9, test Nos. 1 to 4 of Tables 10 and 11, test Nos. 1 to 7 of Tables 12 and 13, test Nos. 2, 3, 5, 7 and 8 of Tables 28 and 29).

A high-performance copper alloy rolled sheet having tensile strength of 300 (N/mm$^2$) or greater at 350° C. was obtained (see test Nos. 1 and 3 to 6 of Tables 12 and 13, test Nos. 1 and 11 of Tables 14 and 15).

A high-performance copper alloy rolled sheet of which Vickers hardness (HV) after heating at 700° C. for 30 seconds is equal to or greater than 100, or 80% or greater of a value of Vickers hardness before the heating, or of which a recrystallization ratio in a metal structure after heating is 40% or less was obtained (see test Nos. 1 and 3 to 6 of Tables 12 and 13, test Nos. 1 and 11 of Tables 14 and 15).

The above-described contents will be summarized as follows.

The higher the cooling rate in hot rolling is, and the higher the end temperature is, the better the timing at which the recrystallization of the matrix and the precipitation occur. Accordingly, a recrystallization ratio is decreased and precipitates become smaller, so high strength is obtained.

When a cooling rate in hot rolling is low, precipitation occurs in the course of cooling of the hot rolling and the capacity to precipitate decreases. Accordingly, the recrystallization of the matrix occurs more rapidly than the precipitation. Accordingly, a recrystallization ratio increases and precipitated grains become larger. Asa result, strength is low, a performance index is low and stress relaxation properties are poor. Heat resistance is also low.

When a hot rolling start temperature is low, Co, P and the like are not sufficiently subjected to solid solution and the capacity to precipitate decreases. Accordingly, the recrystallization of the matrix occurs more rapidly than the precipitation. Accordingly, a recrystallization ratio increases and precipitated grains become larger. Asa result, strength is low, a performance index is low and stress relaxation properties are poor. Heat resistance is also low.

When a hot rolling temperature is high, crystal grains become larger and the bendability of a final sheet becomes poor.

When the upper limit of a proper precipitation heat treatment temperature condition is exceeded, the recrystallization of the matrix proceeds. Accordingly, a recrystallization ratio increases, and thus the precipitation is substantially completed. Accordingly, electrical conductivity is good, but precipitated grains become larger. As a result, strength is low, a performance index is low and stress relaxation properties are poor. Heat resistance is also low.

When the lower limit of a proper precipitation heat treatment temperature condition is exceeded, recrystallized grains are not formed, and thus ductility of the matrix is not recovered and elongation and bendability are poor. In addition, since insufficient precipitation occurs, stress relaxation properties are poor. When a precipitation heat treatment is performed even for a short time, high electrical conductivity, high strength and good ductility are obtained.

The invention is not limited to the configurations of the above-described various embodiments and various modifications may be made without departing from the spirit of the invention. For example, machining or a heat treatment not affecting a metal structure may be performed in an arbitrary stage of the process.

INDUSTRIAL APPLICABILITY

As described above, a high-performance copper alloy rolled sheet according to the invention can be used for the following purposes.

Medium thick sheet: Members mainly requiring high electrical conductivity, high heat conductivity, high strength at room temperature and high high-temperature strength; heat sinks (cooling for hybrid cars, electrical vehicles and computers), heat spreaders, power relays, bus bars, and material used with high-currents typified by hybrid, photovoltaic generation and light-emitting diodes.

Thin sheet: Members requiring highly balanced strength and electrical conductivity; various components for vehicles, information instrument components, measurement instrument components, household electrical appliances, heat exchangers, connectors, terminals, connecting terminals, switches, relays, fuses, IC sockets, wiring instruments, lighting equipment, connection metal fittings, power transistors, battery terminals, contact volume, breaker and switch contacts.

The invention claimed is:

1. A high-strength and high-electrical conductivity copper alloy rolled sheet which has an alloy composition comprising 0.14 to 0.34 mass % of Co, 0.046 to 0.098 mass % of P, 0.005 to 1.4 mass % of Sn and the balance including Cu and inevitable impurities and is manufactured by a manufacturing process including a casting process, a cutting process, a heating process, a hot rolling process, a cold rolling process and a precipitation heat treatment process in this order, wherein a start temperature of the hot rolling process is in the range of 830 to 960° C. to heat and provide a hot-rolled ingot, wherein the hot-rolled ingot is subjected to a cooling step to obtain a solid solution of Co and P and a recrystallized structure having an average grain size of equal to or larger than 6 μm and equal to or smaller than 50 μm, and wherein the cooling step is selected from the group consisting of: (i) wherein the hot-rolled ingot is cooled with a cooling rate of 2° C./sec or greater from a temperature of the hot-rolled ingot subjected to a final pass of the hot rolling process to 350° C., and (ii) wherein the hot-rolled ingot is cooled with a cooling rate of 2° C./sec or greater from 650° C. to 350° C., wherein [Co] mass % representing a Co content and [P] mass % representing a P content satisfy the relationship of $3.0 \leq ([Co]-0.007)/([P]-0.009) \leq 5.9$, a total cold rolling ratio is equal to or greater than 70%, after a final precipitation heat treatment process, a recrystallization ratio is equal to or less than 45%, an average grain size of recrystallized grains in a recrystallization portion is in the range of 0.7 to 7 μm and circular or elliptical precipitates are present in a metal structure, the precipitates are fine precipitates of which 90% or greater are equal to or less than 25 nm in diameter, and the precipitates are uniformly dispersed, wherein after the final precipitation heat treatment, the metal structure includes a fibrous metal structure extending in a rolling direction of the metal structure, and in the fibrous metal structure fine crystals are present which have no annealing twin crystals and in which an average long/short ratio, which is observed from an inverse pole figure (IPF) map and a grain boundary map in an EBSP analysis result, is equal to or greater than 2 and equal to or less than 15, and an average grain size of the fine crystals is in the range of 0.3 to 4 μm and a proportion of the area of the fine crystals to the whole metal structure in an observation plane is in the range of 0.1% to 25%.

2. The high-strength and high-electrical conductivity copper alloy rolled sheet according to claim 1, wherein 0.16 to 0.33 mass % of Co, 0.051 to 0.096 mass % of P and 0.005 to 0.045 mass % of Sn are contained and [Co] mass % representing a Co content and [P] mass % representing a P content satisfy the relationship of $3.2 \leq ([Co]-0.007)/([P]-0.009) \leq 4.9$.

3. The high-strength and high-electrical conductivity copper alloy rolled sheet according to claim 1, wherein 0.16 to 0.33 mass % of Co, 0.051 to 0.096 mass % of P and 0.32 to 0.8 mass % of Sn are contained and [Co] mass % representing a Co content and [P] mass % representing a P content satisfy the relationship of $3.2 \leq [Co]-0.007)/([P]-0.009) \leq 4.9$.

4. The high-strength and high-electrical conductivity copper alloy rolled sheet according to claim 1, wherein at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr is further contained.

5. The high-strength and high-electrical conductivity copper alloy rolled sheet according to claim 1, wherein conductivity is equal to or greater than 45(% IACS), and a value of $(R^{1/2} \times S \times (100+L)/100)$ is equal to or greater than 4300 when conductivity is denoted by R(% IACS), tensile strength is denoted by S(N/mm$^2$) and elongation is denoted by L(%).

6. The high-strength and high-electrical conductivity copper alloy rolled sheet according to claim 1, manufactured by a manufacturing process including hot rolling, wherein the hot-rolled ingot subjected to the hot rolling process and cooling has an average grain size equal to or greater than 6 μm and equal to or less than 50 or satisfies the relationship of $5.5\times(100/RE0)\leq D\leq 70\times(60/RE0)$ where a rolling ratio of the hot rolling is denoted by RE0(%) and a grain size after the hot rolling is denoted by D μm, and when a cross-section of the crystal grain taken along a rolling direction is observed, when a length in the rolling direction of the crystal grain is denoted by L1 and a length in a direction perpendicular to the rolling direction of the crystal grain is denoted by L2, an average value of L1/L2 is equal to or greater than 1.02 and equal to or less than 4.5.

7. The high-strength and high-electrical conductivity copper alloy rolled sheet according to claim 1, wherein the tensile strength at 350° C. is equal to or greater than 300(N/mm$^2$).

8. The high-strength and high-electrical conductivity copper alloy rolled sheet according to claim 1, wherein Vickers hardness (HV) after heating at 700° C. for 30 seconds is equal to or greater than 100, or 80% or greater of a value of Vickers hardness before the heating, or, a recrystallization ratio in the metal structure after heating is equal to or less than 45%.

9. The high-strength and high-electrical conductivity copper alloy rolled sheet according to claim 2, wherein at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr is further contained.

10. The high-strength and high-electrical conductivity copper alloy rolled sheet according to claim 3, wherein at least one of 0.002 to 0.2 mass % of Al, 0.002 to 0.6 mass % of Zn, 0.002 to 0.6 mass % of Ag, 0.002 to 0.2 mass % of Mg and 0.001 to 0.1 mass % of Zr is further contained.

11. The high-strength and high-electrical conductivity copper alloy rolled sheet according to claim 1, wherein the precipitates have an average grain diameter of 2.0 to 11 nm.

12. A high-strength and high-electrical conductivity copper alloy rolled sheet which has an alloy composition comprising 0.14 to 0.34 mass % of Co, 0.046 to 0.098 mass % of P, 0.005 to 1.4 mass % of Sn and the balance including Cu and inevitable impurities and is manufactured by a manufacturing process including a casting process, a cutting process, a heating process, a hot rolling process, a cold rolling process and a precipitation heat treatment process in this order, wherein a start temperature of the hot rolling process is in the range of 830 to 960° C. to heat and provide a hot-rolled ingot, wherein the hot-rolled ingot is subjected to a cooling step to obtain a solid solution of Co and P and a recrystallized structure having an average grain size of equal to or larger than 6 μm and equal to or smaller than 50 μm, and wherein the cooling step is selected from the group consisting of: (i) wherein the hot-rolled ingot is cooled with a cooling rate of 2° C./sec or greater from a temperature of the hot-rolled ingot subjected to a final pass of the hot rolling process to 350° C., and (ii) wherein the hot-rolled ingot is cooled with a cooling rate of 2° C./sec or greater from 650° C. to 350° C., wherein [Co] mass % representing a Co content and [P] mass % representing a P content satisfy the relationship of $3.0\leq([Co]-0.007)/([P]-0.009)\leq 5.9$, a total cold rolling ratio is equal to or greater than 70%, after a final precipitation heat treatment process, a recrystallization ratio is equal to or less than 45%, circular or elliptical precipitates are present in a metal structure, the precipitates are fine precipitates of which 90% or greater are equal to or less than 25 nm in diameter, and the precipitates are uniformly dispersed, wherein after the final precipitation heat treatment, the metal structure includes a fibrous metal structure extending in a rolling direction of the metal structure, and in the fibrous metal structure fine crystals are present which have no annealing twin crystals and in which an average long/short ratio, which is observed from an inverse pole figure (IPF) map and a grain boundary map in an EBSP analysis result, is equal to or greater than 2 and equal to or less than 15, and an average grain size of both of the fine crystals and recrystallized grains is in the range of 0.5 to 6 μm and a proportion of the area of both of the fine crystals and recrystallized grains to the whole metal structure in the observation plane is in the range of 0.5% to 45%.

13. A high-strength and high-electrical conductivity copper alloy rolled sheet which has an alloy composition comprising 0.14 to 0.34 mass % of Co, 0.046 to 0.098 mass % of P, 0.005 to 1.4 mass % of Sn and the balance including Cu and inevitable impurities and is manufactured by a manufacturing process including a casting process, a cutting process, a heating process, a hot rolling process, a cold rolling process and a precipitation heat treatment process in this order, wherein a start temperature of the hot rolling process is in the range of 830 to 960° C. to heat and provide a hot-rolled ingot, wherein the hot-rolled ingot is subjected to a cooling step to obtain a solid solution of Co and P and a recrystallized structure having an average grain size of equal to or larger than 6 μm and equal to or smaller than 50 μm, and wherein the cooling step is selected from the group consisting of: (i) wherein the hot-rolled ingot is cooled with a cooling rate of 2° C./sec or greater from a temperature of the hot-rolled ingot subjected to a final pass of the hot rolling process to 350° C., and (ii) wherein the hot-rolled ingot is cooled with a cooling rate of 2° C./sec or greater from 650° C. to 350° C., wherein [Co] mass % representing a Co content and [P] mass % representing a P content satisfy the relationship of $3.0\leq([Co]-0.007)/([P]-0.009)\leq 5.9$, a total cold rolling ratio is equal to or greater than 70%, after a final precipitation heat treatment process, a recrystallization ratio is equal to or less than 45%, circular or elliptical precipitates are present in a metal structure, the precipitates are fine precipitates of which have an average grain diameter of 2.0 to 11 nm, and the precipitates are uniformly dispersed, wherein after the final precipitation heat treatment, the metal structure includes a fibrous metal structure extending in a rolling direction of the metal structure, and in the fibrous metal structure fine crystals are present which have no annealing twin crystals and in which an average long/short ratio, which is observed from an inverse pole figure (IPF) map and a grain boundary map in an EBSP analysis result, is equal to or greater than 2 and equal to or less than 15, and an average grain size of both of the fine crystals and recrystallized grains is in the range of 0.5 to 6 μm and a proportion of the area of both of the fine crystals and recrystallized grains to the whole metal structure in the observation plane is in the range of 0.5% to 45%.

* * * * *